US009528177B2

(12) United States Patent
Liu

(10) Patent No.: US 9,528,177 B2
(45) Date of Patent: Dec. 27, 2016

(54) COMPOSITION DESIGN AND PROCESSING METHODS OF HIGH STRENGTH, HIGH DUCTILITY, AND HIGH CORROSION RESISTANCE FEMNALC ALLOYS

(71) Applicant: Apogean Metal Incorporation, Taipei (TW)

(72) Inventor: Tzeng-Feng Liu, Hsinchu (TW)

(73) Assignee: Apogean Metal Incorporation, Taipei (TW)

( * ) Notice: Subject to any disclaimer, the term of this patent is extended or adjusted under 35 U.S.C. 154(b) by 741 days.

(21) Appl. No.: 13/628,808

(22) Filed: Sep. 27, 2012

(65) Prior Publication Data

US 2013/0081740 A1 Apr. 4, 2013

(30) Foreign Application Priority Data

Sep. 29, 2011 (TW) ..... 100135434 A

(51) Int. Cl.
*C21D 8/00* (2006.01)
*C23C 8/38* (2006.01)
(Continued)

(52) U.S. Cl.
CPC ..... *C23C 8/38* (2013.01); *C21D 8/005* (2013.01); *C22C 38/04* (2013.01); *C22C 38/06* (2013.01); *C23C 8/02* (2013.01); *C23C 8/26* (2013.01)

(58) Field of Classification Search
CPC ..... C21D 8/005; C21D 8/00; C23C 8/38
(Continued)

(56) References Cited

U.S. PATENT DOCUMENTS 4,975,335 A * 12/1990 Wan ..... 428/610
5,431,753 A 7/1995 Kim et al.
6,617,050 B2 9/2003 Chao

FOREIGN PATENT DOCUMENTS

TW 460591 10/2001
TW 584568 4/2004
TW I279448 4/2007

OTHER PUBLICATIONS

S.M. Zhu, "Creep and Rupture Properties of an Austenitic Fe—30Mn—9Al—1C Alloy," Metallurgical and Materials Transactions A, vol. 29A, Jan. 1998, pp. 299-306.
(Continued)

*Primary Examiner* — Brian Walck
(74) *Attorney, Agent, or Firm* — Muncy, Geissler, Olds & Lowe, P.C.

(57) ABSTRACT

A novel FeMnAlC alloy, comprising 23~34 wt. % Mn, 6~12 wt. % Al, and 1.4~2.2 wt. % C with the balance being Fe, is disclosed. The as-quenched alloy contains an extremely high density of nano-sized $(Fe,Mn)_3AlC_x$ carbides (κ'-carbides) formed within austenite matrix by spinodal decomposition during quenching. With almost equivalent elongation, the yield strength of the present alloys after aging is about 30% higher than that of the optimally aged FeMnAlC (C≤1.3 wt. %) alloy systems disclosed in prior arts. Moreover, the as-quenched alloy is directly nitrided at 450~550° C., the resultant surface microhardness and corrosion resistance in 3.5% NaCl solution are far superior to those obtained previously for the optimally nitrided commercial alloy steels and stainless steels, presumably due to the formation of a nitrided layer consisting predominantly of AlN.

16 Claims, 39 Drawing Sheets

(51) Int. Cl.

| | |
|---|---|
| ***C23C 8/26*** | (2006.01) |
| ***C22C 38/06*** | (2006.01) |
| ***C23C 8/02*** | (2006.01) |
| ***C22C 38/04*** | (2006.01) |

(58) Field of Classification Search
USPC ..... 148/206, 222, 238, 620
See application file for complete search history.

(56) References Cited

OTHER PUBLICATIONS

J.S. Chou et al., "Observations of Deformation Twins in Hih-Temperatture Tensile Tests of an Fe—28.0Mn—7.5A1-0.75C Alloy," Scripta Metallurgica, vol. 26, 1992, pp. 261-266.
T.F. Liu et al., "Effect of Si Addition on the Microstructure of an Fe—8.0Al—29.0Mn—0.90C Alloy," Metallurgical Transactions A, vol. 21A, Jul. 1990, pp. 1891-1899.
S.C. Tjong et al., "Tensile Deformation Behavior and Work Hardening Mechanism of Fe—28Mn—9Al—0.4C and Fe—28Mn-9A1-1C Alloys," Materials Transactions, JIM. vol. 38, No. 2, 1997, pp. 112-118.
S.C. Chang et al., "Tensile and fatigue properties of Fe—Mn—Al—C alloys," Journal of Materials Science 24, 1989, pp. 1117-1120.
K.S. Chan et al., "Serrated Flow and Dynamic Precipitation in Elevated Temperature Tensile Deformation of Fe—Mn—Al—C Alloys," Materials Transactions, JIM, vol. 38, No. 5, 1997, pp. 420-426.
J.D. Yoo et al., "Factors influencing the tensile behavior of a Fe—28Mn—9Al—0.8C steel," Materials Science and Engineering A 508, 2009, pp. 234-240.
H.J. Lai et al., "The study of work hardening in Fe—Mn—Al—C alloys," Journal of Materials Science 24, 1989, pp. 2449-2453.
J.E. Krzanowski, "The Effects of Heat Treatment and Cold Working on the Room-Temperature and Cryogenic Mechanical Properties of Fe—30Mn—9Al—0.9C Steel," Metallurgical Transactions A, vol. 9A, Jul. 1988, pp. 1873-1876.
K. Sato et al., "Age Hardening of an Fe—30Mn—9Al—0.9C Alloy by Spinodal Decomposition," Scripta Metallurgica, vol. 22, 1988, pp. 899-902.
K. Sato et al., "Spinodal Decomposition and Mechanical Properties of an Austenitic Fe—30wt.%Mn—9wt.%Al—0.9wt%C Alloy," Materials Science and Engineering, AIII, 1989, pp. 45-50.
I. Kalashnikov et al., "Chemical Composition Optimization for Austenitic Steels of the Fe—Mn—Al—C System," Journal of Materials Engineering and Performance, vol. 9(6), Dec. 2000, pp. 597-602.
W.K. Choo et al., "Microstructural Change in Austenitic Fe—30.0wt%Mn—7.8wt%Al—1.3wt%C Initiated by Spinodal Decomposition and its Influence on Mechanical Properties," Acta. Mater. vol. 45, No. 12, 1997, pp. 4877-4885.
K. Sato et al., "Modulated Structure and Magnetic Properties of Age-Hardenable Fe—Mn—Al—C Alloys," Metallurgical Transactions A, vol. 21A, Jan. 1990, pp. 5-11.
S.C. Tjong et al., "The Microstructure and Stress Corrosion Cracking Behaviour of Precipitation-hardened Fe—8.7Al—29.7Mn—1.04C Alloy in 20% NaCl Solution," Materials Science and Engineering, 80, 1986, pp. 203-211.
C.N. Hwang et al., "Grain Boundary Precipitation in an Fe—8.0Al—31.5Mn—1.05C Alloy," Scripta Metallurgica, vol. 28, 1993, pp. 263-268.
C.Y. Chao et al., "Grain Boundary Precipitation in an Fe—7.8Al—31.7Mn—0.54C Alloy," Scripta Metallurgica, vol. 28, 1993, pp. 109-114.
T.F. Liu et al., "Studies of Microstructures and Strength of Fe—Al—Mn Alloys," Strength of Metals and Alloys ICSMA 7, 1985, pp. 423-427.
G.S. Krivonogov et al., "Phase Transformation Kinetics in Steel . . . ," Fiz. Metal. Metalloved., 39, No. 4, 1975, pp. 775-781.
R.K. You et al., "Mechanical Properties of Fe—30Mn—10Al—1C—1Si Alloy," Materials Science and Engineering, A117, 1989, pp. 141-148.
I.S. Kalashnikov et al., "Alloying of Steels of the Fe—Mn—Al—C System with Refractory Elements," Metal Science and Heat Treatment, vol. 43, Nos. 11-12, 2001, pp. 493-496.
I.S. Kalashnikov et al., "Heat Treatment and thermal stability of FeMnAlC alloys," Journal of Materials Processing Technology 136, 2003, pp. 72-79.
K.H. Han, "The microstructures and mechanical properties of an austenitic Nb—bearing Fe—Mn—Al—C alloy processed by controlled rolling," Materials Science and Engineering A279, 2000, pp. 1-9.
C.S. Wang et al., "Effect of Chromium Content on Corrosion Behaviors of Fe—9Al—30Mn—(3,5,6.5,8)Cr—1C Alloys," Materials Transactions, vol. 48, No. 11, 2007, pp. 2973-2977.
S.C. Chang et al., "Environment-Assisted Cracking of Fe—32% Mn—9% Al Alloys in 3.5% Sodium Chloride Solution," Corrosion Engineering, vol. 51, No. 5, 1995, pp. 399-406.
S.C. Chang et al., "The cavitation erosion of Fe—Mn—Al alloys," Wear 181-183, 1995, pp. 511-515.
C.J. Wang et al., "NaCl-induced hot corrosion of Fe—Mn—Al—C alloys," Materials Chemistry and Physics 76, 2002, pp. 151-161.
J.B. Duh et al., "Electrochemical and Corrosion Fatigue Behavior of FeAlMn Alloys in NaCl Solution," Corrosion Science, vol. 44, No. 11, 1988, pp. 810-818.
M. Ruscak et al., "Effect of Ferrite on Corrosion of Fe—Mn—Al Alloys in Sodium Chloride Solution," Corrosion Science, vol. 51, No. 10, 1995, pp. 738-743.
S.T. Shin et al., "Corrosion Behavior of Two-Phase Fe—Mn—Al Alloys in 3.5% NaCl Solution," Corrosion, vol. 49, No. 2, 1993, pp. 130-134.
Y.H. Tuan et al., "Corrosion behaviors of austenitic Fe—30Mn—7A1—xCr—1C alloys in 3.5% NaCl solution," Materials Chemistry and Physics 114, 2009, pp. 595-598.
Y.H. Tuan et al., "Grain Boundary Precipitation in Fe—30Mn—9Al—5Cr—0.7C Alloy," Materials Transactions, vol. 49, No. 7, 2008, pp. 1589-1593.
W. Liang, "Surface modification of AISI 304 austenitic stainless steel by plasma nitriding," Applied Surface Science 211, 2003, pp. 308-314.
R.L. Liu et al., "The microstructure and properties of 17-4PH martensitic precipitation hardening stainless steel modified by plasma nitrocarburizing," Surface & Coatings Technology 204, 2010, pp. 2251-2256.
R.L. Liu et al., "Improvement of wear and corrosion resistances of 17-4PH stainless steel by plasma nitrocarburizing," Materials and Design 31, 2010, pp. 2355-2359.
M.F. Yan et al., "Influence of proccess time on microstructure and properties of 17-4PH steel plasma nitrocarburized with rare earths addition at low temperature," Applied Surface Science 256, 2010, pp. 6065-6071.
M.F. Yan et al., "Martensitic stainless steel modified by plasma nitrobarburizing at conventional temperature with and without rare earths addition," Surface & Coatings Technology 205, 2010, pp. 345-349.
M. Esfandiari et al., "The corrosion and corrosion-wear behaviour of plasma nitrided 17-4PH precipitation hardening stainless steel," Surface & Coatings Technology 202, 2007, pp. 466-478.
C.X. Li et al, "Corrosion properties of plasma nitrided AISI 410 martensitic stainless steel in 3.5% of NaCl and 1% HCI aqueous solutions," Corrosion Science 48, 2006, pp. 2036-2049.
C.X. Li et al., "Corrosion properties of active screen plasma nitrided 316 austenitic stainless steel," Corrosion Science 46, 2004, pp. 1527-1547.
L. Shen et al., "Plasma nitriding of AISI 304 austenitic stainless steel with pre-shot peening," Surface & Coatings Technology 204, 2010, pp. 3222-3227.
S.V. Phadnis et al., "Comparison of rolled and heat treated SS304 in chloride solution using electrochemical and XPS techniques," Corrosion Science 45, 2003, pp. 2467-2483.

* cited by examiner

| Alloy No. | Alloy Composition (wt.%) | | | | | Characteristics of microstructure |
|---|---|---|---|---|---|---|
| | Fe | Mn | Al | C | Other element(s) | |
| 1. | Bal. | 29.1 | 9.82 | 1.45 | | NO.1~22: some examples of alloy compositions disclosed in the present invention. The alloys were solution heat-treated at 980℃~1200℃, and then quenched into room-temperature water or ice water. The as-quenched microstructure is γ+nano-sized κ′-carbides without any grain boundary precipitates. The nano-sized κ′-carbides were formed within the γ-matrix during quenching by spinodal decomposition. Depending on the alloy composition, the size of the κ′-carbides in the as-quenched condition is about 5.5~13.5nm. |
| 2. | Bal. | 29.3 | 9.83 | 1.58 | | |
| 3. | Bal. | 28.7 | 9.78 | 1.71 | | |
| 4. | Bal. | 29.0 | 9.76 | 1.82 | | |
| 5. | Bal. | 28.9 | 9.81 | 1.95 | | |
| 6. | Bal. | 28.6 | 9.84 | 2.05 | | |
| 7. | Bal. | 26.9 | 8.86 | 1.76 | | |
| 8. | Bal. | 28.6 | 9.26 | 1.98 | | |
| 9. | Bal. | 25.9 | 9.35 | 1.62 | | |
| 10. | Bal. | 27.8 | 6.86 | 1.92 | | |
| 11. | Bal. | 23.6 | 8.56 | 1.78 | | |
| 12. | Bal. | 27.5 | 7.82 | 2.03 | | |
| 13. | Bal. | 31.5 | 6.25 | 1.69 | | |
| 14. | Bal. | 29.2 | 8.76 | 1.43 | | |
| 15. | Bal. | 24.8 | 8.91 | 1.56 | | |
| 16. | Bal. | 27.6 | 9.06 | 1.96 | | |
| 17. | Bal. | 27.8 | 10.32 | 1.78 | | |
| 18. | Bal. | 31.3 | 8.02 | 1.83 | | |
| 19. | Bal. | 24.2 | 10.42 | 1.48 | | |
| 20. | Bal. | 30.5 | 8.68 | 1.80 | | |
| 21. | Bal. | 26.5 | 6.31 | 1.75 | | |
| 22. | Bal. | 28.5 | 7.86 | 1.85 | | |
| 23. | Bal. | 28.8 | 9.81 | 1.35 | | Single γ-phase, no precipitate in the as-quenched condition. |
| 24. | Bal. | 29.5 | 8.92 | 1.28 | | |
| 25. | Bal. | 28.2 | 8.87 | 2.18 | | γ+nano-sized κ′-carbides with some coarse κ-carbides formed on the γ grain boundaries in as-quenched condition. |
| 26. | Bal. | 29.3 | 9.06 | 2.21 | | |
| 27. | Bal. | 28.9 | 5.61 | 1.82 | | Single γ-phase, no precipitates in the as-quenched condition. |
| 28. | Bal. | 27.8 | 5.12 | 1.68 | | |
| 29. | Bal. | 29.0 | 7.66 | 1.82 | Cr:3.28 | Alloys 29~30: The microstructure is single γ-phase + nano-sized κ′-carbides in the as-quenched condition. However, there are coarse Cr-rich carbides formed on the γ grain boundaries after aging. Alloys 31~32: The microstructure is single γ-phase + nano-sized κ′-carbides with coarse Cr-rich carbides formed on the γ grain boundaries in the as-quenched condition. |
| 30. | Bal. | 27.8 | 8.15 | 1.91 | Cr:4.65 | |
| 31. | Bal. | 28.1 | 9.02 | 1.75 | Cr:6.46 | |
| 32. | Bal. | 28.5 | 8.90 | 1.65 | Cr:7.10 | |
| 33. | Bal. | 26.9 | 8.52 | 1.85 | Ti:2.02 | γ + nano-sized κ′-carbides with coarse Ti-rich carbides formed on γ grain boundaries in the as-quenched condition. |
| 34. | Bal | 28.3 | 9.12 | 1.69 | Ti:1.25 | |
| 35 | Bal. | 29.1 | 9.22 | 1.85 | Si:0.80 | γ + nano-sized κ′-carbides with coarse $DO_3$ phase formed on γ grain boundaries in the as-quenched condition. |
| 36. | Bal. | 28.3 | 9.12 | 1.69 | Mo:1.05 | γ + nano-sized κ′-carbides in the as-quenched condition, but there are coarse Mo-rich carbides formed on the γ grain boundaries after aging. |
| 37. | Bal. | 26~34 | 6~11 | 0.54~1.3 | | Single γ-phase without any precipitate in the as-quenched condition. |
| 38. | Bal. | 25~31 | 6.3~10 | 0.65~1.1 | V:0~0.75,Nb:0~0.6 W:0~0.8,Mo:0~1.5 | Single γ-phase with small amount of (V,Nb)C carbides in the as-quenched condition |

Note: No. 1~22 are alloys disclosed in the present invention ; No. 23~36 are comparative alloys ; No. 37~38 are alloys disclosed in prior arts.

Figure 8

| Patents of ROC(US) | Composition ranges (in wt.%) claimed. (*: concentrations of selected alloying elements optional to the claimed alloy compositions) | | | | | | | | | | | | |
|---|---|---|---|---|---|---|---|---|---|---|---|---|---|
| Patent no. | Fe | Mn | Al | C | Cr | Si | Mo | Nb | Ti | Co | Cu | N | |
| This invention | Bal. | 23~34 | 6~12 | 1.4~2.2 | | | | | | | | | |
| 185568 | Bal. | 26~28 | 6.5~8 | 0.9~1.1 | 5~6 | 0.2~1.5 | 1.0~1.2 | | | | 0.9~1.1 | 0.02~0.04 | |
| 460591 (same as US6617050) | Bal. | 25~31 | 6.3~7.8 | 0.65~0.85 | 5.5~9 | *0.8~1.5 | *0.5~1.0 | | *2.0~5.0 | | | | |
| 506845 (same as US0082067) | Bal. | 28~31.5 | 7.8~10 | 0.9~1.1 | *5~7 | *0.8~1.5 | | | 0.35~2.5 | | | | |
| 584568 (same as US0006007) | Bal. | 25~31 | 7~10 | 0.9~1.1 | 5~7 | *0.8~1.5 | *0.5~1.0 | | | | | | |
| I235677 | Bal. | 23~30 | 6.3~10 | 0.8~1.05 | 5~9 | *0.6~1.0 | | | | 0.2~10 | | 0.2~0.4 | |
| I279448 | Bal. | 23~33 | 8.1~9.8 | 0.6~1.2 | 3~7.8 | 0.1~0.5 | | | | | | | |
| US5647922 | Bal. | 15~35 | 0.1~6.0 | <1.5 | | | | | | | | | Consisting of at least one of the followings: 0.0005-0.04%B, 0.0005-0.050.%Ti, 0.0005-0.050.%Zr, 0.0005-0.040%La, 0.0005-0.040%Ce, 0.0005-0.030%Ca |
| US5431753 | Bal. | 15~35 | 0.1~6.0 | <1.5 | <9.0 | <0.6 | | <1.0 | <0.5 | | <5.0 | <0.2 | <0.5%V, <4.0%Ni |
| US4968357 | Bal. | 22~36 | 4.5~10.5 | 0.4~1.25 | | | | | | | | | Consisting of at least one of the followings: 0.06-0.50%Ti, 0.02~0.2% Nb and 0.10-0.40%V |
| US4875933 | Bal. | 10~45 | 4~15 | 0.01~1.4 | 0~12 | 0~2.5 | *0.1~3.5 | *0.1~3.5 | *0.1~3.5 | | *0.1~3.5 | | It could consist of 0.1-3.5%V、W；0.1-7.5%Ni；0.01-1.0%Y, Sc, Ta and Hf |
| FeMnAlC | Bal. | 26~34 | 6~11 | 0.54~1.3 | | | | | | | | | Refs. (1)-(20) of the present invention |
| FeMnAlMC | Bal. | 25~31 | 6.3~10 | 0.65~1.1 | | | | | | | | | M=(V, Nb, W, Mo), M≤1.75wt.%，Refs. (21)-(25) of the present invention |
| FeMnAlCrC | Bal. | 26.5~31 | 6.85~10 | 0.69~1.06 | 2.6~9.56 | | | | | | | | Refs. (26)-(39) of the present invention |

Figure 9

| Alloy Composition (wt.%) | Heat-treatment Conditions | Mechanical Properties | | |
|---|---|---|---|---|
| | | U.T.S.(MPa) | Y.S. (MPa) | El. (%) |
| Fe-29.0%Mn-9.76%Al-1.82%C (alloy of present invention) | solution heat-treated | 1082 | 872 | 55.3 |
| | aged at 450℃ for 9 hours | 1487 | 1383 | 32.5 |
| | aged at 450℃ for 12 hours | 1530 | 1417 | 28.0 |
| | aged at 500℃ for 8 hours | 1402 | 1290 | 32.2 |
| Fe-28.6%Mn-9.84%Al-2.05%C (alloy of present invention) | solution heat-treated | 1123 | 912 | 52.5 |
| | aged at 450℃ for 9 hours | 1518 | 1414 | 30.8 |
| | aged at 450℃ for 12 hours | 1552 | 1432 | 26.3 |
| | aged at 500℃ for 8 hours | 1438 | 1312 | 31.4 |
| Fe-(26~34)%Mn-(6~11)%Al-(0.54~1.3)%C (Fe-Mn-Al-C alloys disclosed in prior arts) | solution heat-treated | 840~993 | 410~551 | 72~52 |
| | aged at 550℃ for 15~16 hours | 1130~1220 | 890~1080 | 39~31.5 |
| Fe-(25~31)%Mn-(6.3~10)%Al-(0.6~1.75)%M -(0.65~1.1)% C (Fe-Mn-Al-C alloys disclosed in prior arts) | solution heat-treated | 814~993 | 423~552 | 70~50 |
| | aged at 550℃ for 15~16 hours | 953~1259 | 910~1094 | 41~26 |

Figure 12

| Alloys | Alloy Composition (wt.%) | Tensile Mechanical Properties | | | Polarization data in 3.5% NaCl solution | | | Hardness after nitriding (Hv) | |
|---|---|---|---|---|---|---|---|---|---|
| | | U.T.S. (MPa) | Y.S. (MPa) | El. (%) | | Corrosion potential(mV) | Pitting potential(mV) | Surface hardness(Hv) | Matrix hardness (Hv) |
| Alloys of present invention | Fe-28.6%Mn-9.26%Al-1.98%C [450℃,12 hours] | 1512 | 1402 | 30.5 | un-nitrided | - 750 | - 520 | --- | --- |
| | | | | | nitrided | + 45 | + 1910 | 1735 | 560 |
| | Fe-30.5%Mn-8.68%Al-1.85%C [500℃,8 hours] | 1388 | 1286 | 33.6 | un-nitrided | - 730 | - 500 | --- | --- |
| | | | | | nitrided | + 50 | + 2030 | 1860 | 550 |
| | Fe-28.5%Mn-7.86%Al-1.85%C [550℃,4 hours] | 1363 | 1218 | 33.5 | un-nitrided | - 720 | - 530 | --- | --- |
| | | | | | nitrided | + 160 | + 2810 | 1514 | 530 |
| AISI 4140 alloy steel | 0.41%C,0.21%Si,0.83%Mn, 0.91%Cr,0.18%Mo | 1020 | 910 | 19 | un-nitrided | - 800~ - 650 | --- | --- | --- |
| | | (595℃ tempering 0.5 hour) | | | nitrided | - 890~ - 400 | - 290~ + 500 | 660~710 | 320 |
| AISI 4340 alloy steel | 0.40%C,0.23%Si,0.73%Mn, 1.78%Ni,0.80%Cr, 0.28%Mo | 1055 | 930 | 18 | un-nitrided | - 551~ - 410 | --- | --- | --- |
| | | (650℃ tempering 0.5 hour) | | | nitrided | - 521~ - 270 | - 160~ + 500 | 610~890 | 220~320 |
| AISI 304 stainless steel | 18%Cr,8%Ni, | 515~559 | 205~269 | 55~40 | un-nitrided | - 420~ - 215 | + 50 ~ + 150 | --- | --- |
| | | | | | nitrided | - 230 ~ - 98 | + 400 ~ + 600 | 1000~1500 | 220~250 |
| AISI 316L stainless steel | 17%Cr,12%Ni,2.5%Mo | 480~580 | 170~290 | 50~40 | un-nitrided | - 300 ~ - 186 | + 200 ~ + 400 | --- | --- |
| | | | | | nitrided | - 300 ~ - 186 | + 200 ~ +1400 | 1202~1300 | 195~220 |
| AISI 410 martensitic stainless steel | 12.5%Cr, 0.15%C | 900 | 740 | 20 | un-nitrided | - 684 ~ - 312 | - 250 ~ + 55 | --- | --- |
| | | (600 ℃ tempering 2 hours) | | | nitrided | - 308 ~ - 30 | 0 ~ + 600 | 725~1204 | 262~500 |
| AISI 17-4PH precipitation-hardening stainless steel | 16%Cr, 4.2%Ni, 3.4%Cu, 0.6%Si, 0.3%Mn, 0.25%Nb, 0.04%C | 1310 | 1207 | 14 | un-nitrided | - 400 ~ - 200 | + 40 ~ + 180 | --- | --- |
| | | (450 ℃ aging 1 hour) | | | nitrided | - 340 ~ - 20 | + 75 ~ +750 | 816~1235 | 360~426 |

Note 1: In this table, the alloys of the present invention were nitrided by plasma nitriding (450℃ and 500℃) and gas nitriding (550℃), respectively. Note 2: AISI 4140 and 4340 alloy steels were nitrided by plasma nitriding at 475~540℃ for 4~8 h; the stainless steels were nitrided by plasma nitriding at 420~480℃ for 8~20 h. Note 3: polarization data for the present alloys and comparative commercially alloys were obtained with the same Standard Calomel Electrode (SCE) and in 3.5% NaCl solution

Figure 15

COMPOSITION DESIGN AND PROCESSING METHODS OF HIGH STRENGTH, HIGH DUCTILITY, AND HIGH CORROSION RESISTANCE FEMNALC ALLOYS

BACKGROUND OF THE INVENTION

1. Field of Invention

The present invention relates to the composition design and processing methods of the FeMnAlC alloys; and particularly to the methods of fabricating FeMnAlC alloys which simultaneously exhibit high strength, high ductility, and high corrosion resistance.

2. Description of the Prior Art

Austenitic FeMnAlC alloys have been subjected to extensive researches over the last several decades, because of their promising application potential associated with the high mechanical strength and high ductility. In the FeMnAlC alloy systems, both Mn and C are the austenite-stabilizing elements. The austenite (γ) phase has a face-center-cubic (FCC) structure; while Al is the stabilizer of the ferrite (α) phase having a body-center-cubic (BCC) structure. Hence, by properly adjusting the contents of the three alloying elements, it is possible to obtain fully austenitic FeMnAlC alloys at room temperature. Prior arts showed that the microstructure of the FeMnAlC alloys with a chemical composition in the range of Fe-(26-34) wt. % Mn-(6-11) wt. % Al-(0.54-1.3) wt. % C was purely single γ-phase without any precipitates after the alloys were solution heat-treated at 980-1200° C. and then quenched to room-temperature or ice water. Depending on the chemical composition, the ultimate tensile strength (UTS), yield strength (YS), and elongation of the as-quenched alloys were 814~993 MPa, 423~552 MPa, and 72-50%, respectively. These results indicate that, although it is possible to obtain single γ-phase with excellent ductility in as-quenched FeMnAlC alloys by properly adjusting the alloy compositions, the mechanical strength of these alloys is relatively low. Thus, prior arts are unable to achieve the goal of obtaining alloys that simultaneously possess high mechanical strength and high ductility in the as-quenched state.

In order to improve the mechanical strength of the Fe—Mn—Al—C alloys, prior arts have revealed that when the as-quenched alloys were aged at 500-650° C. for moderate times, a high density of fine $(Fe,Mn)_3AlC_x$ carbides (so-called κ'-carbides) was found to precipitate coherently within the austenite matrix. The κ'-carbide has an ordered face-center-cubic (FCC) $L'1_2$ crystal structure. From these extensive studies disclosed in the prior arts, the significant improvement of the mechanical strength obtained in the aged FeMnAlC alloys is mainly due to the coherent precipitation of the fine κ'-carbides. However, since the κ'-carbides are rich in carbon and aluminum, the precipitation of these carbides from the supersaturated austenite matrix involves diffusion process of large amount of carbon and relevant alloy elements. Consequently, longer aging time and/or higher aging temperature are usually required. From numerous studies reported previously, an optimal combination of strength and ductility for the FeMnAlC alloys could be obtained through aging treatment at 550° C. for 15~16 hours. This is primarily because that under these treatment conditions, a tremendous amount of fine κ'-carbides was found to precipitate within the austenite matrix and no precipitates were formed on the grain boundaries. According to the prior arts, depending on the alloy compositions, the UTS, YS and El of the FeMnAlC alloys aged at 550° C. for 15~16 hours can reach 1130~1220 MPa, 890~1080 MPa and 39~31.5%, respectively. However, if the aging process was performed at 450° C., it may take more than 500 hours to reach the same level of mechanical strength. Similarly, for 500° C. aging treatment, 50~100 hours were needed.

In another embodiment, prior arts also tried to prolong the aging time at 550~650° C. However, it was found that prolonged aging not only resulted in the growth of the fine κ'-carbides but also led to the $\gamma \rightarrow \gamma_0+\kappa$, $\gamma_0+\kappa$, $\gamma \rightarrow \alpha+\kappa$, $\gamma \rightarrow \kappa+\beta$-Mn, or $\gamma \rightarrow \alpha+\kappa+\beta$-Mn reactions occurring on grain boundaries. Where $\gamma_0$ is the carbon-depleted γ phase and the κ-carbides have the same ordered FCC $L'1_2$ structure as the κ'-carbide, except that they usually precipitate on the grain boundaries with larger size. [Note: Conventionally, for distinction purpose, the finer $(Fe,Mn)_3AlC_x$ carbides formed within the austenite matrix are termed as "κ'-carbides", while the coarser $(Fe,Mn)_3AlC_x$ carbides formed on the grain boundaries are termed as "κ-carbides".] As a result, prolonged aging treatments frequently resulted in embrittlement of the alloys due to the precipitation of coarse κ-carbides on the grain boundaries.

The following publications gave more detailed descriptions and discussions of the abovementioned characteristics [1]-[20].

(1) S. M. Zhu and S. C. Tjong: Metall. Mater. Trans. A. 29 (1998) 299-306. (2) J. S. Chou and C. G. Chao: Scr. Metall. 26 (1992) 261-266. (3) T. F. Liu, J. S. Chou, and C. C. Wu: Metall. Trans. A. 21 (1990) 1891-1899. (4) S. C. Tjong and S. M. Zhu: Mater. Trans. 38 (1997) 112-118. (5) S. C. Chang, Y. H. Hsiau and M. T. Jahn: J. Mater. Sci. 24 (1989) 1117-1120. (6) K. S. Chan, L. H. Chen and T. S. Liu: Mater. Trans. 38 (1997) 420-426. (7) J. D. Yoo, S. W. Hwang and K. T. Park: Mater. Sci. Eng. A. 508 (2009) 234-240. (8) H. J. Lai and C. M. Wan: J. Mater. Sci. 24 (1989) 2449-2453. (9) J. E. Krzanowski: Metall. Trans. A. 19 (1988) 1873-1876. (10) K. Sato, K. Tagawa and Y. Inoue: Scr. Metall. 22 (1988) 899-902. (11) K. Sato, K. Tagawa and Y. Inoue: Mater. Sci. Eng. A. 111 (1989) 45-50. (12) I. Kalashnikov, O. Acselrad, A. Shalkevich and L. C. Pereira: J. Mater. Eng. Perform. 9 (2000) 597-602. (13) W. K. Choo, J. H. Kim and J. C. Yoon: Acta Mater. 45 (1997) 4877-4885. (14) K. Sato, K. Tagawa and Y. Inoue: Metall. Trans. A. 21 (1990) 5-11. (15) S. C. Tjong and C. S. Wu: Mater. Sci. Eng. 80 (1986) 203-211. (16) C. N. Hwang, C. Y. Chao and T. F. Liu: Ser. Metall. 28 (1993) 263-268. (17) C. Y. Chao, C. N. Hwang and T. F. Liu: Scr. Metall. (1993) 109-114. (18) T. F. Liu and C. M. Wan, Strength Met. Alloys, 1 (1986) 423-427. (19) G. S. Krivonogov, M. F. Alekseyenko and G. G. Solov'yeva, Fiz. Metal. Metallov ed., 39, No. 4 (1975) 775-781. (20) R. K. You, P. W. Kao and D. Gran, Mater. Sci. Eng., A117 (1989) 141-147.

Another method disclosed in the prior arts to further enhance the strength was adding small amounts of V, Nb, W and Mo to the austenitic FeMnAlC (C≤1.3 wt. %) alloys. After solution heat-treatment or controlled-rolling followed by an optimal aging at 550° C. for about 16 hrs, the UTS, YS, and El of the Fe-(25-31) wt. % Mn-(6.3-10) wt. % Al-(0.6-1.75) wt. % M(M=V, Nb, W, Mo)-(0.65-1.1) wt. % C alloys were significantly increased up to 953~4259 MPa, 910~1094 MPa, and 41~26%, respectively.

The following publications gave more detailed descriptions and discussions of the abovementioned characteristics [21]-[25].

(21) I. S. Kalashnikov, B. S. Ermakov, O. Aksel'rad and L. K. Pereira, Metal. Sci. Heat. Treat. 43 (2001) 493-496. (22) I. S. Kalashnikov, O. Acselrad, A. Shalkevich, L. D. Chumakova and L. C. Pereira, J. Mater. Proc. Tech. 136

(2003) 72-79. (23) K. H. Han, Mater. Sci. Eng. A 279 (2000) 1-9. (24) G. S. Krivonogov, M. F. Alekseyenko and G. G. Solov'yeva, Fiz. Metall. Metalloved. 39 (1975) 775. (25) I. S. Kalashnikov, B. S. Ermakov, O. Aksel'rad and L. K. Pereira, Metal. Sci. Heat. Treat. 43 (2001) 493-496.

Obviously, the Fe-(28-34) wt. % Mn-(6-11) wt. % Al-(0.54-1.3) wt. % C and Fe-(25-31) wt. % Mn-(6.3-10) wt. % Al-(0.6-1.75) wt. % M (M=V, Nb, W, Mo)-(0.65-1.1) wt. % C alloys disclosed in the prior arts and published literature can possess excellent combinations of mechanical properties, namely high-strength and high-ductility. However, they generally exhibited poor corrosion resistance. For instance, for the abovementioned alloys, the corrosion potential ($E_{corr}$) and pitting potential ($E_{pp}$) in the 3.5% NaCl aqueous solution (mimicking the sea water environment) were within the ranges of $E_{corr}$=−750~−900 mV and $E_{pp}$=−350~−500 mV, respectively. This strongly indicates that the alloys do not have adequate corrosion resistance when serving in sea water environment. In order to enhance the corrosion resistance, previous studies had added Cr to the alloys. It was pointed out that, by adding 3-9 wt. % of Cr, the corrosion resistance of the alloys could be significantly improved and an apparent passivation region can be observed in the current-voltage polarization curves. Previous results indicated that, by adding more than 3.3 wt. % of Cr to the Fe-(28-34) wt. % Mn-(6.7-10.5) wt. % Al-(0.7-1.2) wt. % C alloys, a significant improvement in corrosion resistance could be obtained. For instance, previous studies on Fe-30 wt. % Mn-9 wt. % Al-(3,5,6.5,8) wt. % Cr-1 wt. % C alloys have revealed a remarkable improvement in alloy's corrosion resistance when the Cr concentration exceeded 3.5 wt. %. When the Cr concentration was up to 5 wt. %, the alloys under the as-quenched condition exhibited an improvement of $E_{corr}$ and $E_{pp}$ to −560 mV and −50 mV in 3.5% NaCl solution, respectively. However, when the Cr concentration was increased to 6.5 and 8.0 wt. %, the corrosion resistance of the alloys decreased with increasing Cr concentration: $E_{corr}$=−601 mV and $E_{pp}$=−308 mV for Cr=6.5 wt. %; $E_{corr}$=−721 mV and $E_{pp}$=−380 mV for Cr=8.0 wt. %, respectively. Additionally, in the previous study concerning the corrosion behaviors of the Fe-30 wt. % Mn-7 wt. % Al-(3,6,9) wt. % Cr-1.0 wt. % C alloys in 3.5% NaCl solution, it was reported that when the Cr concentration was increased to about 6 wt. o, the $E_{corr}$ and $E_{pp}$ of the as-quenched alloy could be improved to −556 mV and −27 mV, respectively. However, when the Cr concentration was increased to 9 wt. %, the $E_{corr}$ and $E_{pp}$ of the as-quenched alloy were dramatically decreased to −754 mV and −472 mV, respectively. Investigations disclosed in the prior arts have pointed out that the Cr≤6 wt. % addition could be completely dissolved in Fe-30 wt. % Mn-7 wt. % Al-1.0 wt. % C alloy at the solution heat-treatment temperature of 1100° C. Consequently, the corrosion resistance of the alloys could be pronouncedly improved with increasing Cr concentration. However, when the Cr concentration was increased up to 9 wt. %, the Cr-rich carbides could be detected in the as-quenched alloy. The formation of the Cr-rich carbides resulted in the drastic decrease of the $E_{corr}$ and $E_{pp}$ values. In particular, it should be emphasized here that, even under the optimal composition conditions giving rise to the best corrosion resistance, such as alloys with the composition of Fe-30 wt. % Mn-7.0 wt. % Al-6.0 wt. % Cr-1.0 wt. % C, its performance in corrosion resistance is still far below those of AISI 304 (in 3.5% NaCl solution $E_{corr}$=−350~−210 mV, $E_{pp}$=+100~+500 mV) and AISI 316 ($E_{corr}$=−200 mV, $E_{pp}$=+400 mV) austenitic stainless steels or the 17-4PH precipitation-hardening stainless steels ($E_{corr}$=−400~−200 mV, $E_{pp}$=+40~+160 mV).

Moreover, since Cr is a very strong carbide former, prior arts have shown that, although the as-quenched alloys usually reveal single austenite phase when the Cr concentration is below about 6 wt. %, coarse Cr-rich carbides, such as $(Fe,Mn,Cr)_{23}C_6$ and $(Fe,Mn,Cr)_7C_3$, can easily precipitate on the grain boundaries during the aging treatment. As a result, the aged alloys frequently exhibit dramatic reduction in both their ductility and corrosion resistance. This is also the primary reason why most of the austenitic Fe—Mn—Al—Cr—C alloys disclosed in the prior arts or published literature have been used in the as-quenched condition and seldom carried out any aging treatment. In a series of Fe-(26.5-30.2) wt. % Mn-(6.85-7.53) wt. % Al-(3.15-9.56) wt. % Cr-(0.69-0.79) wt. % C alloys disclosed in the prior arts, the UTS and YS of the alloys are respectively ranging within 723~986 MPa and 410~635 MPa after solution heat-treatment. If one compares these mechanical properties with those of the abovementioned Fe—Mn—Al—C alloys subjected to 15~16 hours of aging at 550° C. (UTS=1130~1220 MPa YS-890~1080 MPa), it is apparent that, although exhibiting superior corrosion resistance, the austenitic Fe—Mn—Al—Cr—C alloys have much lower mechanical strength than the aged Fe—Mn—Al—C alloys.

The following publications gave more detailed descriptions and discussions of the abovementioned characteristics [26]-[39].

(26) C. Y. Chao, 2001, "Low density high ductility Fe-based alloy materials for golf club heads", Patent No. 460591, Taiwan, R.O.C. (27) C. Y. Chao, 2004, "Low density Fe-based materials for golf club heads", Patent No. 460591, Taiwan, R.O.C. (Same as US Patent No.: US006007). (28) T. F. Liu and J. W. Lee, 2007, "Low density, high strength, high toughness alloy materials and the methods of making the same", Patent No. I279448, Taiwan, R.O.C. (29) Tai W. Kim, Jae K. Han, Rae W. Chang and Young G. Kim, 1995, "Manufacturing process for austenitic high manganese steel having superior formability, strengths and weldability", U.S. Pat. No. 5,431, 753. (30) C. S. Wang, C. Y. Tsai, C. G. Chao and T. F. Liu: Mater. Trans. 48 (2007) 2973-2977. (31) S. C. Chang, J. Y. Liu and H. K. Juang: Corros. Eng. 51 (1995) 399-406. (32) S. C. Chang, W. H. Weng, H. C. Chen, S. J. Liu and P. C. K. Chung: Wear 181-183 (1995) 511-515. (33) C. J. Wang and Y. C. Chang: Mat. Chem. Phy. 76 (2002) 151-161. (34) J. B. Duh, W. T. Tsai and J. T. Lee, Corrosion November (1988) 810. (35) M. Ruscak and T. R. Perng, Corrosion 51 (1995) 738-743. (36) C. J. Wang and Y. C. Chang, Mater. Chem. Phy. 76 (2002) 151-161. (37) S. T. Shih, C. Y. Tai and T. P. Perng, Corrosion February 49 (1993) 130-134. (38) Y. H. Tuan, C. S. Wang, C. Y. Tsai, C. G. Chao and T. F. Liu: Mater. Chem. Phy. 114 (2009) 246-249. (39) Y. H. Than, C. L. Lin, C. G. Chao and T. F. Liu: Mater. Trans. 49 (2008) 1589-1593.

The characteristics of the Fe-(26-34) wt. % Mn-(6-11) wt. % Al-(0.54-1.3) wt. % C and Fe-(25-31) wt. % Mn-(6.3-10) wt. % Al-(0.6-1.75) wt. % M(M=V,Nb,Mo,W)-(0.65-1.1) wt. % C alloys disclosed in the prior arts can be summarized as following. For alloys containing less than 1.4 wt. % of carbon, the microstructure of the alloys after being solution heat-treated at 980~1200° C. and then quenched, is single austenite phase or austenite phase with small amount of (V, Nb)C carbides. When the as-quenched alloys are aged at 550° C. for 15~16 hours, the alloys can achieve the optimal combination of high-strength and high-ductility. However, the alloys usually exhibit poor corrosion resistance. When up to approximately 6 wt. % of Cr was added to the austenitic Fe—Mn—Al—C alloys, the corrosion resistance can be improved in the as-quenched condition. Nevertheless, due to the precipitation of coarse Cr-rich carbides on the austenite grain boundaries during aging treatments, the alloys easily lose their ductility and corrosion resistance. Therefore, it can be concluded from the above discussions that the compositions of various Fe—Mn—Al—C, Fe—Mn—Al-M (M=V, Nb, W, Mo)—C, and Fe—Mn—Al—Cr—C alloys and the associated processing conditions disclosed in the prior arts have failed to accomplish the goal of producing an alloy possessing the characteristics of high-strength, high-ductility, and high corrosion resistance, simultaneously.

In order to overcome these unresolved outstanding problems, the present inventor, based on decades of practical experiences in materials researches, including alloy designs and technology developments of Fe—Mn—Al—C alloys, has carried out numerous of experiments and come up with the present novel invention.

SUMMARY OF THE INVENTION

The primary purpose of the present invention is to provide an alloy not only has a superior ductility comparable to (or the same as) that of austenitic Fe—Mn—Al—C, Fe—Mn—Al-M-C, and Fe—Mn—Al—Cr—C alloys disclosed in the prior arts, but also possesses much higher mechanical strength.

Another purpose of the present invention is to provide a processing method of treating the abovementioned alloy, which would produce the alloy with not only having a superior ductility comparable to (or the same as) that of austenitic Fe—Mn—Al—C, Fe—Mn—Al-M-C, and Fe—Mn—Al—Cr—C alloys disclosed in the prior arts, but also possessing much higher mechanical strength and far superior corrosion resistance.

In order to accomplish the above purposes, according to the present invention, the chemical composition range for each alloying element of the Fe—Mn—Al—C alloys should be as following: Mn (23-34 wt. %, preferably 25-32 wt. %); Al (6-12 wt. %, preferably 7.0-10.5 wt. %); C (1.4-2.2 wt. %, preferably 1.6-2.1 wt. %); with the balance being Fe.

The processing methods carried out to treat the Fe—Mn—Al—C alloys disclosed in the present invention are briefly summarized as following:

(1) In the alloys disclosed in the present invention, the formation mechanism of the high density of fine κ'-carbides is completely different from that reported in the alloys disclosed in the prior arts. The present invention discloses Fe—Mn—Al—C quaternary alloys with the carbon concentration being not lower than 1.4 wt. % and not higher than 2.2 wt. %. Within this specific composition range, the high density of fine (nano-scale) κ'-carbides is formed within the austenite matrix by spinodal decomposition phase transition mechanism during quenching from the solution heat-treatment temperature. Whereas, for the alloys previously disclosed in the prior arts, the fine κ'-carbides could only be observed in the aged alloys.

(2) The alloys disclosed in the present invention can possess an excellent combination of high mechanical strength and high ductility in the as-quenched condition, since the high density of fine κ'-carbides is formed during quenching. With almost equivalent elongation, the yield strength of the present alloys is about 1.6~2.1 and 1.2~1.5 times of that of the alloys disclosed in the prior arts in the as-quenched condition and after optimal aging treatment, respectively. The detailed comparisons will be described later.

(3) The alloys disclosed in the present invention display multiple beneficial effects of aging and nitriding when the as-quenched alloys are directly nitrided at 450-550° C. In addition, owing to the high Al contents in the present alloys, the surface layer formed after nitriding treatment is AlN or predominantly AlN with a small amount of $Fe_4N$. This is quite different from that obtained in nitrided alloy steels (e.g. AISI 4140, 4340) and martensitic (e.g. AISI 410) or precipitation-hardening (e.g. 17-4 PH) stainless steels commercially available for using in the high strength and/or highly corrosive environments. In those alloy and stainless steels, the surface layer after nitriding was composed primarily of $Fe_{2-3}N$ and $Fe_4N$. Consequently, the alloys disclosed in the present invention after nitriding treatments exhibit far superior mechanical strength, ductility, surface hardness, as well as corrosion resistance in 3.5% NaCl solution over the abovementioned alloy and stainless steels even after being subjected to the optimal strengthening and nitriding treatments. The detailed comparisons will be described later.

1. The Novel Features of the Fe—Mn—Al—C Alloy Composition Design Disclosed in the Present Invention The main reason leading to the three novel characteristics described above for the alloys disclosed in the present invention is the profound in-depth studies investigating the effects of each alloying element on the resultant material's properties. The more detailed results are described below.

(1) Mn: Mn is a strong austenite-stabilizing element. Since the austenite phase is of face-center-cubic (FCC) structure with more dislocation slip systems, hence, possesses better ductility than other crystal structures, such as body-center-cubic (BCC) and hexagonal close packed (HCP) structures. Therefore, in order to obtain a fully austenite structure at room temperature, the Mn concentrations of the present alloys are kept in the range of 23-34 wt. %, as those added in the prior arts.

(2) Al: Al not only is a strong ferrite-stabilizing element former but also is one of the primary elements for forming $(Fe,Mn)_3AlC_x$ carbides (κ'-carbides). Thus, in order to have a thorough understanding of how Al affects the formation of fine κ'-carbides during quenching, the present invention has designed a series of alloys with various Al concentrations and carried out careful observations. Through a series of X-ray diffraction (XRD) and transmission electron microscopy (TEM) analyses performed on the alloys with various Al concentrations, it was confirmed that the formation of κ'-carbides during quenching is intimately related to the Al concentration of the alloy. For instance, for Fe—Mn—Al—C alloys with a fixed carbon concentration of 1.8 wt. %, the results indicated that when the Al concentration is less than 5.8 wt. %, the resultant microstructures of the as-quenched alloys were all single austenite phase and no κ'-carbides were formed within the austenite matrix. As the Al concentration was increased to above 6.0 wt. %, the microstructure of the as-quenched alloys was austenite phase containing a high density of extremely fine κ'-carbides. The extremely fine κ'-carbides were formed by spinodal decomposition during quenching. However, when the Al concentration was increased to above 12.0 wt. %, it was found that in addition to the primary austenite matrix+κ'-carbides, a small amount of ferrite phase would appear on the austenite grain boundaries.

Consequently, it is evident that the Al concentration of the present alloys should be limited within the range of 6-12 wt. %.

(3) Carbon: The previous studies on austenitic FeMnAlC alloys disclosed in the prior arts were only conducted on the alloys with 0.51≤C≤1.30 wt. %, in which it was reported that as-quenched microstructure of the previous alloys was single austenite phase and no precipitates could be detected. However, the present invention found that when the carbon concentration was over about 1.4 wt. %, a high density of extremely fine κ'-carbides could be observed within the austenite matrix in the alloys after being solution heat-treated at 980-1200° C. and then quenched into room-temperature water or ice water. The systematic TEM analyses have evidently indicated that the high density of extremely fine κ'-carbides was formed within the austenite matrix by spinodal decomposition during quenching. This is a completely different κ'-carbides formation mechanism as compared with that occurring in the Fe—Mn—Al—C with C≤1.3 wt. % alloys disclosed in prior arts, where κ'-carbides could only be observed in the aged alloys. It is emphasized here that the spinodal decomposition-induced κ'-carbides formation mechanism disclosed in the present invention has never been reported by other researchers before. The following examples carried out by the present invention further delineate the effects of carbon concentration on the above-mentioned spinodal decomposition-induced κ'-carbides formation.

In order to examine the effects of carbon concentration on the as-quenched microstructures of the present alloys, TEM analyses on the Fe-29 wt. % Mn-9.8 wt. % Al-(1.35, 1.45, 1.58, 1.71, 1.82, 1.95, 2.05) wt. % C alloys were carried out. The alloys were solution heat-treated at 1200° C. for 2 hours and then quenched into room-temperature water. Both selected-area diffraction patterns (SADPs) and $(100)_{\kappa'}$ dark-field images were used to delineate the effects. FIG. 1(*a*) is a SADP of the alloy with 1.35 wt. % C. It can be clearly seen that only diffraction spots of austenite phase could be observed. This indicates that the as-quenched microstructure of the alloy is single austenite phase without any κ'-carbides, which is similar to that found in the as-quenched austenitic FeMnAlC with 0.51≤C≤1.30 wt. % alloys disclosed in the prior arts. However, when the carbon concentration was increased above 1.45 wt. %, nano-scale fine κ'-carbides with an $L'1_2$ crystal structure started to form within the austenite matrix. FIGS. 1(*b*)-1~1(*g*)-1 and FIGS. 1(*b*)-2~1(*g*)-2 show the SADPs and $(100)_{\kappa'}$ dark-field images of the alloys with 1.45, 1.58, 1.71, 1.82, 1.95, and 2.05 wt. % carbon, respectively. From these SADPs, it is seen that in addition to the diffraction spots of the austenite phase, the diffraction spots arising from the $L'1_2$-structured κ'-carbides can also be detected. It is also seen in these SADPs that satellites lying along <100> reciprocal lattice directions around the $(200)_\gamma$ and $(220)_\gamma$ diffraction spots could be observed. The existence of the satellites demonstrates that the extremely fine κ'-carbides were formed by spinodal decomposition during quenching. Furthermore, the intensity of the κ'-carbide diffraction spots appears to increase with increasing the carbon concentration. These results indicate that the extremely fine κ'-carbides were formed within the austenite matrix through the spinodal decomposition mechanism during quenching, and the more the carbon concentration the more the amount of the κ'-carbides would be formed. These are further verified by the dark-field images shown in FIGS. 1(*b*)-2~1(*g*)-2; wherein the volume percentage of the nano-scale fine κ'-carbides is rapidly increased with increasing carbon concentration. "The existence of a high density of extremely fine κ'-carbides being formed within the austenite matrix through the spinodal decomposition mechanism during quenching" is one of the most prominent features disclosed in the present invention. This feature has resulted in dramatic improvements in both the mechanical properties and corrosion resistance to the present alloys after being properly treated with aging or nitriding processes. (This part of technical details will be described and discussed later.)

The experiments described above indicate that the carbon concentration of the present alloys should be above 1.4 wt. %. FIGS. 2(*a*)-2(*c*) show the TEM bright field-image and $(100)_{\kappa'}$ dark-field images of the upper and lower grains of the as-quenched alloy with 2.08 wt. % C, respectively. These results evidently demonstrate that, even with C=2.08 wt. %, the as-quenched microstructure of the alloy remains as austenite matrix+fine κ'-carbides without any precipitates appeared on the austenite grain boundaries. Nevertheless, when the carbon concentration is increased to 2.21 wt. %, in addition to the extremely fine κ'-carbides formed within the austenite matrix, some coarse precipitates started to appear on the austenite grain boundaries, as illustrated in FIG. 3. In FIGS. 3(*a*)-3(*c*), it is concluded that the coarse precipitates formed on the austenite grain boundaries are the κ-carbides. The κ-carbides have a similar crystal structure as the κ'-carbides [please refer to the "note" described in previous sections]. The presence of grain boundary κ-carbides would be detrimental to the alloy's ductility. Based on the above microstructural analyses and discussions, the carbon concentration of the present alloys should not exceed 2.3 wt. %, preferably should be within the range of 1.4 wt. %≤C≤2.2 wt. %.

(4) Cr, Mo, and Ti: Cr, Mo, and Ti are very strong carbide-forming elements. The present inventor also investigated the effects of the addition of these elements on the as-quenched as well as the aged microstructures of the alloys disclosed in the present invention. The results indicated that when the addition of these alloying elements was kept lower than certain concentrations, the as-quenched microstructure could remain to be austenite matrix+κ'-carbides without any grain boundary precipitates. However, when the as-quenched alloys were subjected to aging treatment at 450~550° C., the precipitation of coarse Cr-rich, Mo-rich, or Ti-rich carbides could be readily observed on the grain boundaries. When the addition of these strong carbide-forming elements exceeded certain concentrations, it was found that the as-quenched microstructure became austenite matrix+κ'-carbides with a significant amount of coarse grain boundary precipitates.

FIGS. 4(*a*)-(*b*) are an optical micrograph and TEM bright-field image of an Fe-28.1 wt. % Mn-9.02 wt. % Al-6.46 wt. % Cr-1.75 wt. % C alloy after being solution heat-treated at 1200° C. for 2 hours and then quenched into room-temperature water. It is clear in these figures that some coarse precipitates were formed on the austenite grain boundaries. The energy dispersive X-ray spectrometry (EDS) analysis indicated that the coarse grain boundary precipitates were Cr-rich Cr-carbides, as shown in FIG. 4(*c*). FIGS. 5(*a*) and 5(*b*) show the TEM bright-field image and EDS analysis of the grain boundary precipitates for an Fe-26.9 wt. % Mn-8.52 wt. % Al-2.02 wt. % Ti-1.85 wt. % C alloy after being solution heat-treated at 1200° C. for 2 hours and then quenched into room-temperature water. The results indicate that the as-quenched microstructure consists of austenite matrix+κ'-carbides, and coarse Ti-rich Ti-carbides formed on the grain boundaries. On the other hand, the TEM analyses of an as-quenched Fe-28.3 wt. %-Mn-9.12 wt. % Al-1.05 wt. % Mo-1.69 wt. % C alloy revealed that the as-quenched microstructure was purely austenite matrix+κ'-carbides without any grain boundary precipitates. However, when this as-quenched alloy was aged at 500° C. for 8 hours, in addition to the increased size and amount of the κ'-carbides within the austenite matrix, some coarse Mo-rich Mo-carbides would appear on the austenite grain boundaries, as shown in FIG. 6.

It has been confirmed repeatedly by experiments that strong carbide-forming elements, such as Cr, Ti, and Mo, can easily result in formation of coarse grain boundary precipitates, which frequently leads to dramatic reduction in alloy's ductility. Moreover, the present invention also found that the addition of Cr, Ti, and Mo appeared to have no beneficial effect to promote one of the prominent features of the present invention, namely: "A high density of extremely fine κ'-carbides can be formed within the austenite matrix through the spinodal decomposition mechanism during quenching". Thus, it is not recommended to add any of the strong carbide-forming elements to the alloys disclosed in the present invention.

(5) Si: Previous researches and technologies have disclosed that in Fe—Mn—Al—C alloy systems, Si not only is a strong ferrite-stabilizing element former but also has a very strong effect on the formation of ordered $D0_3$ phase. Once the ordered $D0_3$ phase is fowled in the alloy, the ductility of the alloy will be deteriorated drastically. Previous researches and technologies have also shown that the as-quenched microstructure of the austenitic FeMnAlC alloy with Si≤1 wt. % was single γ-phase. Moreover, the $D0_3$ phase could be observed on the austenite grain boundaries in these alloys after being aged the 500~550° C. However, in the higher carbon concentration Fe—Mn—Al—C alloys disclosed in the present invention, with only 0.8 wt. % of Si addition, the ordered $D0_3$ phase had already been observed on the grain boundaries in the as-quenched alloy. FIGS. 7(*a*)-(*c*) respectively show the TEM bright-field image, a SADP, and EDS analysis of coarse grain boundary precipitates of an Fe-29.1 wt. % Mn-9.22 wt. % Al-0.80 wt. % Si-1.85 wt. % C alloy after being solution heat-treated at 1200° C. for 2 hours and then quenched into room-temperature water. FIG. 7(*a*) clearly shows the microstructure of austenite+fine κ'-carbides in the matrix and some coarse precipitates on the grain boundaries. FIGS. 7(*b*) and 7(*c*) reveal that the coarse grain boundary precipitates are indeed the Si-rich ordered $D0_3$ phase. As described above, it is not recommended to add Si to the alloys disclosed in the present invention.

According to the above descriptions and discussions, the composition ranges of the present alloys are preferably composed of 23~34 wt. % Mn, 6~12 wt. % Al, 1.4~2.2 wt. % C with the balance being Fe. In order to let the experts of the present technology field further understand the novelties of the present invention, part of the chemical compositions and associated microstructural characteristics of the present alloys, as well as those of the comparative alloys disclosed in the prior arts (including the published patents and research literature) are listed in FIG. 8 and FIG. 9, respectively. The results illustrated in these figures are only to further clarify the novel features of alloy composition designs and microstructural characteristics disclosed in the present invention, and they should not be deemed as the scope of the present invention.

2. The Novel Features of the Aging Treatment and the Resultant Excellent Mechanical Properties in the Fe—Mn—Al—C Alloys Disclosed in the Present Invention As mentioned above, the as-quenched microstructure of the Fe—Mn—Al—C and Fe—Mn—Al-M (M=V, Nb, W, Mo)—C with C≤1.3 wt % alloys disclosed in the prior arts was single austenite phase or austenite phase with small amount of (V, Nb)C carbides. There is no fine κ'-carbides formed within the austenite matrix during quenching, hence these alloys are lacking in the most important strengthening ingredient—the fine κ'-carbide precipitates. Consequently, in order to improve mechanical strengths of the alloys, the as-quenched Fe—Mn—Al—C and Fe—Mn—Al-M-C alloys all need to be aged at 550~650° C. for various times to result in the coherent precipitation of the fine κ'-carbides. According to the disclosed prior arts, these alloys could attain optimal combination of mechanical strengths and ductility, when aged at 550° C. for 15~16 hours. With an elongation better than about 26%, values of 953~1259 MPa for UTS and 890~1094 MPa for YS could be attained. Nevertheless, when the aging treatment was carried out at 450° C., it took more than 500 hours to attain the similar combination of mechanical properties. For 500° C. aging treatment, the time was about 50~100 hours. The underlying mechanism for this is because, in these cases, the κ'-carbides were precipitated from the supersaturated carbon concentration within the austenite matrix. The nucleation and growth dominated precipitation process involves extensive diffusion processes of the associated alloying elements. Thus, it usually needs higher aging temperature and longer aging time.

On the contrary, the fine κ'-carbides can be formed by spinodal decomposition mechanism within the austenite matrix during quenching. This novel feature naturally leads to the unique as-quenched microstructure of austenite+fine κ'-carbides. As a result, the alloys disclosed in the present invention can possess an excellent combination of mechanical properties even in the as-quenched condition. Furthermore, the present invention also found that the volume fraction of the κ'-carbides and the mechanical strength both were increased rapidly with increasing carbon concentration. The unique as-quenched microstructure of austenite+fine κ'-carbide existing in the present alloys would lead many advantages over various Fe—Mn—Al—C alloy systems disclosed in prior arts.

The present inventor discovered that the as-quenched alloys disclosed in the present invention were solution heat-treated, quenched, and properly aged at 450, 500, and 550° C. for moderate times, the average particle size and volume fraction of the fine κ'-carbides increased, and no grain boundary precipitates could be detected. In particular, it was found that when the carbon and Al concentrations were within the ranges of 1.6~2.1 wt. % and 7.0~10.5 wt. %, respectively, the aged alloys exhibited the best combination of mechanical strength and ductility. Specifically, when the alloys disclosed in the present invention were aged at 450° C. for 9~12 hours, the average size of the fine κ'-carbides formed within the austenite matrix increased from 5~12 nm in the as-quenched condition to 22~30 nm. The volume fraction of the fine κ'-carbides also increased significantly, while there were still no observable coarse κ-carbides formed on the grain boundaries. Under these conditions, the UTS and YS are respectively increased from 1030~1155 MPa and 865~925 MPa for the as-quenched alloys to 1328~1558 MPa and 1286~4432 MPa for the aged alloys, while still maintaining 33.5~26.3% of elongation.

Similar results were obtained for aging the alloys at 500° C. and 550° C. However, in these cases, the aging time could be further reduced to 8~10 hours (500° C.) or 3~4 hours (550° C.) for achieving the best combination of mechanical strength and ductility. For instance, when the alloys with 1.6 wt. %≤C≤2.1 wt. % and 7.0 wt. %≤Al≤10.5 wt. % were aged at 500° C. for 8~10 hours, both the average size and volume fraction of the fine κ'-carbides increased significantly and no precipitates were formed on the grain boundaries. In this case, the UTS and YS were increased to 1286~1445 MPa and 1230~1326 MPa, respectively, while still maintaining 33.8~30.6% good elongation. When the aging time was increased to 12 hours, some coarse κ-carbides started to appear on the grain boundaries. In this case, although the UTS and YS were slightly increased, the elongation was decreased to about 23%. The microstructures of the alloys aged at 550° C. for 3~4 hours were very similar to those aged at 450° C. for 9~12 hours or aged at 500° C. for 8~10 hours. However, when the aging time was increased to 5 hours, coarse grain boundary precipitates were readily observed. SADP and EDS analyses indicated that these coarse grain boundary precipitates were Mn-rich κ-carbides. With increasing aging time at 550° C., the κ-carbides grew into adjacent austenite grains through a $\gamma+\kappa' \rightarrow \gamma_0+\kappa$ reaction, which deteriorated the ductility dramatically.

Comparing to the Fe—Mn—Al—C and Fe—Mn—Al-M-C with C≤1.3 wt. % alloys disclosed in the prior arts, the present invention has the following apparent novelties and technological features of nonobviousness:

(1) The alloys disclosed in the present invention have the novel microstructure consisting of austenite+fine κ'-carbides in the as-quenched condition. This feature is completely different from that of the Fe—Mn—Al—C and Fe—Mn—Al-M-C with C≤1.3 wt. % alloys. In that, the as-quenched microstructure is single austenite phase or austenite phase with small amount of (V, Nb)C carbides.

(2) The fine κ'-carbides obtained in the alloys disclosed in the present invention are formed within the austenite matrix by spinodal decomposition mechanism during quenching. This unique κ'-carbide formation mechanism is also completely different from that occurred in the Fe—Mn—Al—C and Fe—Mn—Al-M-C with C≤1.3 wt. % alloys disclosed in prior arts. In that, the κ'-carbides can only be observed within the austenite matrix in the aged alloys.

(3) Since the present alloys have the novel microstructure consisting of austenite+fine κ'-carbides in the as-quenched condition, both the aging temperature and aging time required for attaining the optimal combination of mechanical strength and ductility can be significantly reduced; namely 450° C.→9~12 hours; 500° C.→8~10 hours; 550° C. 3~4 hours. Comparing to the Fe—Mn—Al—C and Fe—Mn—Al-M-C with C≤1.3 wt. % alloys disclosed in prior arts, since their as-quenched microstructure is purely single austenite phase without any κ'-carbides, longer aging times are required for attaining optimal combination of mechanical strength and ductility; namely 450° C.→>500 hours; 500° C.→50~100 hours; 550° C.→15~16 hours. Therefore, the present invention has the apparent technological feature of nonobviousness.

(4) Since the carbon concentration contained in the alloys disclosed in the present invention is much higher than that in the previous Fe—Mn—Al—C alloy systems, the obtainable volume fraction of the κ'-carbides is much higher than those alloy systems. Also the aging temperature and aging time can be dramatically reduced. Furthermore, comparing to the previous alloys (C≤1.3 wt. %) after being aged at 550° C. for 15~16 hours, the size of the κ'-carbides in the present alloys is also much smaller. As a result, with almost equivalent elongation, the mechanical strength of the alloys disclosed in the present invention is enhanced by more than 30%.

In order to further delineate the novel features in aging treatment and superior mechanical properties of the present alloys described above, we will describe in detail three experimental results associated with the present alloys in the followings.

3. The Novel Features of the Nitriding Treatment and the Resultant Excellent Corrosion Resistance in the Fe—Mn—Al—C Alloys Disclosed in the Present Invention In the prior arts, and published literature, it is seen that after solution heat-treatment or controlled rolling followed by optimal aging at 550° C. for 15-16 hours, the Fe—Mn—Al—C and Fe—Mn—Al-M (M=V, Nb, W, Mo)—C with C≤wt. % alloys can possess optimal combination of high-strength and high-ductility. However, the corrosion resistance of these alloys in aqueous environments is not adequate for applications in industry. In the 3.5% NaCl solution, the corrosion potential ($E_{corr}$) and pitting potential ($E_{pp}$) of these alloys are in the range of −750~−900 mV and −350~−500 mV, respectively. It means that these alloys are essentially incompetent to corrosive environments. It has also been shown that, by adding 3~6 wt. % of Cr into the Fe—Mn—Al—C alloys, the corrosion resistance of the alloys can be significantly improved by inducing a passivation region in the current-voltage polarization curves. Typically, the $E_{corr}$ and $E_{pp}$ can be improved to −556~−560 mV and −53~−27 mV, respectively. However, since Cr is a very strong carbide-forming element, the alloys are usually not suitable for further aging treatment. Therefore, the alloys have the shortcomings of insufficient mechanical strengths.

The present inventor has performed a detailed examination on the corrosion resistance of the novel 1.4≤C≤2.2 wt % alloys disclosed in the present invention. As expected, it was found that the present alloys exhibited inadequate corrosion resistance in 3.5% NaCl solution which is similar to that of the Fe—Mn—Al—C or Fe—Mn—Al-M-C alloys disclosed in the prior arts. Moreover, it is quite often in various application environments that the mechanical parts or components have to simultaneously meet the requirements of mechanical strength, ductility, surface abrasion, and chemical corrosion effects. Consequently, surface nitriding treatments for various types of alloy steels and stainless steels are frequently practiced. For instance, in order to improve the abrasion resistance, fatigue resistance, and corrosion resistance, the AISI 410 martensitic stainless steels or the 17-4 precipitation-hardening stainless steels widely used in cutting tools, water or steam valves, pumps, turbines, compressive machinery components, shaft bearings, plastic forming molds, or components used in sea waters, are usually subjected to surface nitriding treatments.

It is thus substantially desirable to develop alloys that can simultaneously meet as many of those requirements as possible. In fact, it has been exactly the driving force that leads to yet another novel technological feature disclosed in the present invention. From the numerous experiments conducted by the inventor, it has been demonstrated that when the as-quenched alloys disclosed in the present invention were directly nitrided (by either plasma nitriding or gas nitriding) at 450° C., 500° C., and 550° C. under 1~6 torr of $N_2+H_2$ mixed gas or $NH_3+N_2$ (or $NH_3+N_2+H_2$) mixed gas for 9~12 hours, 8~10 hours, and 3~4 hours, respectively, superior surface microhardness as well as excellent corrosion resistance in 3.5% NaCl solution were readily obtained.

Since the temperatures and times of the nitriding treatments exactly match with the optimal aging conditions for the present alloys, the technology disclosed in the present invention not only markedly improves the abrasion resistance and corrosion resistance, but also simultaneously possess the excellent mechanical properties obtained under the same aging conditions described above. It is worthwhile to note here that information concerning the nitriding treatments of the Fe—Mn—Al—C alloy systems has never been reported in the prior arts and previously published literature.

In the following sections, we shall describe the prominent features of the present alloys after plasma nitriding or gas nitriding treatments.

(1) The structure of the nitrided layer of the present alloys consists predominantly of the FCC-structured AlN and traced amount of FCC-structured $Fe_4N$. This is completely different from that obtained in nitrided commercialized industrial steels, wherein the structure of the nitrided layer is mainly composed of HCP-structured $Fe_{2-3}N$ and FCC-structured $Fe_4N$. Since the crystal structure of the nitrided layer in the present alloys is the same as that of the austenite+κ'-carbides matrix, no microvoids and microcracks can be observed in the vicinity of the interface between the nitrided layer and matrix even when the alloys are fractured after the tensile tests. As a result, the nitrided alloys exhibit essentially the same tensile strength and ductility as those obtained from the aging treatment alone (no nitriding treatment).

(2) Depending on the alloy compositions and nitriding conditions (such as 450° C., 500° C., or 550° C. for 9~12 hours, 8~40 hrs, or 3~4 hours, respectively), the surface microhardness of the alloys disclosed in the present invention can reach 1500~1880 Hv, and the $E_{corr}$ and $E_{pp}$ in 3.5% NaCl solution can be improved to +50~+220 mV and +2010~+2850 mV, respectively. It is obvious that the alloys disclosed in the present invention after being nitrided have far superior surface microhardness and corrosion resistance in 3.5% NaCl solution to those of various types of industrial alloy steels and stainless steels even after being treated with the optimal nitriding conditions.

For AISI 4140 and 4340 alloy steels, AISI 304 and 316 austenitic stainless steels, AISI 410 martensitic stainless steels, or 17-4PH precipitation-hardening stainless steels disclosed in the prior arts, it is well-known that, in order to enhance the fatigue resistance, surface abrasion, and corrosion resistance, further nitriding treatments are required. It is also well-established that when the type of high Cr-containing stainless steels is nitrided at temperatures above 480° C., the primary structure of the nitrided layer consists of $Fe_3N$ (HCP), $Fe_4N$ (FCC), and CrN (FCC). A significant amount of CrN formation results in a surrounding Cr-depletion region, which would cause severe degradation in corrosion resistance of the nitrided stainless steels. As a result, this type of stainless steels usually is nitrided at 420~480° C. for about 8~20 hours to obtain a nitrided layer mainly consisting of $Fe_{2-3}N$ and $Fe_4N$ without or with a very small amount of CrN. In general, for AISI 304 and 316 stainless steels, the nitriding treatments are performed at 420~480° C. Prior to nitriding, the UTS, YS, and El of the AISI 304 and 316 stainless steels are 480~580 MPa, 170~290 MPa, and 55~40%, respectively. After nitriding treatment, the surface microhardness of these stainless steels can reach 1350~1600 Hv, and the $E_{corr}$ and $E_{pp}$ in 3.5% NaCl solution can be improved to −330~+100 mV and +90~+1000 mV, respectively. It is apparent that after nitriding treatment, the AISI 304 and 316 stainless steels can possess excellent surface microhardness and corrosion resistance, however, the mechanical strength is relatively low.

Thus, for many industrial applications requiring high mechanical strength and high corrosion resistance, the nitrided AISI 4140 and 4340 alloy steels, AISI 410 martensitic stainless steel and 17-4PH precipitation-hardening stainless steels are widely used. Nevertheless, in order to enable these alloy steels and stainless steels to simultaneously possess high mechanical strength and high corrosion resistance, the following heat treatment processes and specific considerations are needed: (i) austenization→quench→tempering (or aging) to obtain necessary mechanical strength; (ii) to avoid the so-called 475 tempering embrittlement. It is well-known to materials scientists that the as-quenched alloy steels and martensitic stainless steels shouldn't be tempered in the temperature range of 375~560° C. to avoid the 475 tempering embrittlement. Usually, when tempered at temperature below 375° C., the resulting alloys could possess higher mechanical strength but lower ductility; whereas, when tempered at 560° C. or above, the alloys had a lower mechanical strength with higher ductility. (iii) Based on the extensive previous studies, it can be summarized that the optimal nitriding treatments for AISI 4140 and 4340 alloy steels were performed at 475~540° C. for 4~8 hours, whereas, in the high Cr-containing stainless steels, the optimal nitriding treatments were carried out at 420~480° C. for 8~20 hours. The standard nitriding procedures for the AISI 4140 and 4340 alloy steels, and the AISI 410 and 17-4PH stainless steels are: austenization→quench→tempering (~600° C.)→nitriding treatments (475~540° C. for 4~8 hours or 420~480° C. for 8~20 hours). After the optimal nitriding treatments, the surface microhardness of the nitrided AISI 4140 and 4340 alloy steels can reach about 610~890 Hv with $E_{corr}$=−521~−98 mV and $E_{pp}$=−290~+500 mV in 3.5% NaCl solution. The UTS, YS, and El are about 1050 MPa, 930 MPa, and 18%, respectively. For the nitrided AISI 410 martensitic stainless steel, the surface microhardness can reach about 1204 Hv with $E_{corr}$=−30 mV and $E_{pp}$=+600 mV in 3.5% NaCl solution. The UTS, YS, and El are about 900 MPa, 740 MPa, and 20%, respectively. Similarly, the surface microhardness of the nitrided 17-4PH stainless steels can reach about 1016~1500 Hv with $E_{corr}$=−500~−200 mV and $E_{pp}$=+600~+740 mV in 3.5% NaCl solution. The UTS, YS, and El are about 1310 MPa, 1207 MPa, and 14%, respectively.

Comparing to the nitrided AISI 4140 and 4340 alloy steels, AISI 304 and 316 austenitic stainless steels, AISI 410 martensitic stainless steels, and 17-4PH precipitation-hardening stainless steels described above, it is evident that the present invention has the following further apparent novelties and technological features of nonobviousness:

(1) The FeMnAlC (1.4 wt. %≤C≤2.2 wt. %) alloys disclosed in the present invention, after being solution heat-treated, quenched, and then directly nitrided at 450~550° C. (simultaneously aged) will form a nitrided layer consisting primarily of AlN and a small amount of $Fe_4N$ (both nitrides have the FCC structure). This nitrided layer is quite different from that obtained in the nitrided alloy steels and stainless steels containing high Cr concentrations, where the main constituents of the nitrided layer are $Fe_3N$ (HCP) and $Fe_4N$ (FCC) or $Fe_3N$ and $Fe_4N$ with a very small amount of CrN. As a consequence, the alloys disclosed in the present invention have exhibited far superior performances over the nitrided AISI 4140 and 4340 alloy steels, AISI 304 and 316 austenitic stainless steels, AISI 410 martensitic stainless steels, and 17-4PH precipitation-hardening stainless steels in virtually every aspect of material properties, including surface microhardness, corrosion resistance in 3.5% NaCl solution, as well as the mechanical strength and ductility.

(2) The FeMnAlC (1.4 wt. %≤C≤2.2 wt. %) alloys disclosed in the present invention can achieve the dual effects of nitriding and aging by merely carrying out one-step nitriding treatment. Comparing with the multiple-step of austenization→quench→tempering (or aging)→nitriding treatment required for the alloy steels and stainless steels, the present invention apparently has a much simplified process. Moreover, in the present invention, the processing conditions applied to nitriding treatments are exactly the same as those practiced to obtain the optimal combinations of mechanical strength and ductility for the same alloys under aging. Thus, by performing nitriding treatments to the as-quenched alloys disclosed in the present invention directly, the excellent combination of high surface microhardness, high corrosion resistance, high mechanical strength, and superior ductility can be accomplished simultaneously.

(3) The main constituents of the nitrided layer are $Fe_3N$ (HCP) and $Fe_4N$ (FCC) in AISI 4140 and 4340 alloy steels, and $Fe_3N$ and $Fe_4N$ without or with a very small amount of CrN in the high Cr-containing stainless steels, which are different from the structure of the matrix (BCC) of the alloy steels and stainless steels. However, for the alloys disclosed in the present invention, the constituents of the obtained nitrided layer are predominantly AlN and small amount of $Fe_4N$, both have the same FCC crystal structure as the austenite matrix and the κ'-carbides formed within the matrix. This not only can facilitate the nitriding efficiency but also result in excellent coherent interface between the nitrided layer and the matrix. It has been evidently demonstrated that there was no crack formed at the interface between the nitrided layer and matrix, even when the alloys were fractured after tensile tests.

In order to further emphasize the novelties and technological features of nonobviousness exhibited in the nitrided alloys disclosed in the present invention, various properties of two of the present alloys and those of the AISI 4140 and 4340 alloy steels and AISI 304, 306, 410 and 17-4PH stainless steels are listed and compared in FIG. 16. One of the present alloys, after being solution heat-treated and quenched, was aged at 450° C., 500° C., and 550° C. for 12, 8, and 4 hours, respectively. While the other one, after being solution heat-treated and quenched, was directly plasma nitrided at 450° C., 500° C. for 12 and 8 hours, and gas nitrided at 550° C. for 4 hours, respectively. The typical nitriding conditions for the stainless steels were the optimized conditions disclosed in the prior arts, namely at 420~480° C. for 8~20 hours.

The following publications gave more detailed descriptions and discussions of the abovementioned characteristics [40]-[49].

(40) Wang Liang, Applied Surface Sci. 211 (2003) 308-314. (41) R. L. Liu, M. F. Yan, Surf. Coat. Technol. 204 (2010) 2251-2256. (42) R. L. Liu, M. F. Yan, Mater. Design 31 (2010) 2355-2359. (43) M. F. Yan, R. L. Liu, Applied Surface Sci. 256 (2010) 6065-6071. (44) M. F. Yan, R. L. Liu, Surf. Coat. Technol. 205 (2010) 345-349. (45) M. Esfandiari, H. Dong, Surf. Coat. Technol. 202 (2007) 466-478. (46) C. X. Li, T. Bell, Corrosion Science 48 (2006) 2036-2049. (47) C. X. Li, T. Bell, Corrosion Science 46 (2004) 1527-1547. (48) Lie Shen, Liang Wang, Yizuo Wang, Chunhua Wang, Surf. Coat. Technol. 204 (2010) 3222-3227. (49) S. V. Phadnis, A. K. Satpati, K. P. Muthe, J. C. Vyas, R. I. Sundaresan, Corrosion Science 45 (2003) 2467-2483.

BRIEF DESCRIPTION OF THE DRAWINGS

FIG. 1(*a*) and FIG. 1(*b*)-1~FIG. 1(*g*)-1 seven SADPs of the alloys with C=1.35, 1.45, 1.58, 1.71, 1.82, 1.95, and 2.05 wt. %, respectively. The zone axis is [001]. (hkl: γ; hkl: κ'-carbide); FIG. 1(*b*)-2~FIG. 1(*g*)-2 the $(100)_{\kappa'}$ dark-field images of the alloys with C=1.45, 1.58, 1.71, 1.82, 1.95, and 2.05 wt. %, respectively.

FIG. 2(*a*) bright-field image; FIG. 2(*b*)~FIG. 2(*c*) $(100)_{\kappa'}$ dark-field images taken from the upper and lower grains in FIG. 2(*a*), respectively.

FIG. 3(*a*) bright-field image; FIG. 3(*b*)~FIG. 3(*c*) $(100)_{\kappa'}$ dark-field images taken from the upper and lower grains in FIG. 3(*a*), respectively.

FIG. 4(*a*) An optical micrograph; FIG. 4(*b*) TEM bright-field image; FIG. 4(*c*) EDS profile obtained from a coarse grain boundary precipitate.

FIG. 5(*a*) bright-field image; FIG. 5(*b*) EDS profile obtained from a coarse grain boundary precipitate.

FIG. 6(*a*) bright-field image of the alloy in the as-quenched condition; FIG. 6(*b*) EDS profile obtained from a coarse grain boundary precipitate formed in the alloy aged at 500° C. for 8 hours.

FIG. 7(*a*) bright-field image; FIG. 7(*b*)~FIG. 7(*c*) a SADP (hkl: $D0_3$ phase) and EDS profile obtained from a coarse grain boundary precipitate, respectively.

FIG. 8 Comparisons of chemical compositions and microstructural characteristics of the present alloys, comparative alloys, as well as the alloys disclosed in the prior arts.

FIG. 9 Comparisons of chemical compositions between the alloys disclosed in the present invention and the FeMnAlC alloy systems disclosed in the prior arts (including in published patents and research literature).

FIG. 10(*a*) TEM $(100)_{\kappa'}$ dark-field image; FIG. 10(*b*)~FIG. 10(*c*) SEM images taken from the fracture surface and free surface of the as-quenched alloy after tensile test, respectively.

FIG. 11(*a*)-1~FIG. 11(*b*)-4 The microstructure and fracture metallographic analyses of the Fe-28.6 wt. % Mn-9.84 wt. % Al-2.05 wt. % C alloy after being aged at 450° C. FIG. 11(*a*)-1~FIG. 11(*a*)-2 TEM bright-field and $(100)_{\kappa'}$ dark-field images of the alloy after being aged for 6 hours, respectively; FIG. 11(*b*)-1~FIG. 11(*b*)-2 SEM images of the alloy after being aged for 9 hours and its tensile free surface, respectively; FIG. 11(*b*)-3~FIG. 11(*b*)-4 SEM images of the alloy after being aged for 12 hours and its tensile free surface, respectively.

FIG. 12 The comparison table of tensile mechanical properties of the Fe-29.0 wt. % Mn-9.76 wt. % Al-1.82 wt. % C and Fe-28.6 wt. % Mn-9.84 wt. % Al-2.05 wt. % C alloys disclosed in the present invention in the as-quenched condition and after being aged at 450° C., 500° C., and 550° C. for various times, as well as those of the FeMnAlC alloy systems disclosed in the prior arts.

FIG. 13(*a*) SEM image of the alloy after being aged for 4 hours; FIG. 13(*b*)-1~FIG. 13 (*b*)-3 TEM bright-field image, a SADP (hkl: austenite phase; hkl: κ'-carbide) and EDS profile obtained from a coarse grain boundary precipitate of the alloy after being aged for 5 hours; FIG. 13(*c*) TEM bright-field image of the alloy after being aged for 6 hours.

FIG. 14(*a*) Cross-sectional SEM image; FIG. 14(*b*)-1 TEM bright-field image of the nitrided layer; FIG. 14(*b*)-2~FIG. 14(*b*)-4 three SADPs taken from the area I marked in FIG. 14(*b*)-1. The zone axes of AlN are [001], [011], and [$\bar{1}$11], respectively; FIG. 14(*c*)-1~FIG. 14(*c*)-6 TEM micrographs of the area II marked in FIG. 14(*b*)-1. FIG. 14(*c*)-1 bright field image, FIG. 14(*c*)-2~FIG. 14(*c*)-5 four SADPs of AlN and $Fe_4N$ (hkl: AlN, <u>hkl</u>: $Fe_4N$). The zone axes of both two phases are [001], [011], [$\bar{1}$11], and [$\bar{2}\bar{1}\bar{1}$]. FIG. 14(*c*)-6 dark-field image of AlN; FIG. 14(*d*)-1~FIG. 14(*d*)-3 TEM bright-field image, a SADP (the zone axes of AlN, austenite, and κ'-carbides are all [001]; <u>hkl</u>: austenite, hkl: κ'-carbide, the arrows indicated: AlN), and dark-field image of AlN, respectively, of the area C marked in FIG. 14(*a*); FIG. 14(*e*) The surface microhardness as a function of the depth for the nitrided alloy; FIG. 14(*f*) SEM image of the tensile fracture surface; FIG. 14(*g*) The corrosion polarization curves in 3.5% NaCl solution for the as-quenched (prior to nitriding) and nitrided alloys.

FIG. 15 Comparisons of mechanical properties, corrosion resistance in 3.5% NaCl solution, surface microhardness of some alloys disclosed in the present invention (with and without nitriding treatments), and those of the commercial AISI 4140 and 4340 alloy steels as well as AISI 304, 316, 410 and 17-4PH stainless steels.

FIG. 16(*a*) cross-sectional SEM image; FIG. 16(*b*) XRD diffraction pattern; FIG. 16(*c*) The surface microhardness as a function of the depth for the nitrided alloy; FIG. 16 (*d*) SEM image of the tensile fracture surface; FIG. 16(*e*) The corrosion polarization curves in 3.5% NaCl solution for the as-quenched (prior to nitriding) and nitrided alloys.

FIG. 17(*a*) cross-sectional SEM image; FIG. 17(*b*) XRD diffraction pattern; FIG. 17(*c*) The surface microhardness as a function of the depth for the nitrided alloy; FIG. 17(*d*) SEM image of the tensile fracture surface; FIG. 17(*e*) The corrosion polarization curves in 3.5% NaCl solution for the as-quenched (prior to nitriding) and nitrided alloys.

DESCRIPTION OF THE PREFERRED EMBODIMENT

Example 1

Figure 10A:
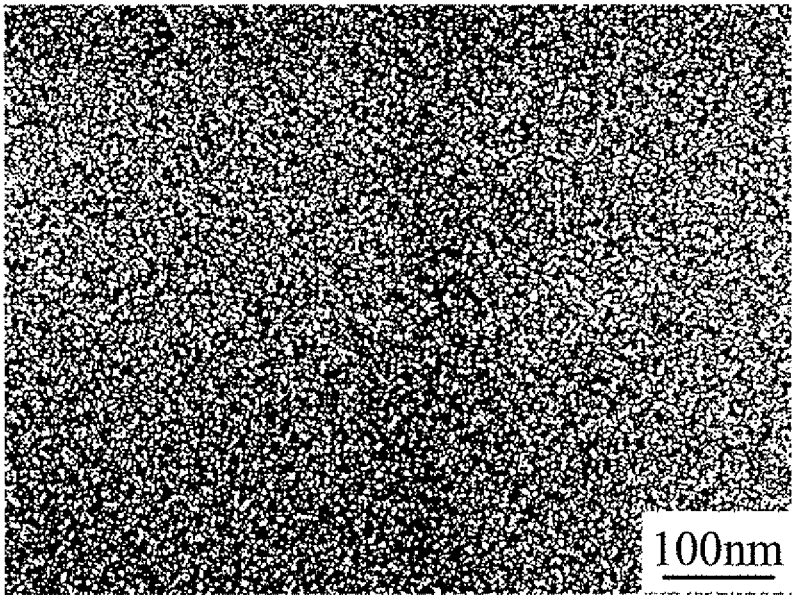
FIG. 10(*a*)~FIG. 10(*c*) The microstructure and fracture metallographic analyses of the Fe-27.6 wt. % Mn-9.06 wt. % Al-1.96 wt. % C alloy after being solution heat-treated at 1200° C. for 2 hours and then quenched into room-temperature water.
Figure 10B:
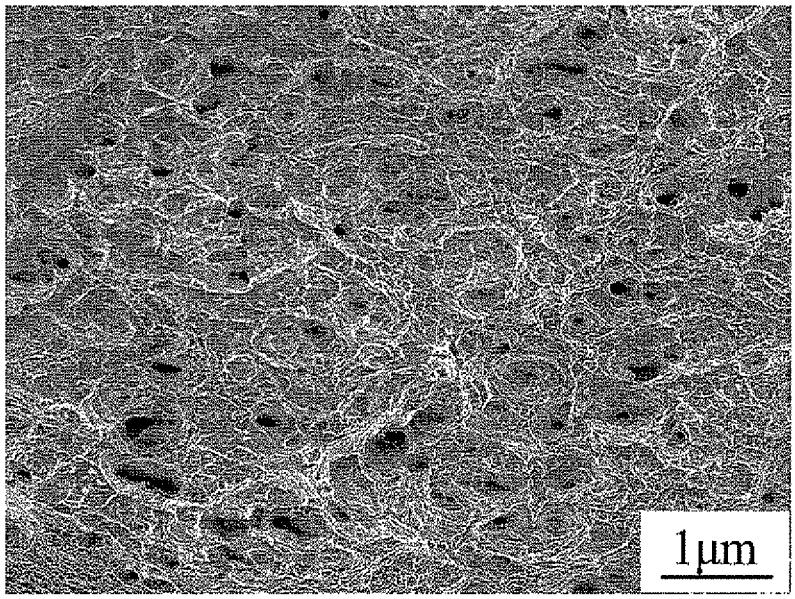
Figure 10C:
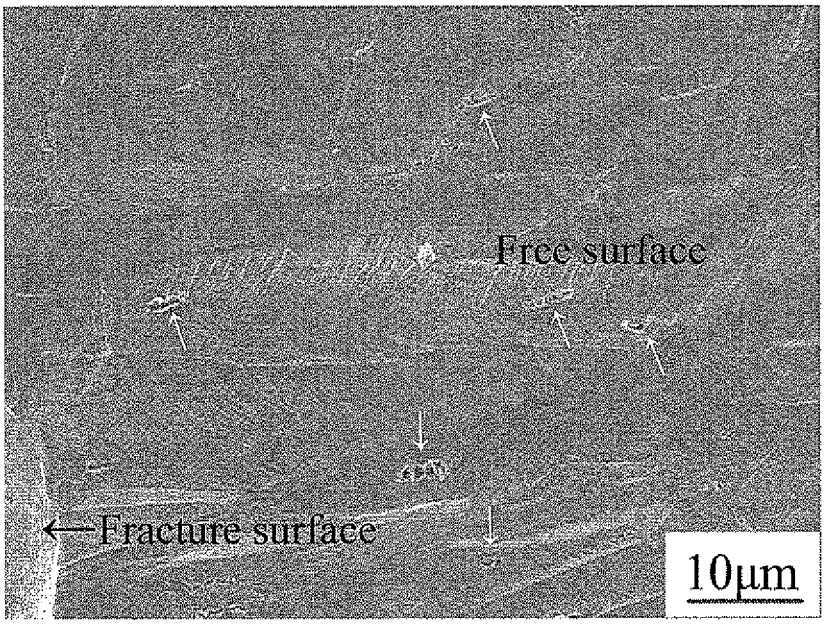
Figures 1, 11A:
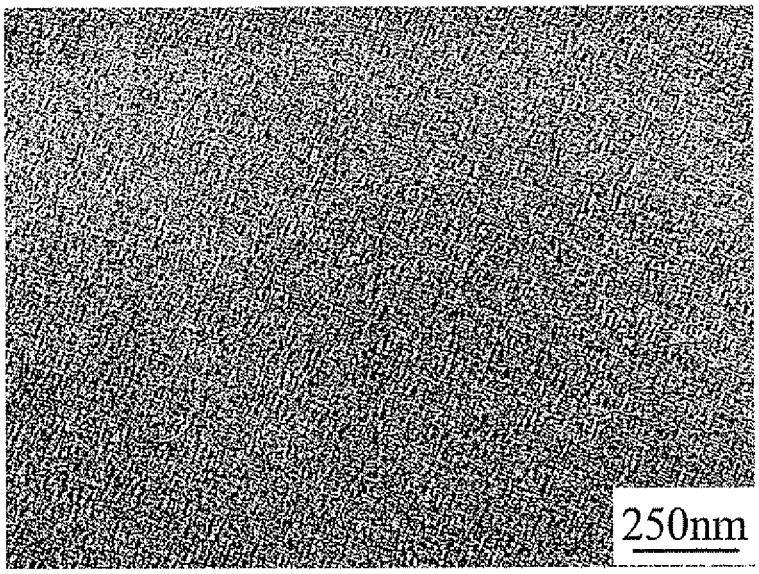
Figures 2, 11A:
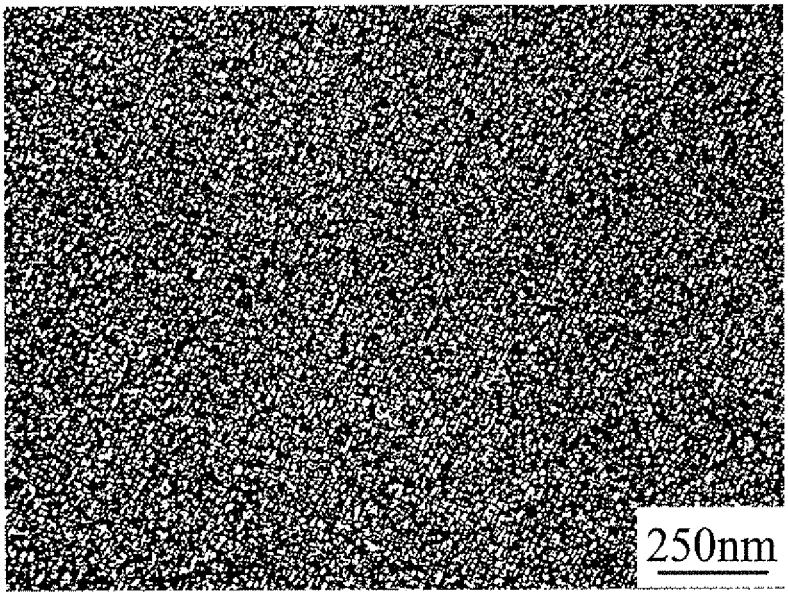
Figures 1, 11B:
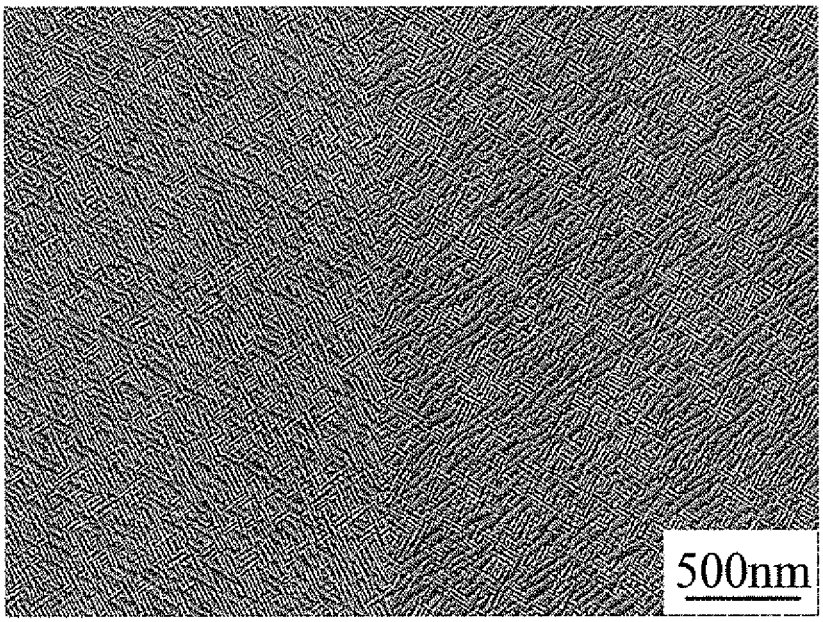
Figures 2, 11B:
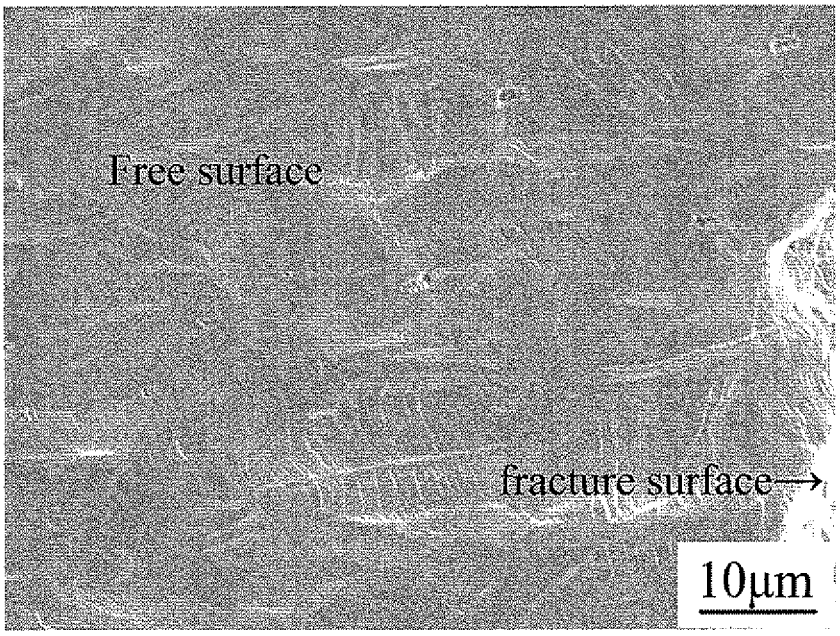
Figures 3, 11B:
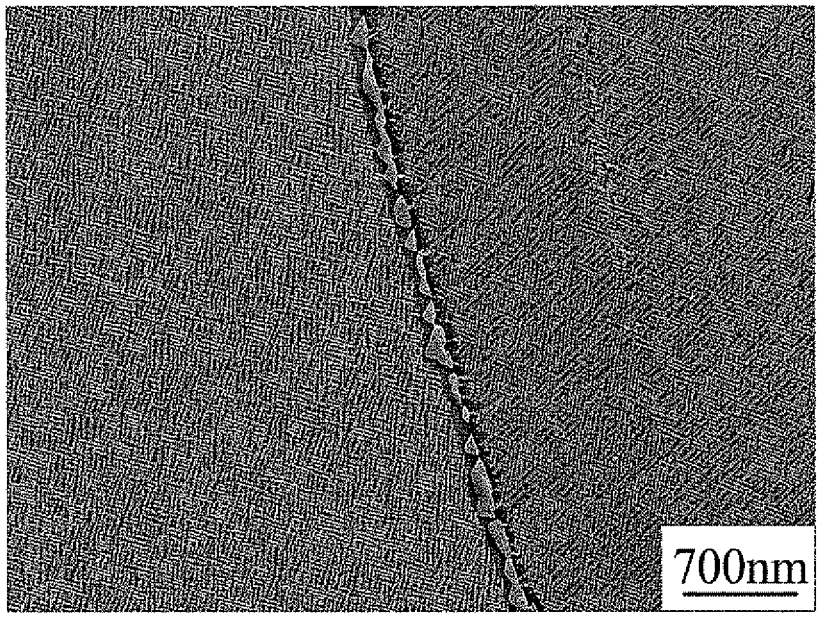
Figures 4, 11B:
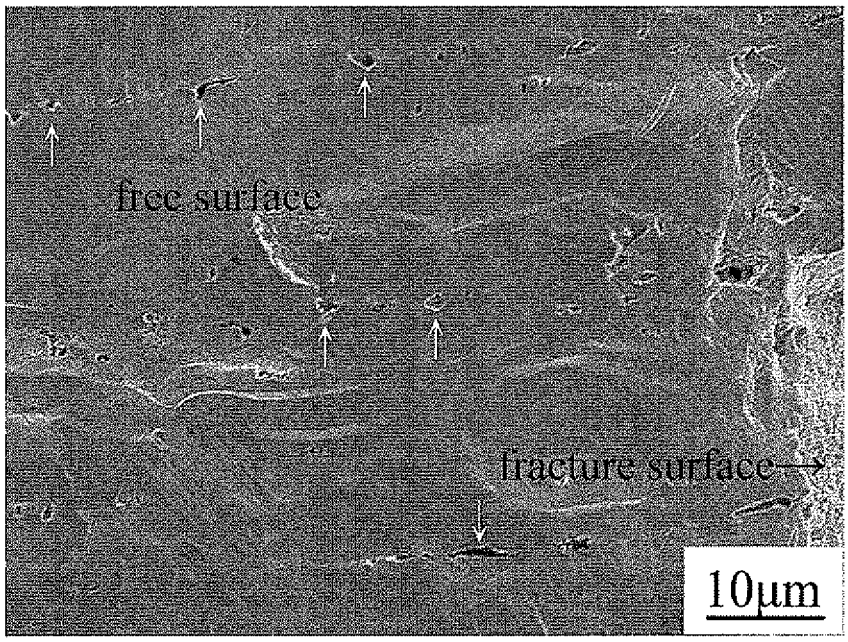
Figure 13A:
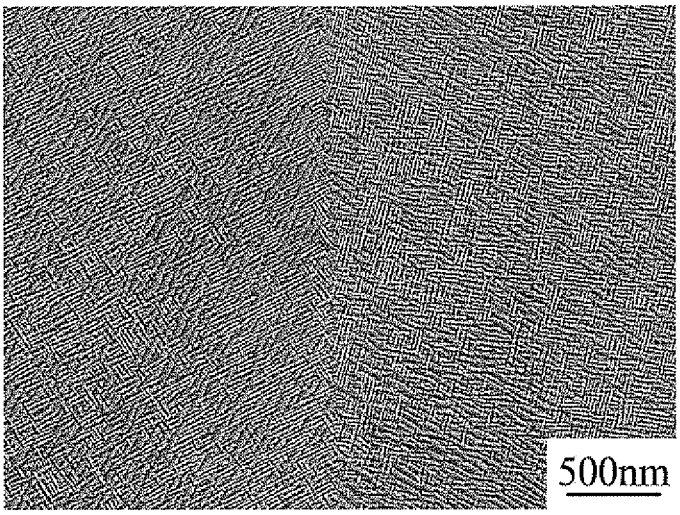
FIG. 13(*a*)~FIG. 13(*c*) The microstructure analyses of the Fe-29.0 wt. % Mn-9.76 wt. % Al-1.82 wt. % C alloy after being aged at 550° C.
Figures 1, 13B:
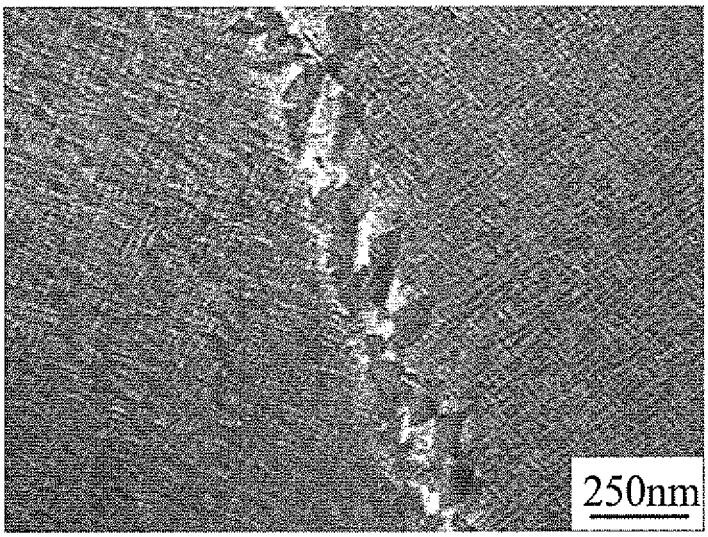
Figures 2, 13B:
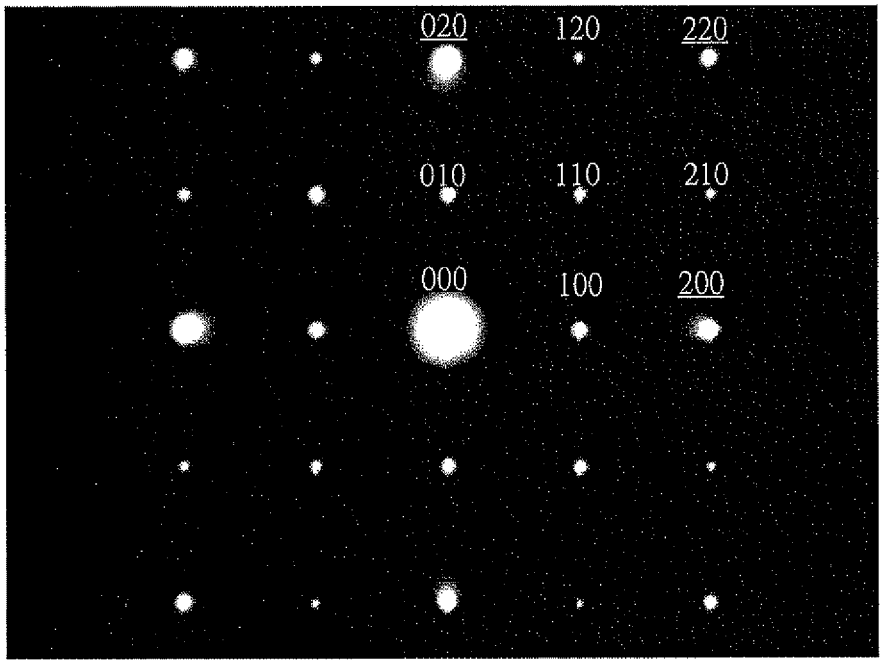
Figures 3, 13B:
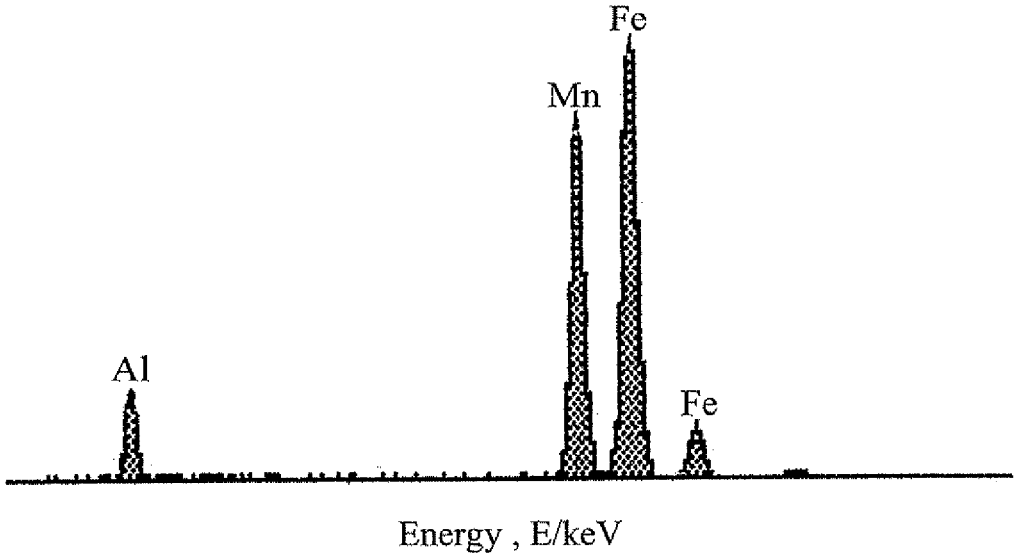
Figure 13C:
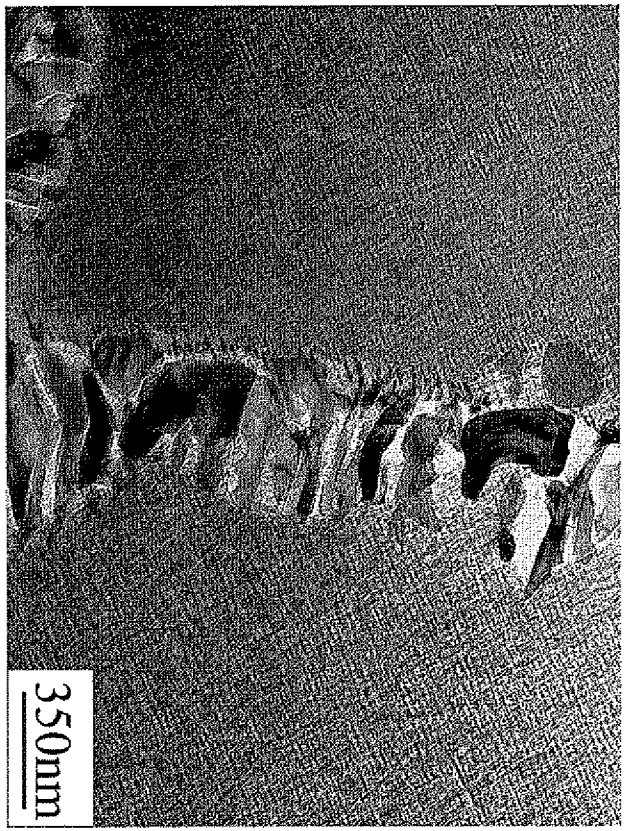
Figure 14A:
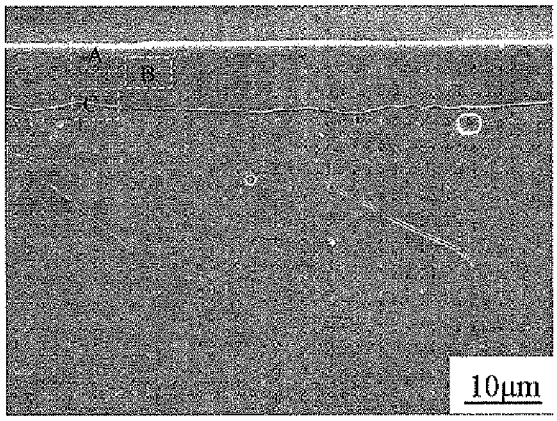
FIG. 14(*a*)~FIG. 14(*g*) The microstructure and fracture metallographic analyses of the Fe-28.6 wt. % Mn-9.26 wt. % Al-1.98 wt. % C alloy after plasma nitriding at 450° C. for 12 hours in a plasma nitriding chamber filled with 50% $N_2$+50% $H_2$ mixed gas at 4 torr pressure.
Figures 2, 14B:
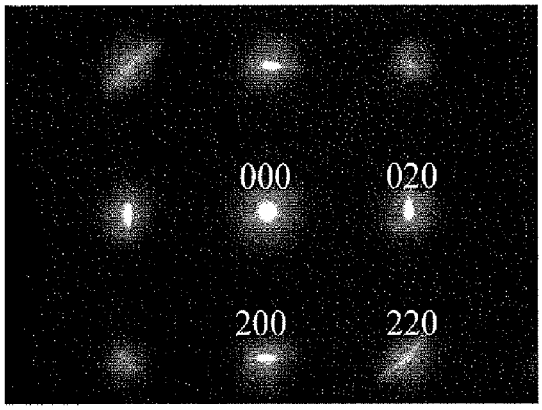
Figures 1, 14B:
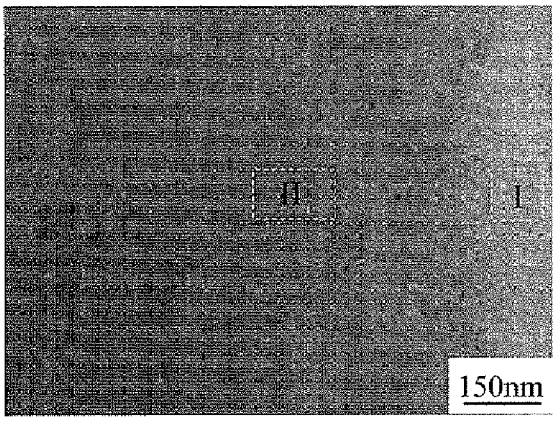
Figures 3, 14B:
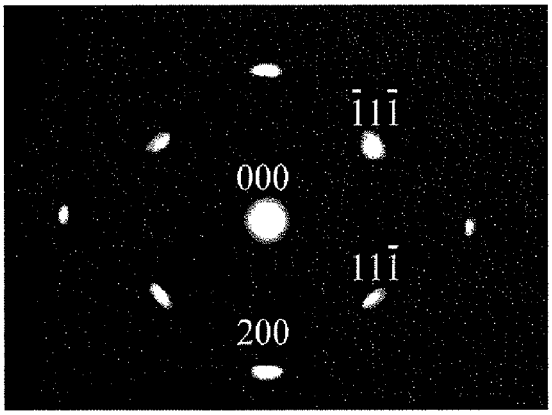
Figures 4, 14B:
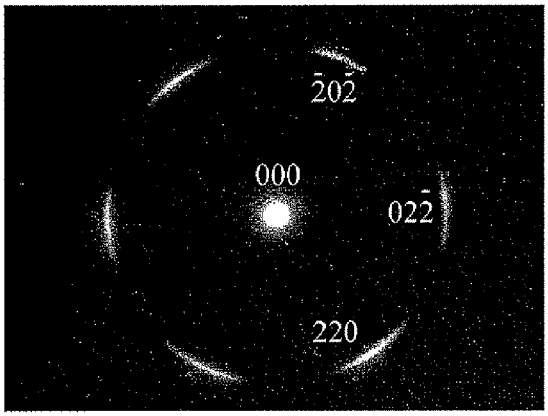
Figures 1, 14C:
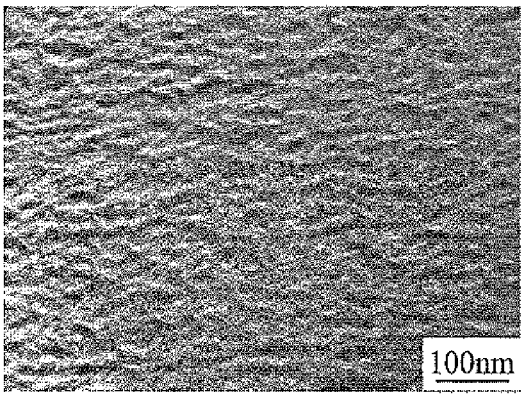
Figures 4, 14C:
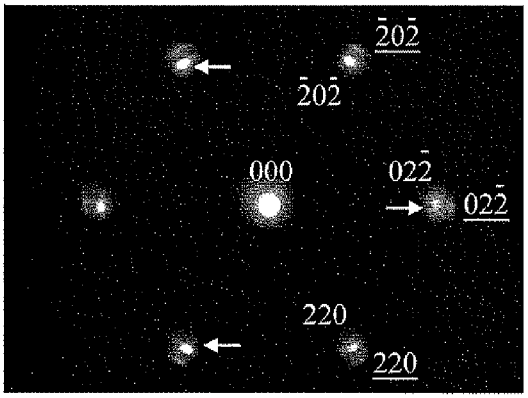
Figures 2, 14C:
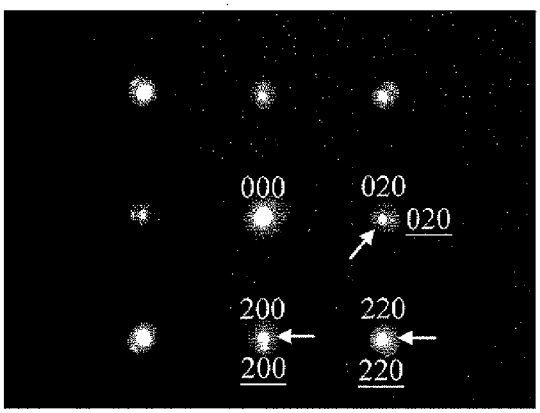
Figures 5, 14C:
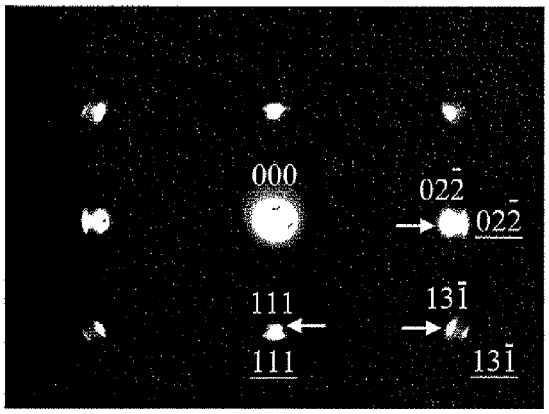
Figures 3, 14C:
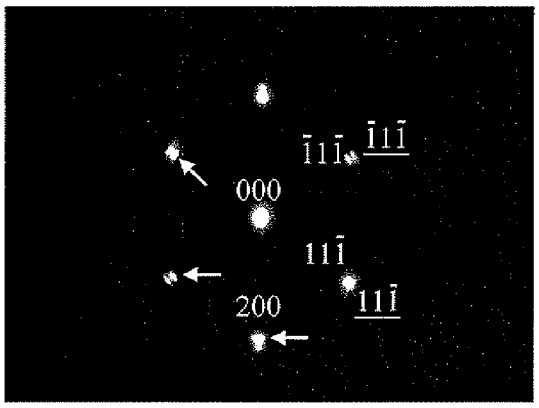
Figures 6, 14C:
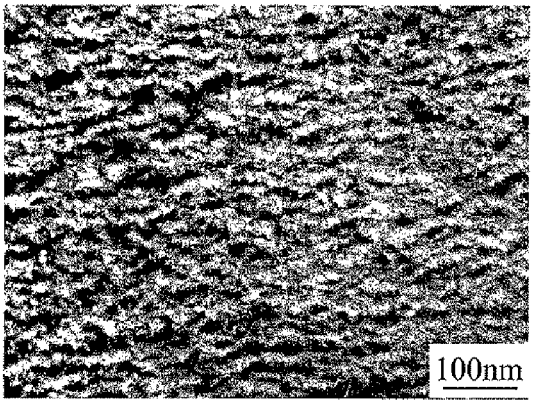
Figures 1, 14D:
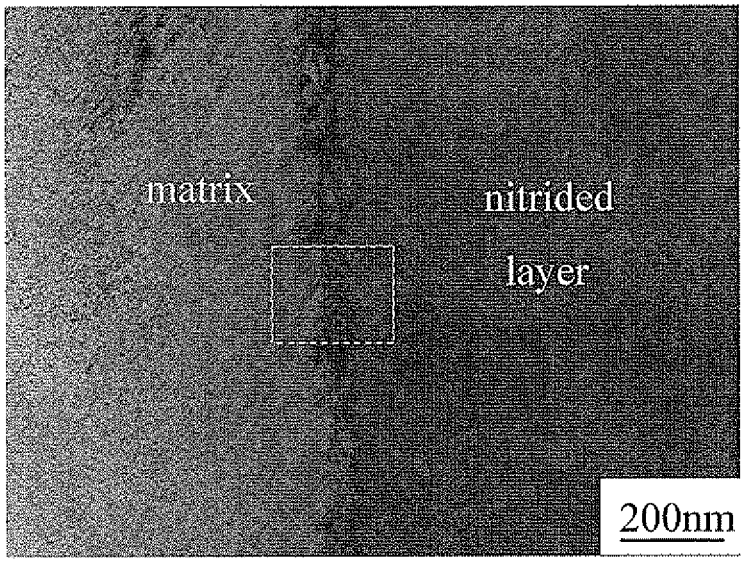
Figures 2, 14D:
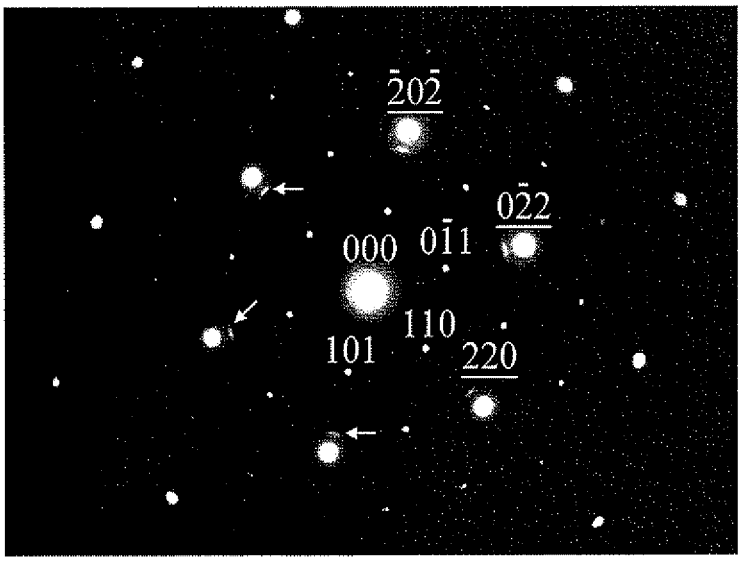
Figures 3, 14D:
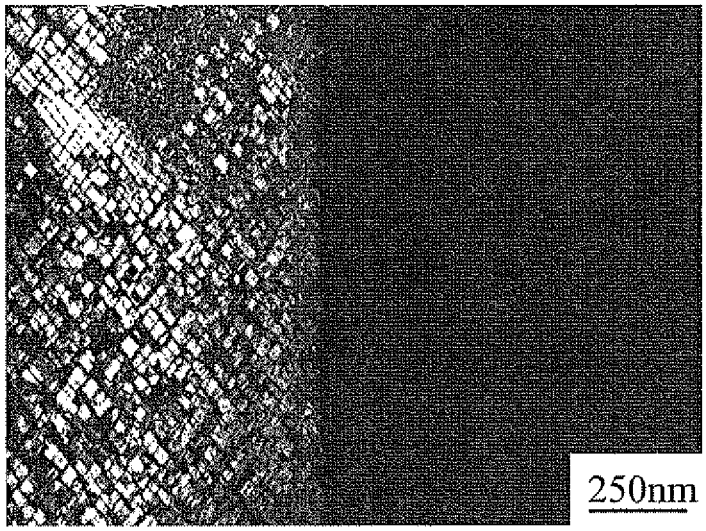
Figure 14E:
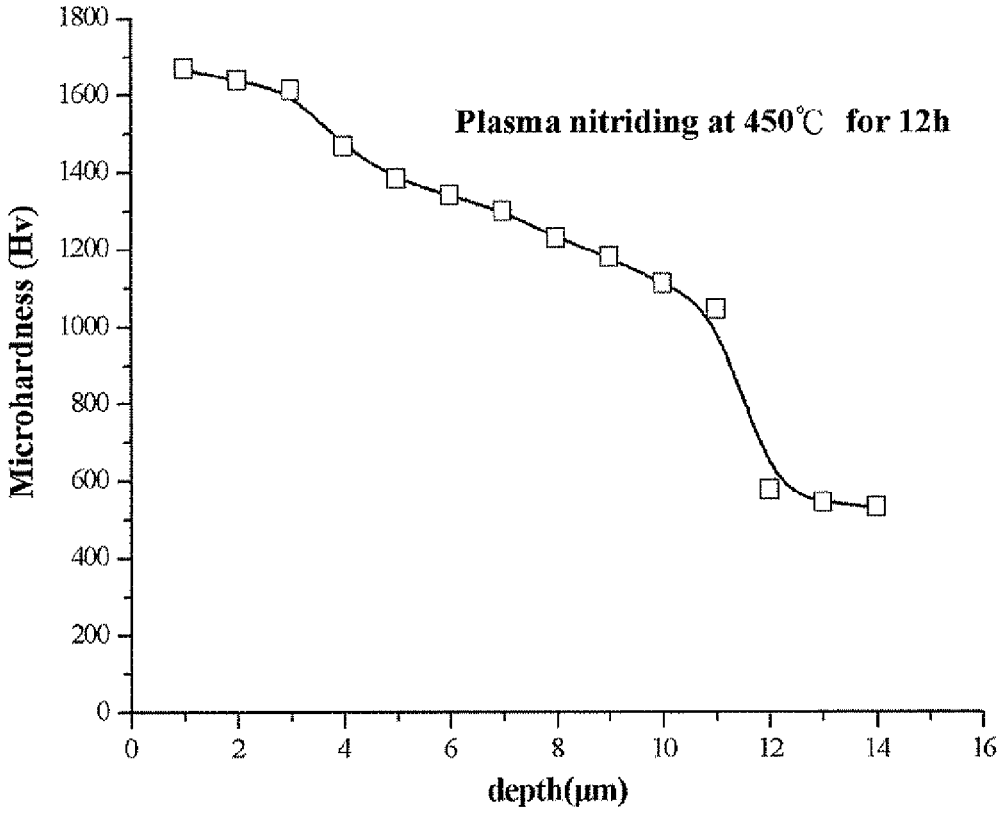
Figure 14F:
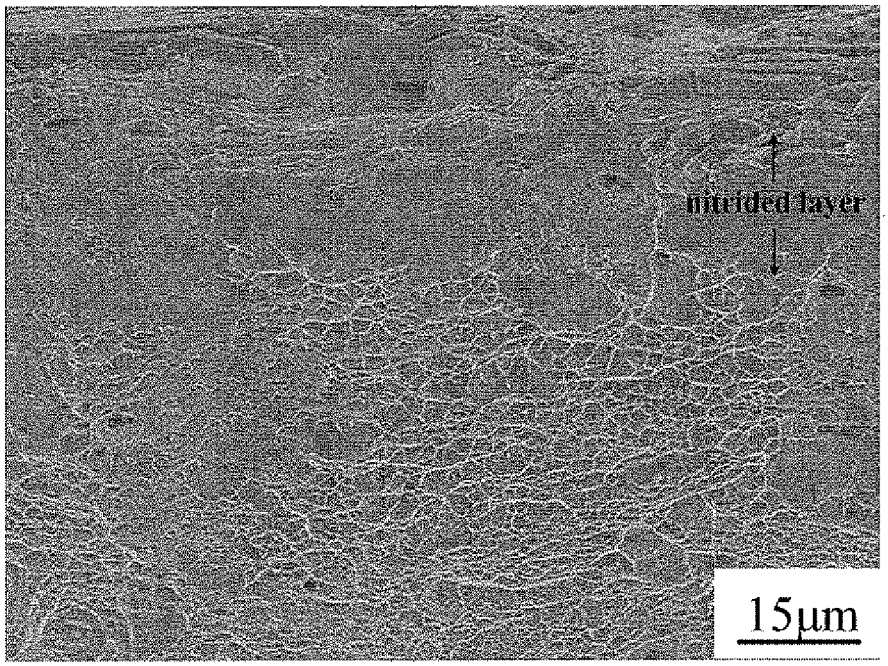
Figure 14G:
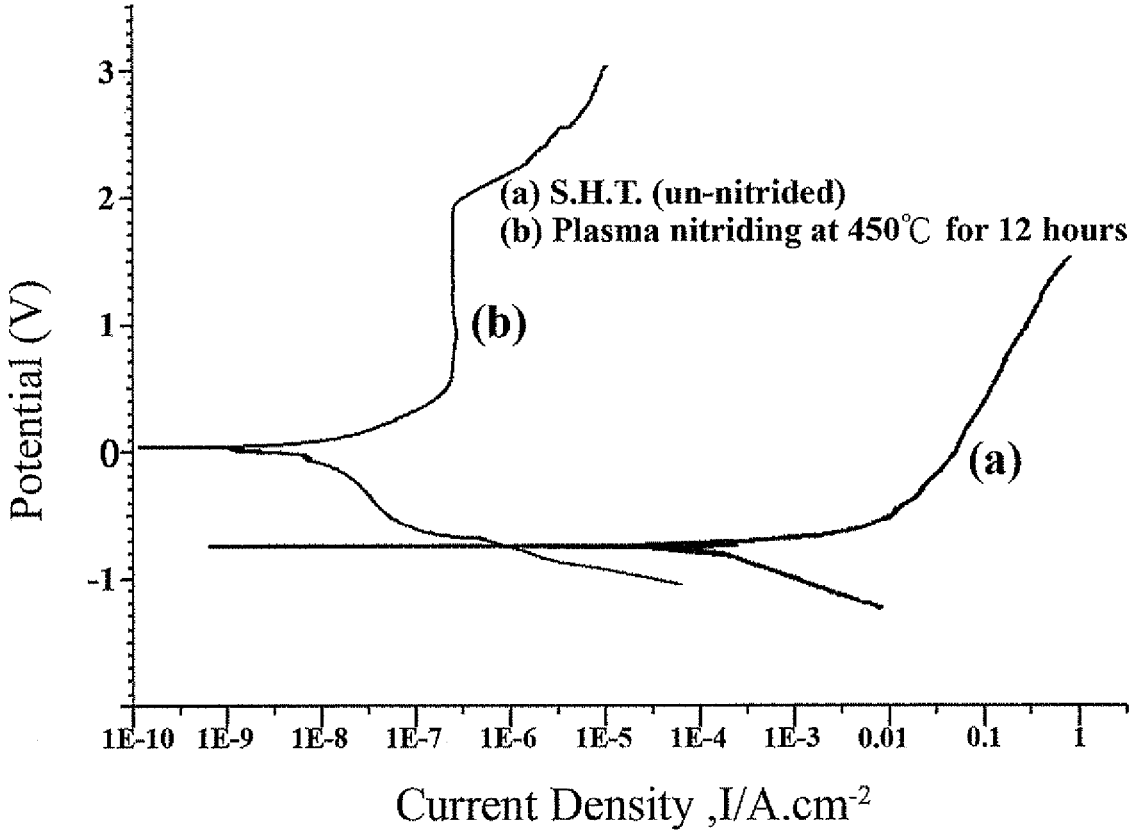
Figure 16A:
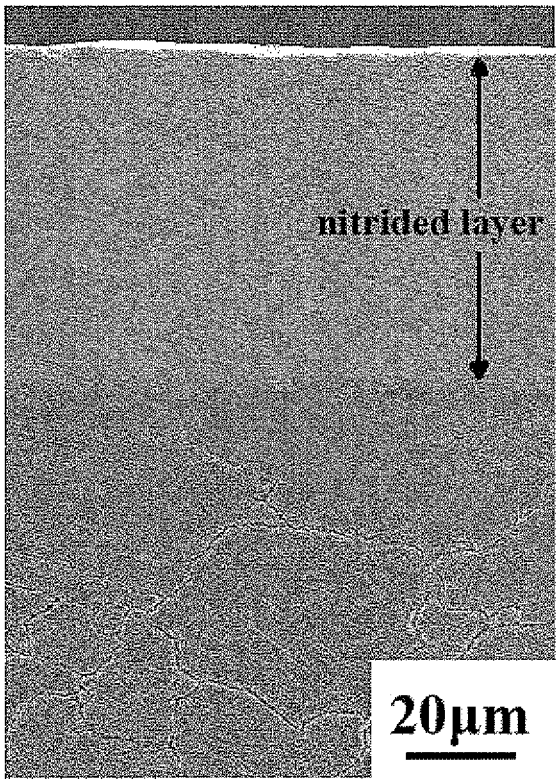
FIG. 16(*a*)~FIG. 16 (*e*) The microstructure, fracture metallograph, hardness, and corrosion resistance analyses of the Fe-30.5 wt. % Mn-8.68 wt. % Al-1.85 wt. % C alloy after plasma nitriding at 500° C. for 8 hours in a plasma nitriding chamber filled with 65% $N_2$+35% $H_2$ mixed gas at 1 torr pressure.
Figure 16B:
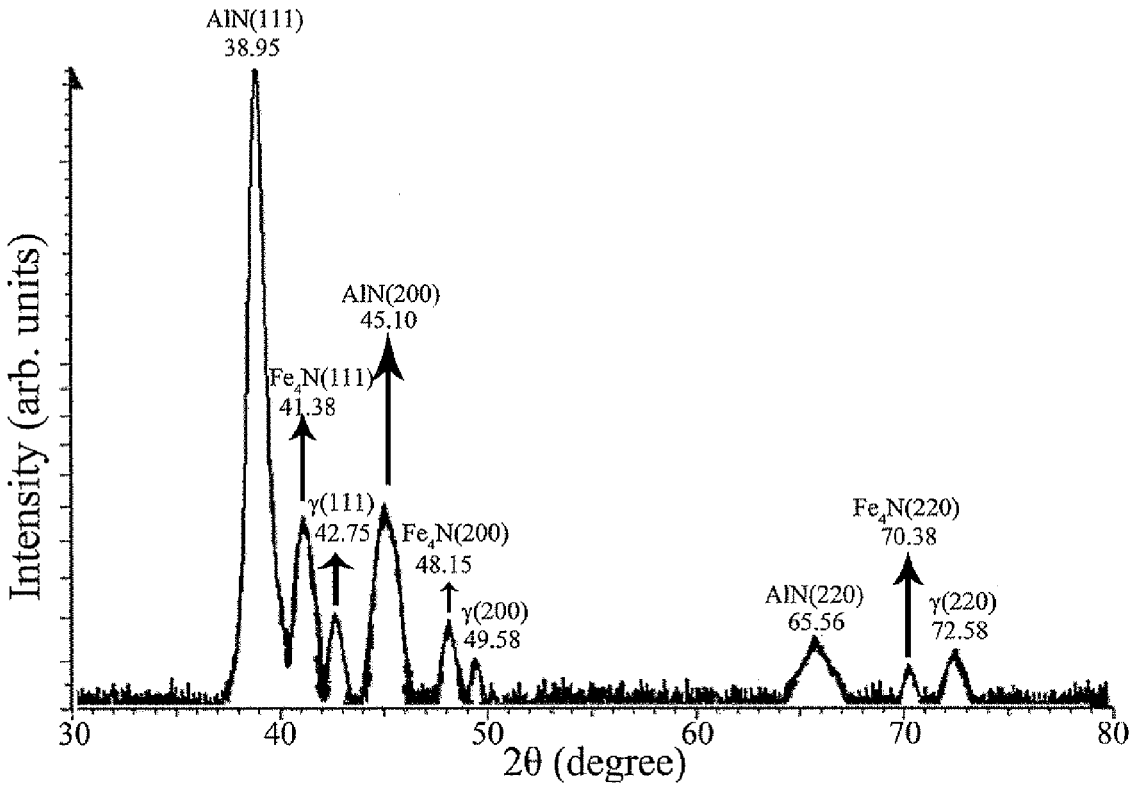
Figure 16C:
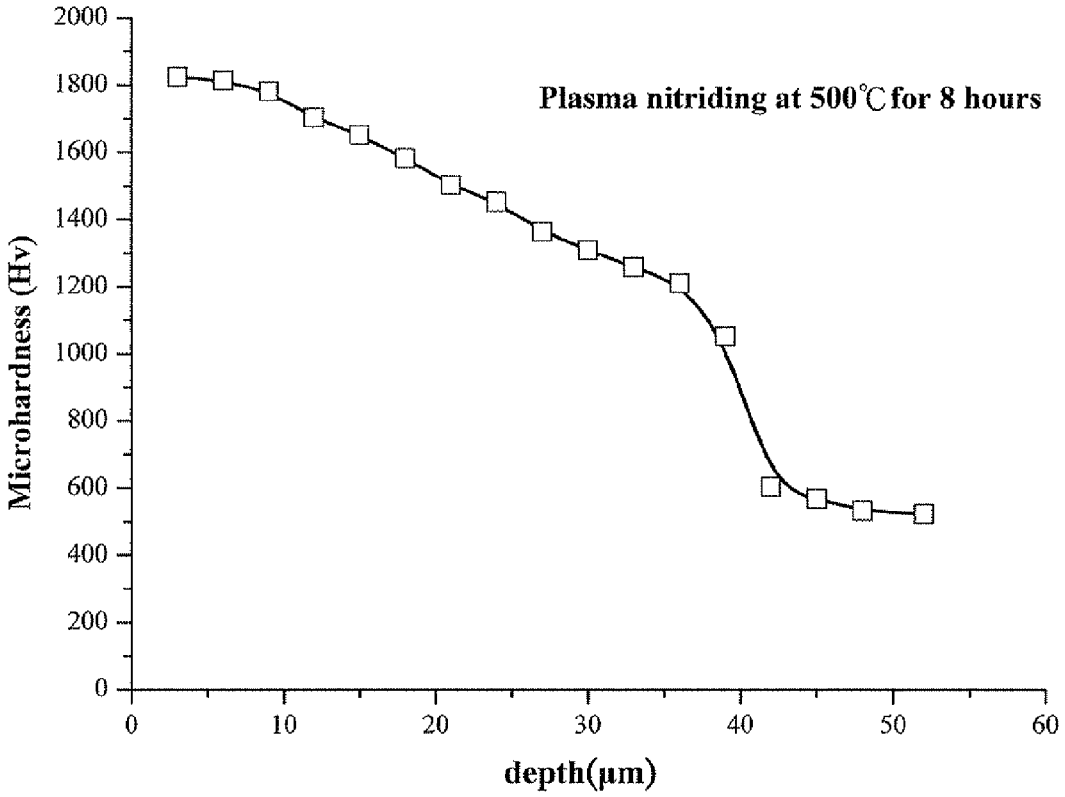
Figure 16D:
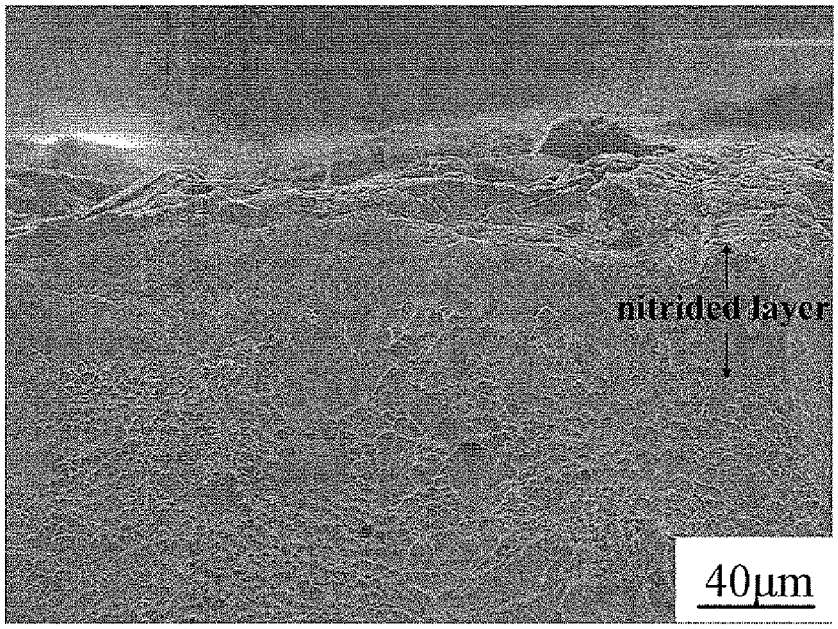
Figure 16E:
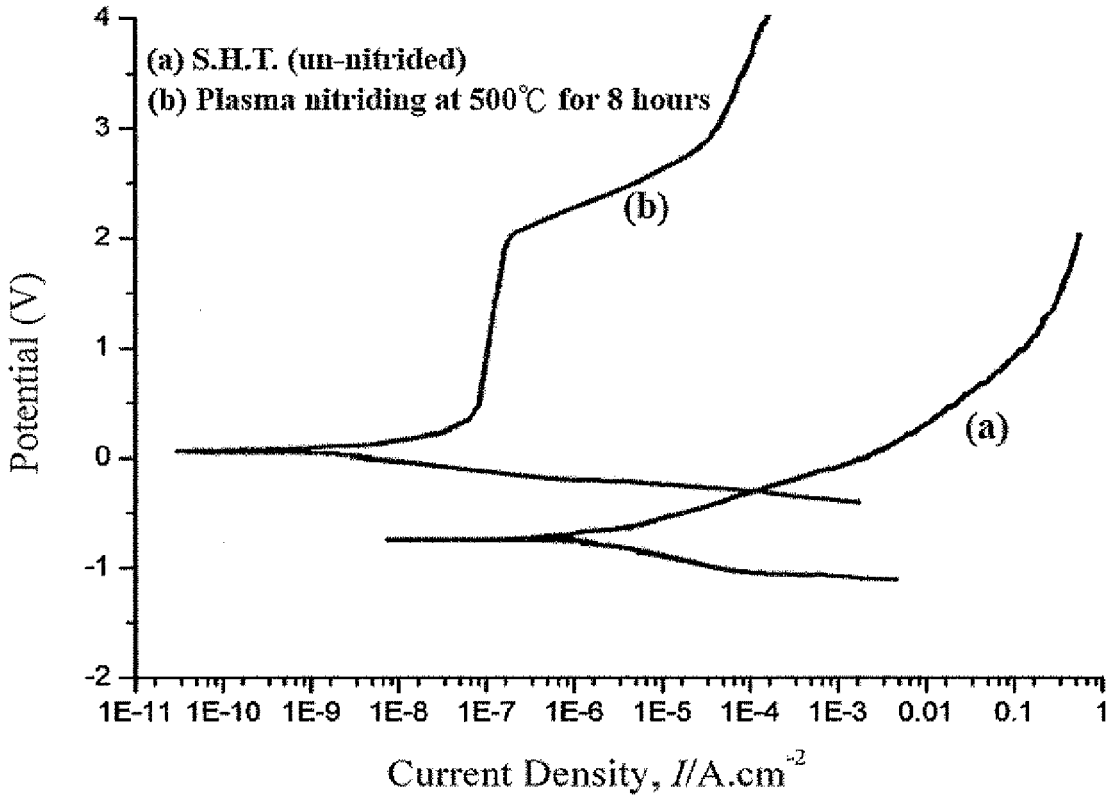
Figure 17A:
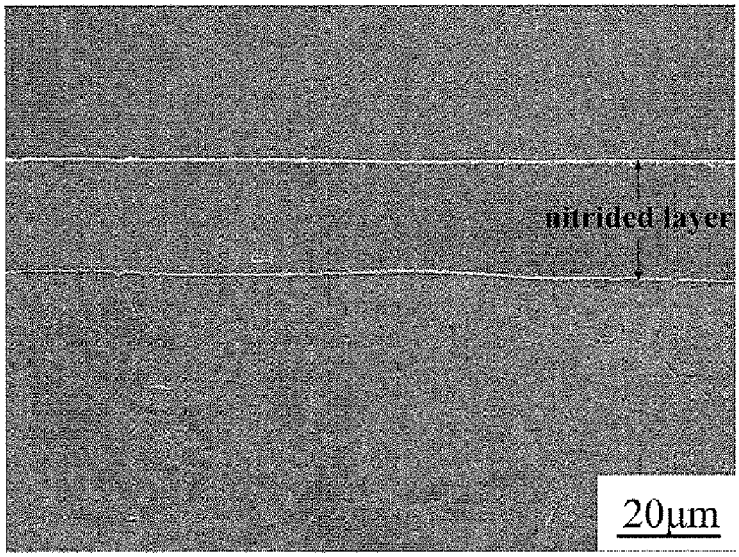
FIG. 17(*a*)~FIG. 17(*e*) The microstructure, fracture metallograph, hardness, and corrosion resistance analyses of the Fe-28.5 wt. % Mn-7.86 wt. % Al-1.85 wt. % C alloy after gas nitriding at 550° C. for 4 hours in a gas nitriding chamber filled with 60% $NH_3$+40% $N_2$ mixed gas at ambient pressure.
Figure 17B:
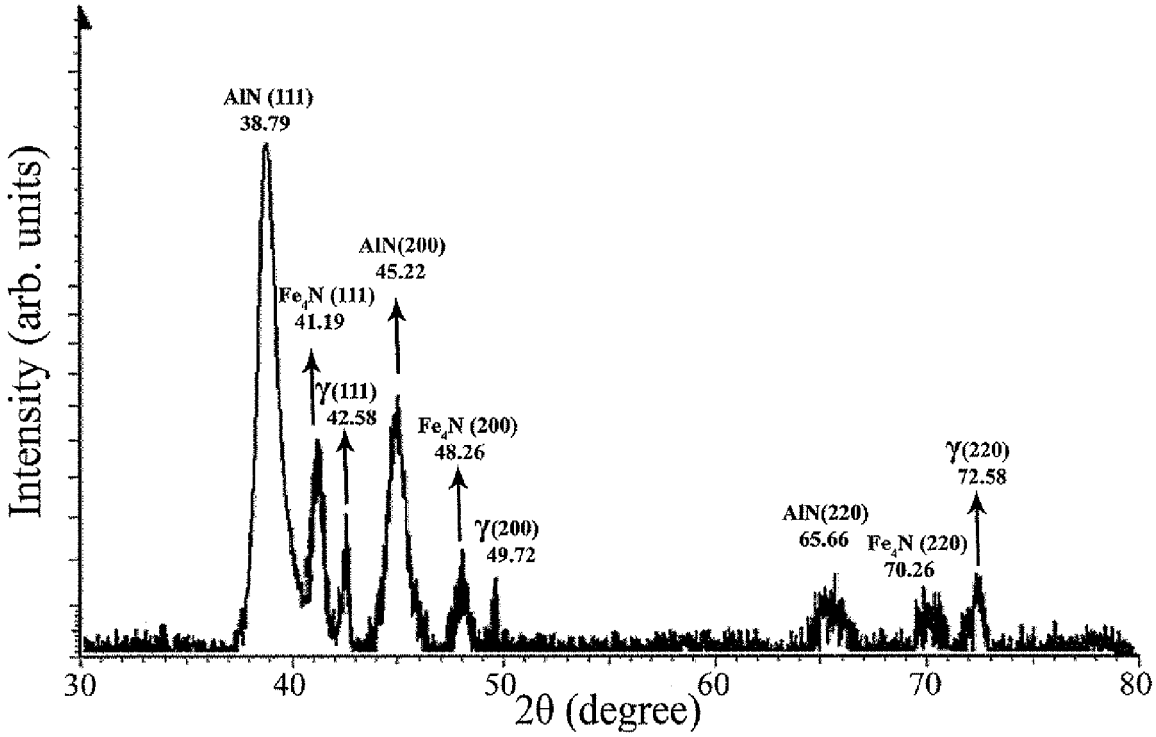
Figure 17C:
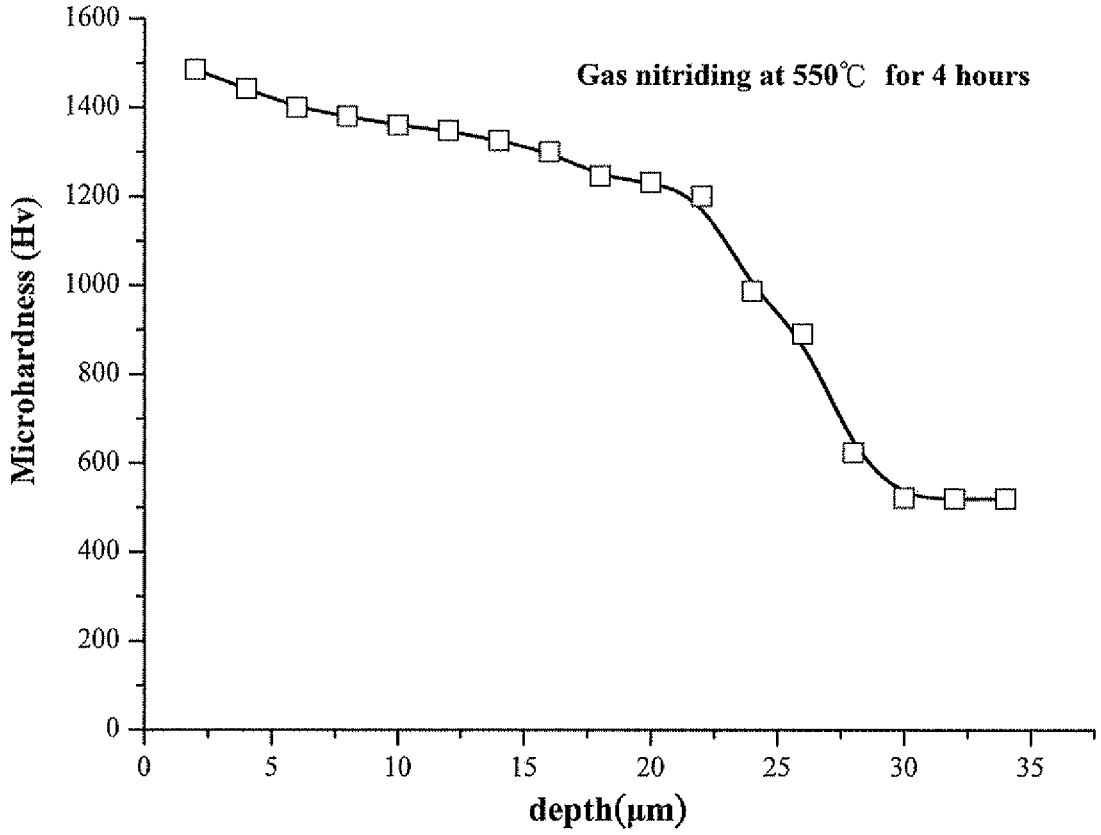
Figure 17D:
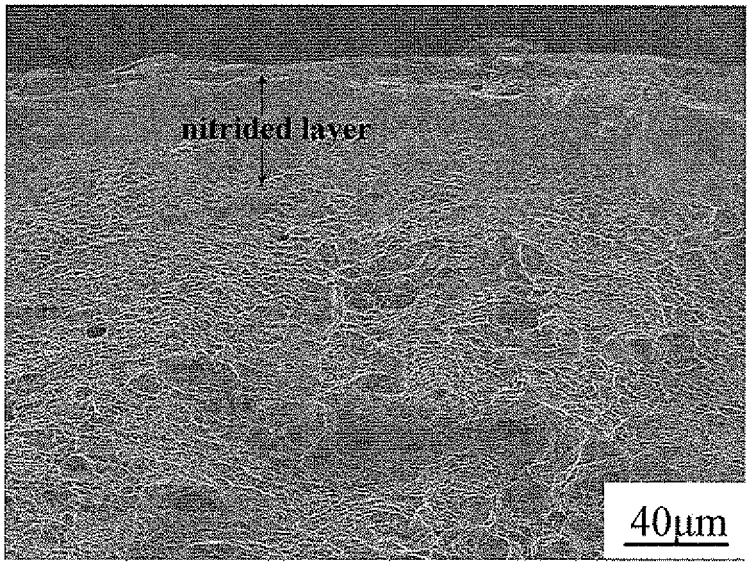
Figure 17E:
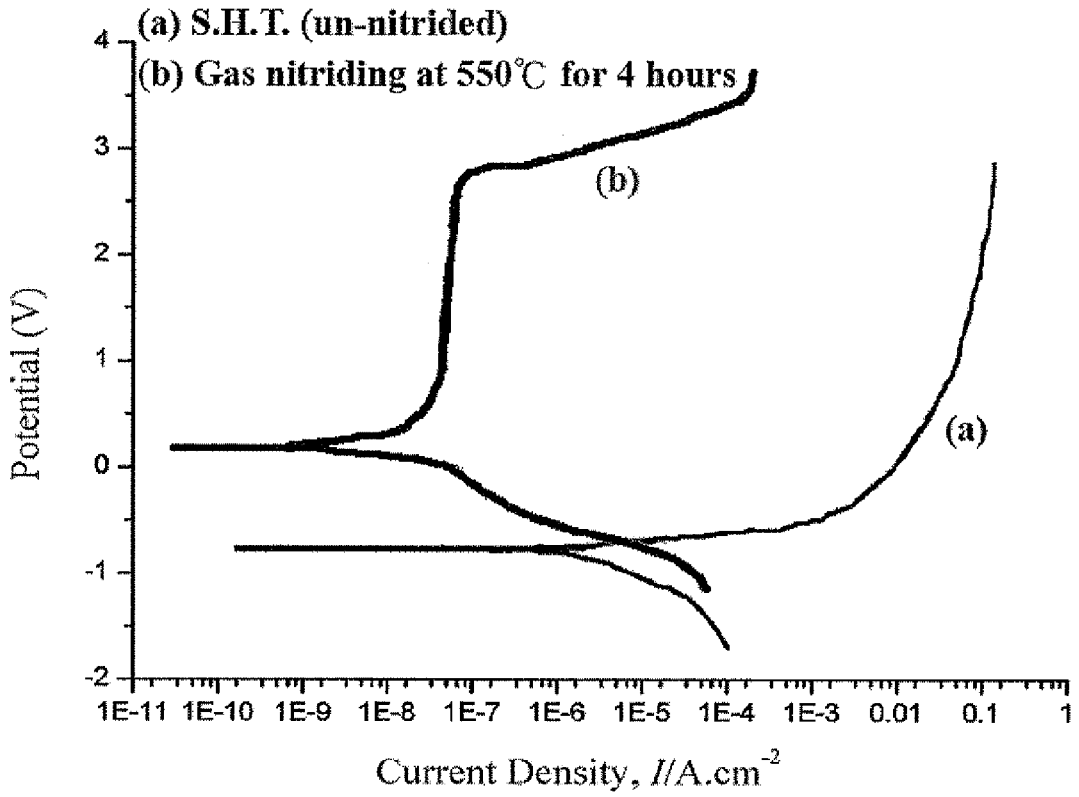

FIG. 10(*a*) shows the TEM $(100)_{\kappa'}$ dark-field image of an Fe-27.6 wt. % Mn-9.06 wt. % Al-1.96 wt. % C alloy disclosed in the present invention after being solution heat-treated at 1200° C. for 2 hours and then quenched into room temperature water. It is obvious that a high density of extremely fine κ'-carbides was formed within the austenite matrix. The result of tensile test revealed that the UTS, YS, and El of the present alloy are 1120 MPa, 892 MPa, and 53.5%, respectively. FIG. 10(*b*) is a SEM image taken from the fracture surface of the as-quenched alloy after tensile test, revealing the presence of ductile fracture with fine and deep dimples. FIG. 10(*c*) is a SEM micrograph taken from the free surface in the vicinity of the fracture surface, showing that the austenite grains were drastically elongated along the direction of the applied stress. Moreover, slip bands were generated over the specimen and some isolated microvoids (as indicated by arrows) were formed randomly within the grains. It is also seen in this figure that in spite of the presence of the microvoids, the austenite matrix had a high resistance to crack propagation and exhibited self-stabilization under deformation. These observations are expected, because the as-quenched alloy has an excellent elongation of 53.5%.

Comparing to the Fe—Mn—Al—C and Fe—Mn—Al-M-C with C≤1.3 wt. % alloys disclosed in the prior arts (typically in the as-quenched condition UTS=814~998 MPa, YS=410~560 MPa, and El=72-50%), under the as-quenched condition, the alloys disclosed in the present invention exhibited about 60% enhancement in the mechanical yield strength with almost equivalent elongation. The primary reason for the remarkable enhancement is believed to originate from the existence of the extremely fine κ'-carbides resulted from the spinodal decomposition during quenching. These κ'-carbides have the same crystal structure as the austenite matrix and can form coherent interface with the matrix. As a result, it not only strengthens the alloy but also keeps the excellent ductility of the alloy.

Example 2

This example is aimed to demonstrate the effects of aging time on microstructural evolution and associated mechanical properties of an Fe-28.6 wt. % Mn-9.84 wt. % Al-2.05 wt. % C alloy disclosed in the present invention, which was solution heat-treated, quenched and then aged at 450° C. for various times. This example will further illustrate the significant benefits resulted from one of the prominent novel features disclosed in the present invention, namely: "A high density of extremely fine κ'-carbides can be formed within the austenite matrix through the spinodal decomposition mechanism during quenching". With this prominent feature, the alloys disclosed in the present invention can accomplish remarkable enhancements in mechanical strength while maintaining the excellent ductility by aging at much lower temperatures with significantly shortened aging time. The TEM $(100)_{\kappa'}$ dark-field image of the present alloy in the as-quenched condition has been shown in FIG. 1(*g*)-2.

Analysis performed on the dark-field image using the LECO2000 image analyzer further revealed that, in the as-quenched condition, the average particle size and volume fraction of the κ'-carbides within the austenite matrix were about 12 nm and 45%, respectively.

FIGS. 11(*a*)-1 and 11(*a*)-2 show the TEM bright-field and dark-field images of the same alloy after being aged at 450° C. for 6 hours, respectively. The image analyses indicate that, the average particle size and volume fraction of the κ'-carbides within the austenite matrix were increased to ~25 nm and 53%, respectively. FIG. 11(*a*)-2 also shows that the κ'-carbides started to grow slightly along certain crystallographic orientation. Under this circumstance, the UTS, YS, and El of the alloy are 1306 MPa, 1179 MPa, and 39.8%, respectively. FIG. 11(*b*)-1 shows the SEM image of the alloy after being aged at 450° C. for 9 hours, indicating that both the average particle size and volume fraction of the κ'-carbides are increased with increasing aging time. It is noted that there is still no grain boundary precipitates observed, and the UTS and YS of the alloy are further improved to 1518 MPa and 1414 MPa, respectively, while the elongation is kept at 30.8%. FIG. 11(*b*)-2, SEM free surface morphology of the fractured alloy (450° C., 9 hours), again, reveals the feature of many slip bands within the highly deformed and elongated grains, indicating the excellent ductility of the alloy.

When the aging time was increased to 12 hours, in addition to the κ'-carbides within the austenite matrix (which grew slightly), large κ-carbides were observed to appear on the austenite grain boundaries (FIG. 11(*b*)-3). At this stage, the UTS and YS of the alloy slightly increased to 1552 MPA and 1432 MPa, respectively, while the elongation significantly reduced to 26.3%. FIG. 11(*b*)-4, a SEM image taken from the free surface of the alloy after tensile test, indicates that, in addition to the slip bands appeared within the highly deformed and elongated grains, there are some small voids appearing primarily along the grain boundaries (as indicated by arrows). It is noted that these small voids do not link up together, which might explain why the alloy could still maintain an elongation of 26.3%, albeit the appearance of grain boundary precipitates. Comparing to the Fe—Mn—Al—C and Fe—Mn—Al-M-C with C≤1.3 wt. % alloys disclosed in the prior arts, it is apparent that the alloys disclosed in the present invention can accomplish the optimal combination of mechanical strength and ductility with lower aging temperatures and much shorter aging times. Moreover, with almost equivalent elongation, the present alloy can possess yield strength about 30% higher than that of the Fe-MN—Al-(M)-C (C≤1.3 wt. %) alloys disclosed in the prior arts even when they were optimally aged at 550° C. for 15~16 hours. FIG. 12 lists the detailed tensile mechanical properties of the alloys mentioned above for further comparisons.

Example 3

Figure 1A:
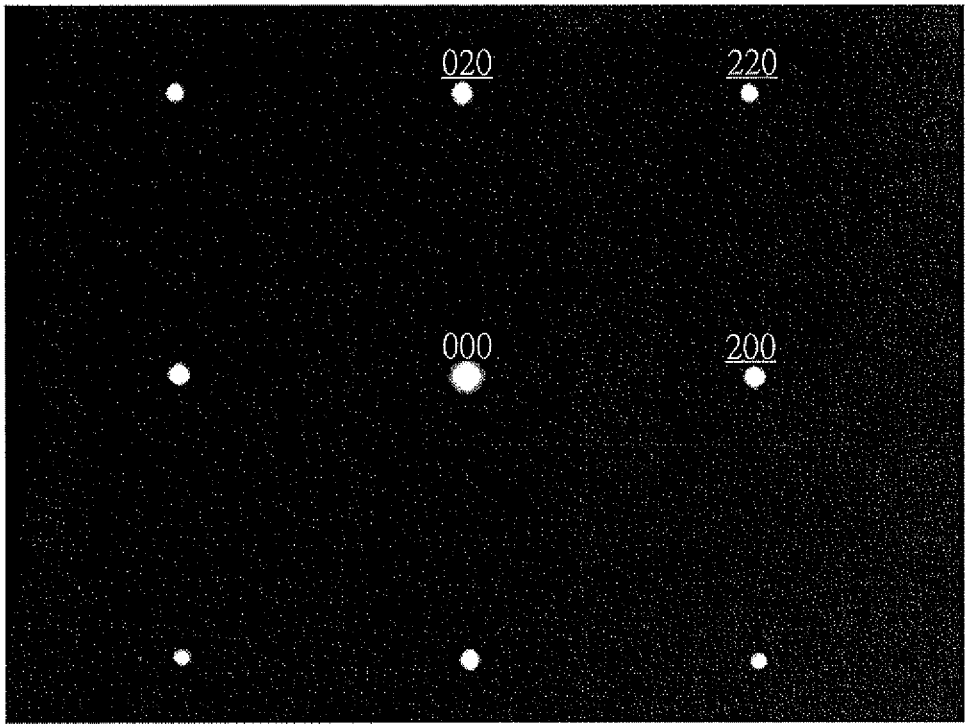
FIG. 1(*a*)~FIG. 1(*g*)-2 Transmission electron micrographs of the as-quenched Fe-29.0 wt. % Mn-9.8 wt. % Al-x wt. % C alloys.
Figures 1, 1B:
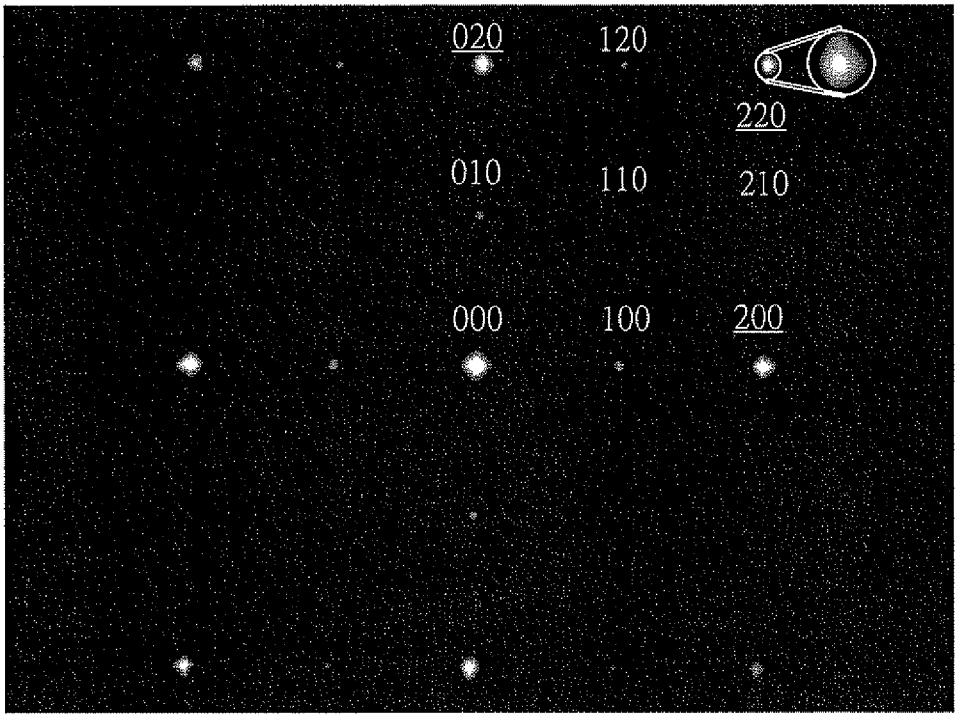
Figures 1, 1B, 2:
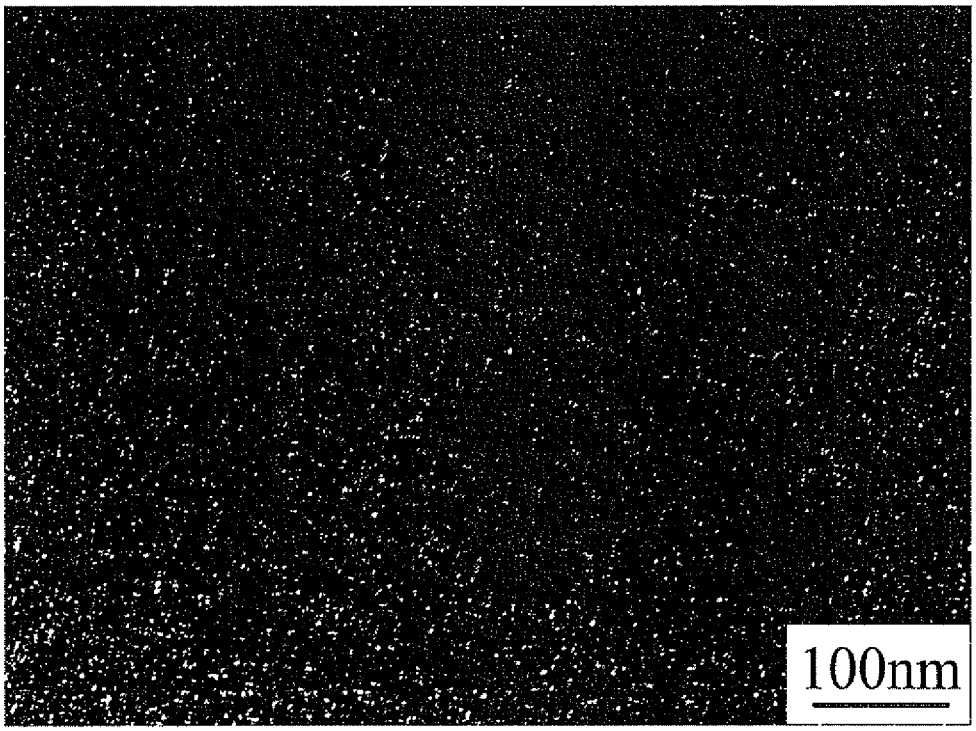
FIG. 2(*a*)~FIG. 2(*c*) Transmission electron micrographs of the as-quenched Fe-27.5 wt. % Mn-7.82 wt. % Al-2.08 wt. % C alloy.
Figures 1, 1C:
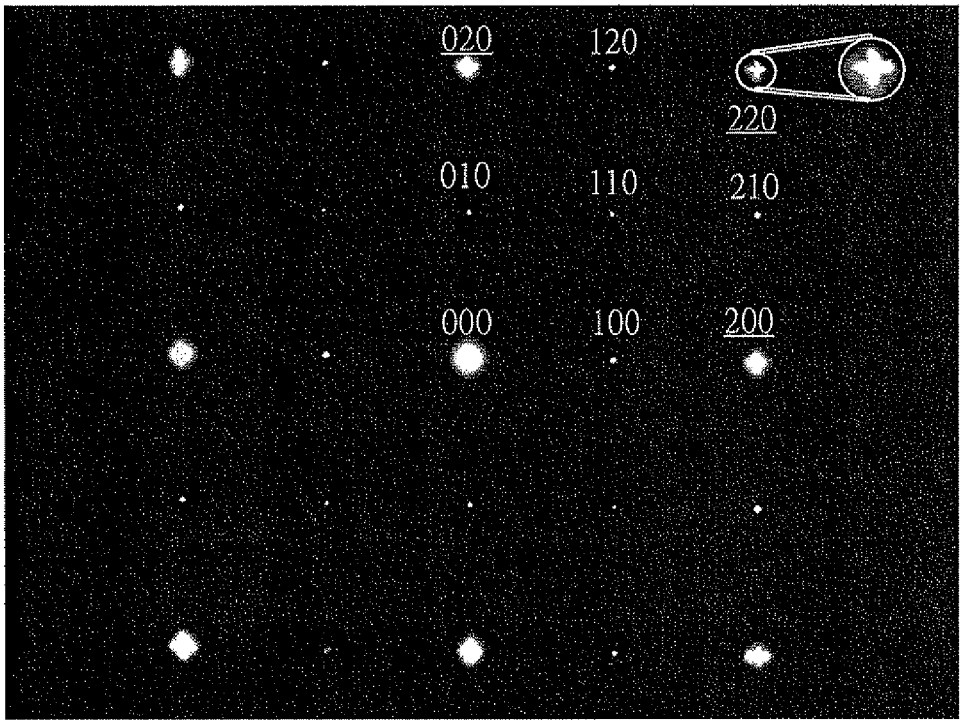
Figures 1, 1C, 2:
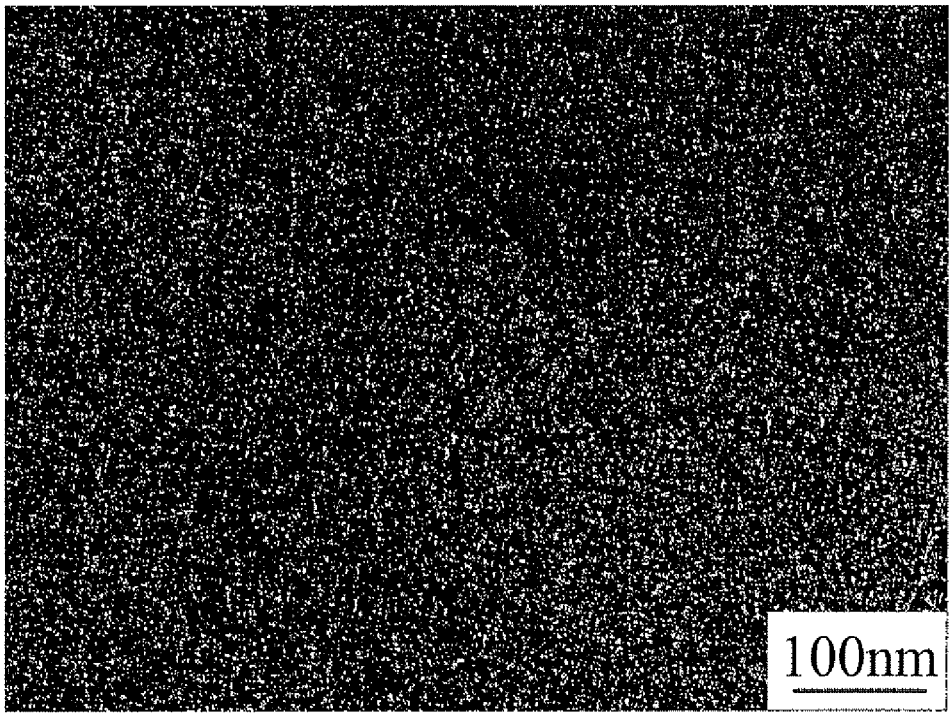
Figures 1, 1D:
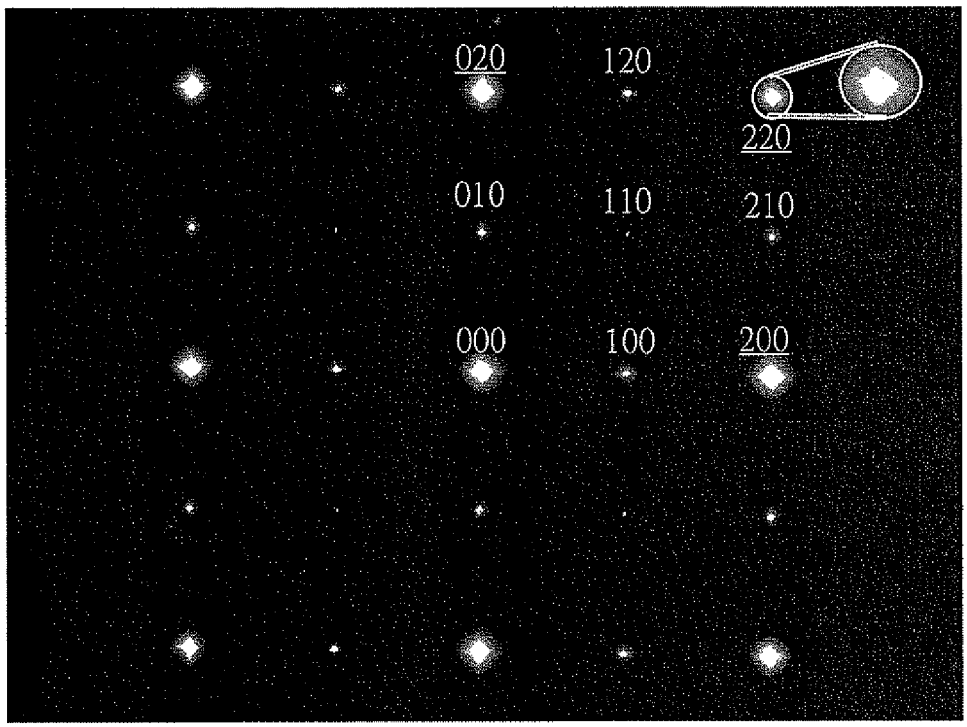
Figures 1, 1D, 2:
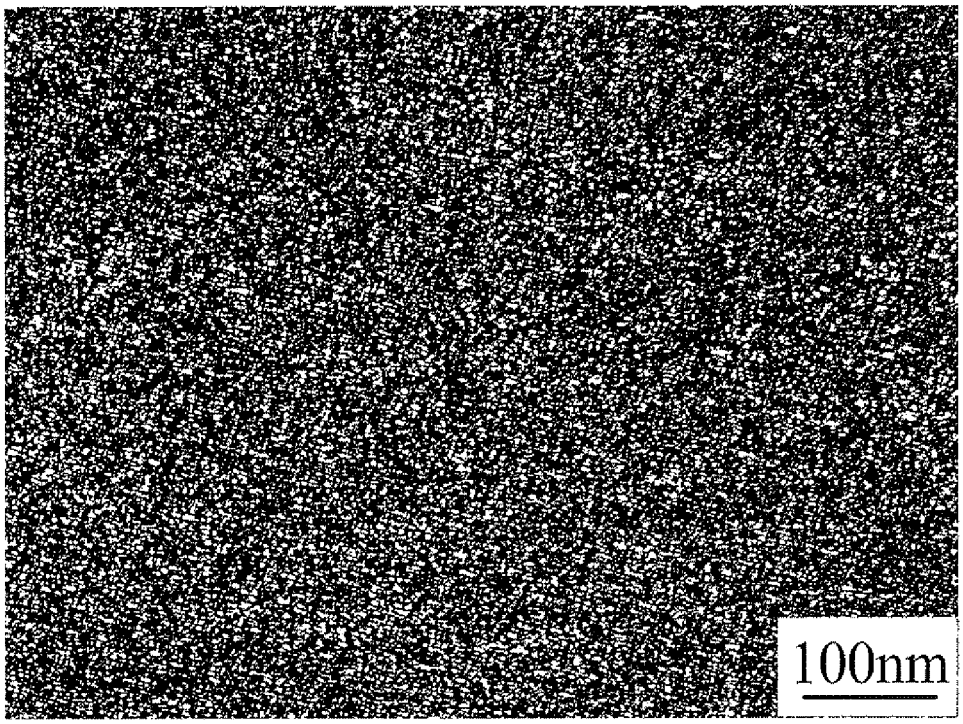
Figures 1, 1E:
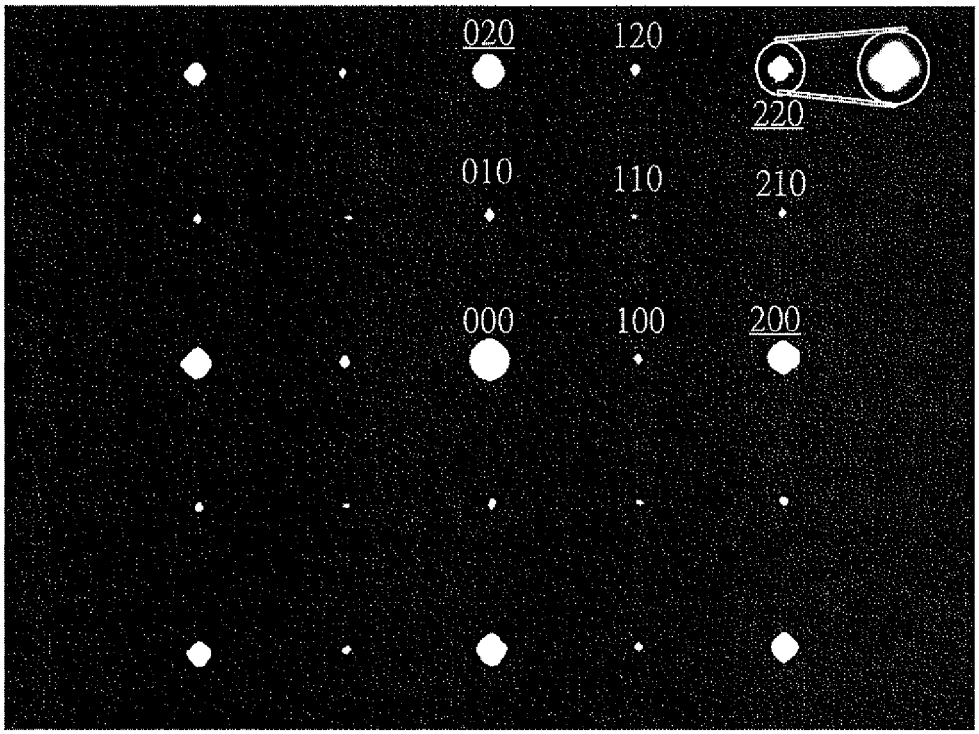
Figures 1, 1E, 2:
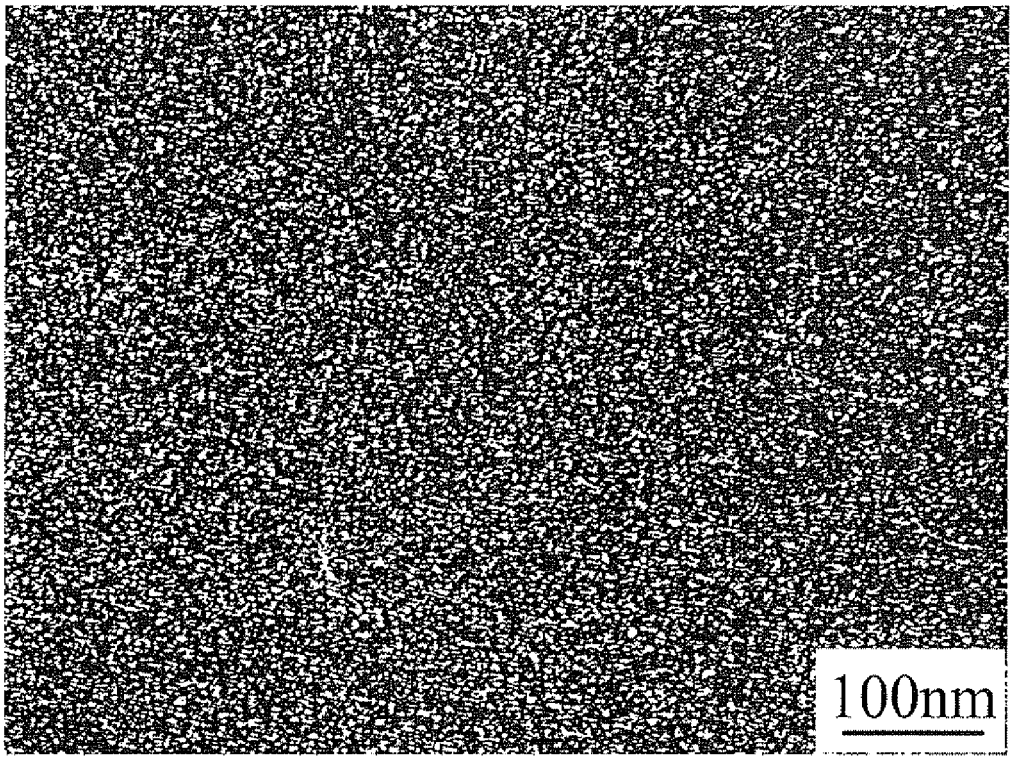
Figures 1, 1F:
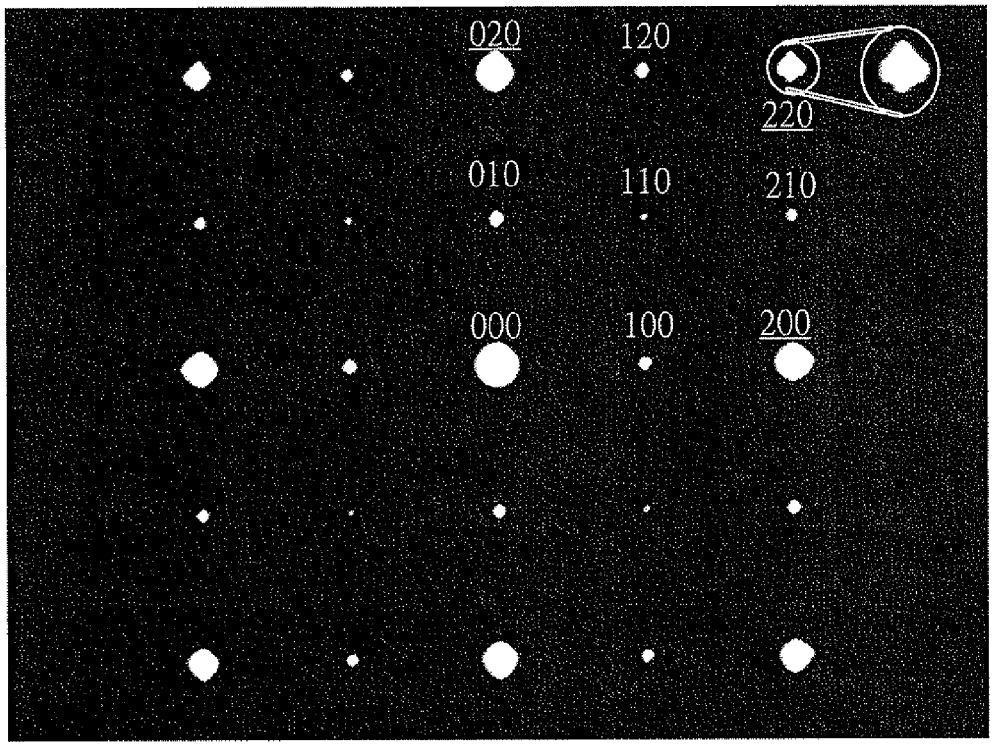
Figures 1, 1F, 2:
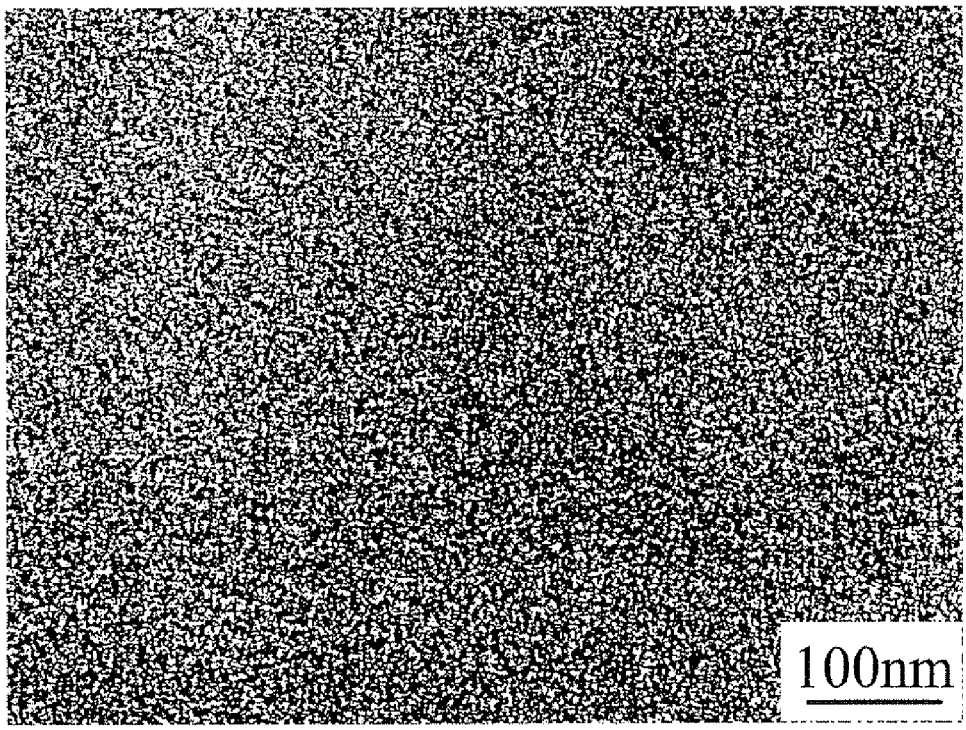
Figures 1, 1G:
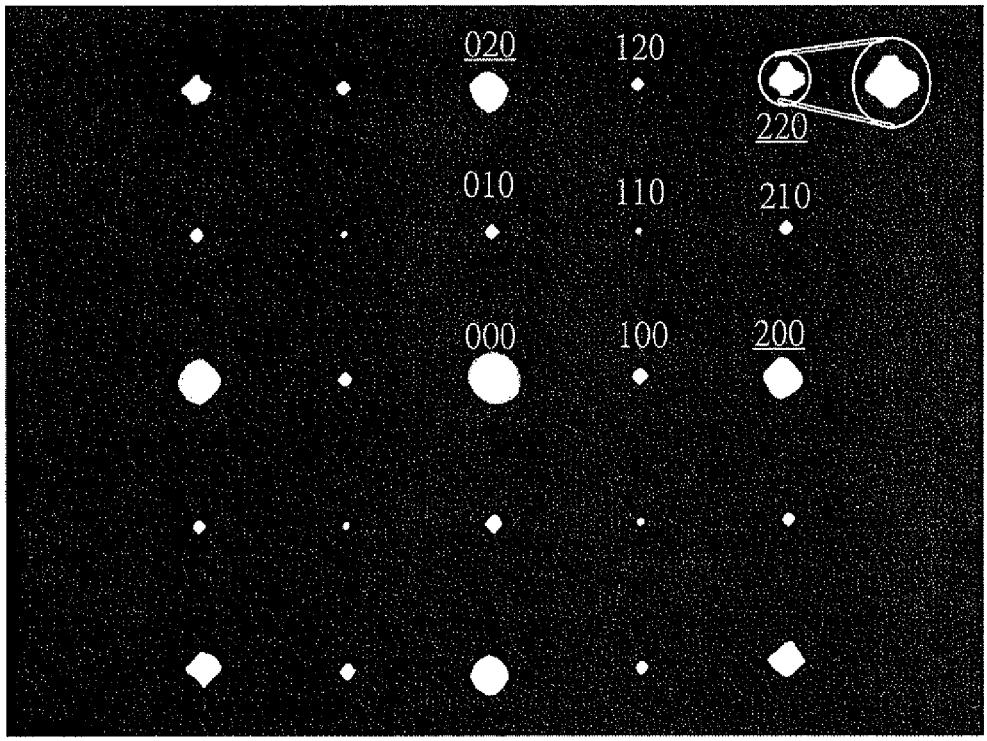
Figures 1, 1G, 2:
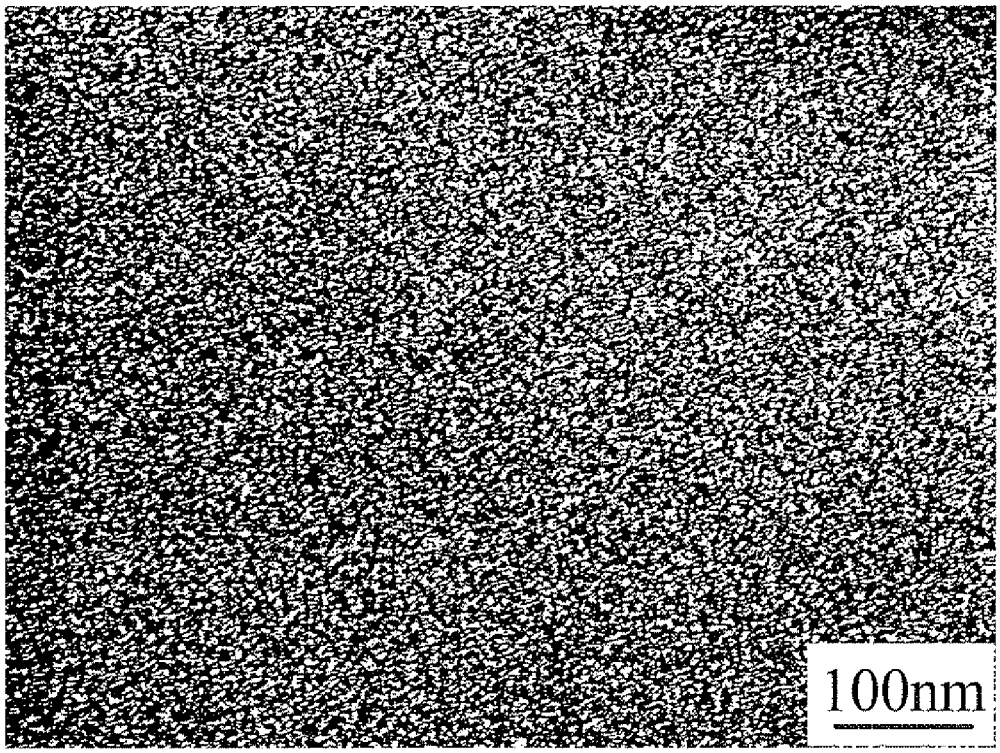
Figure 2A:
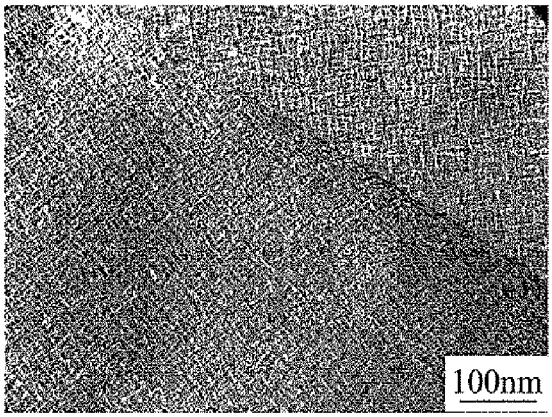
Figure 3A:
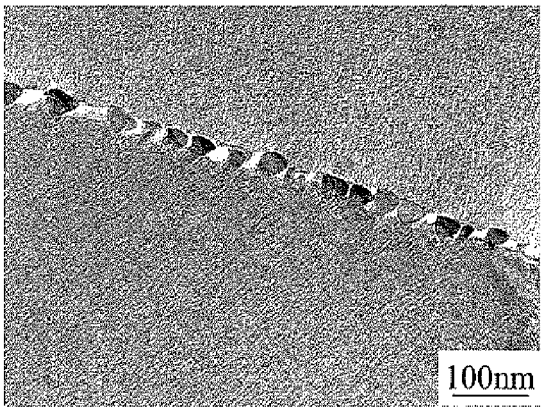
FIG. 3(*a*)~FIG. 3(*c*) Transmission electron micrographs of the as-quenched Fe-29.3 wt. % Mn-9.06 wt. % Al-2.21 wt. % C alloy.
Figure 2B:
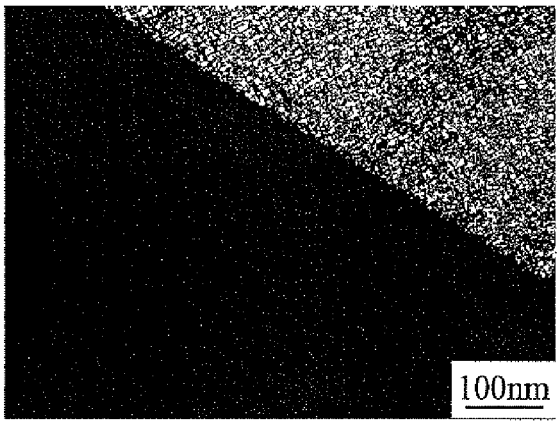
Figure 3B:
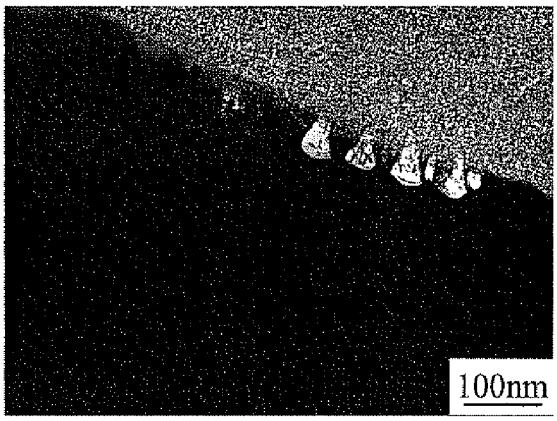
Figure 2C:
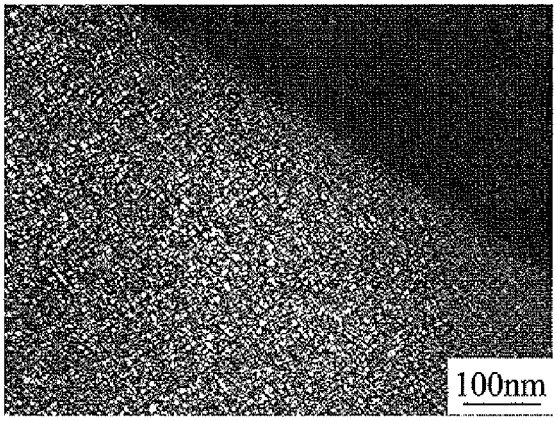
Figure 3C:
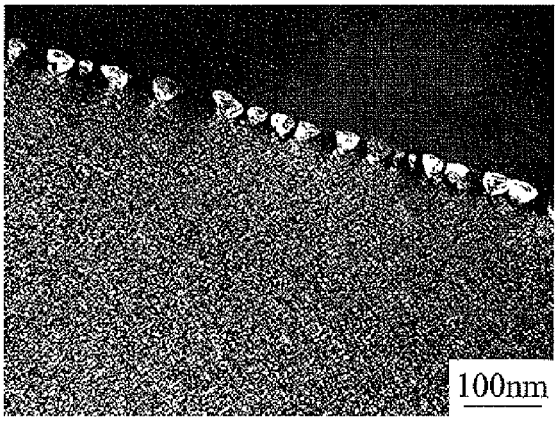
Figure 4A:
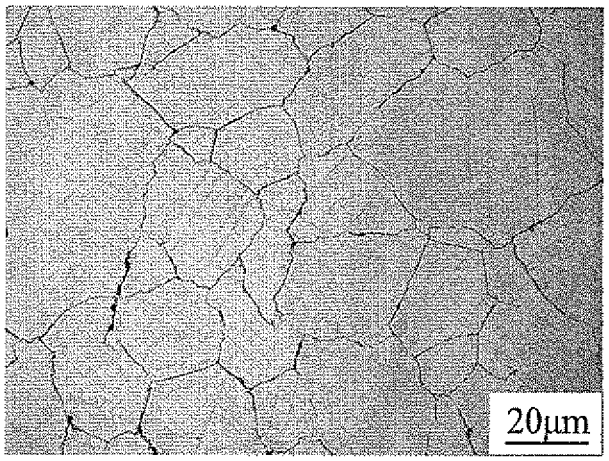
FIG. 4(*a*)~FIG. 4(*c*) Micrographs and EDS analysis of the as-quenched Fe-28.1 wt. % Mn-9.02 wt. % Al-6.46 wt. % Cr-1.75 wt. % C alloy.
Figure 4B:
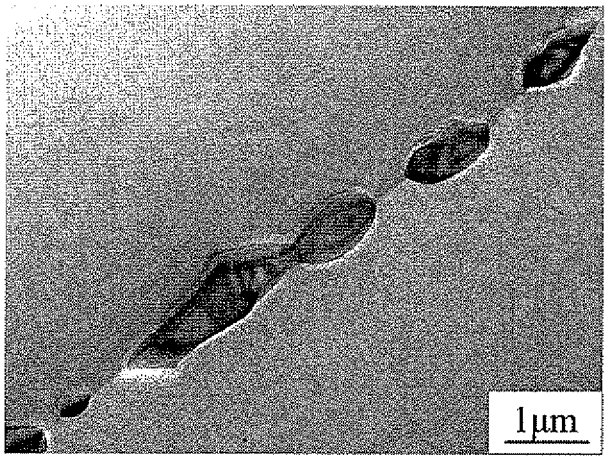
Figure 4C:
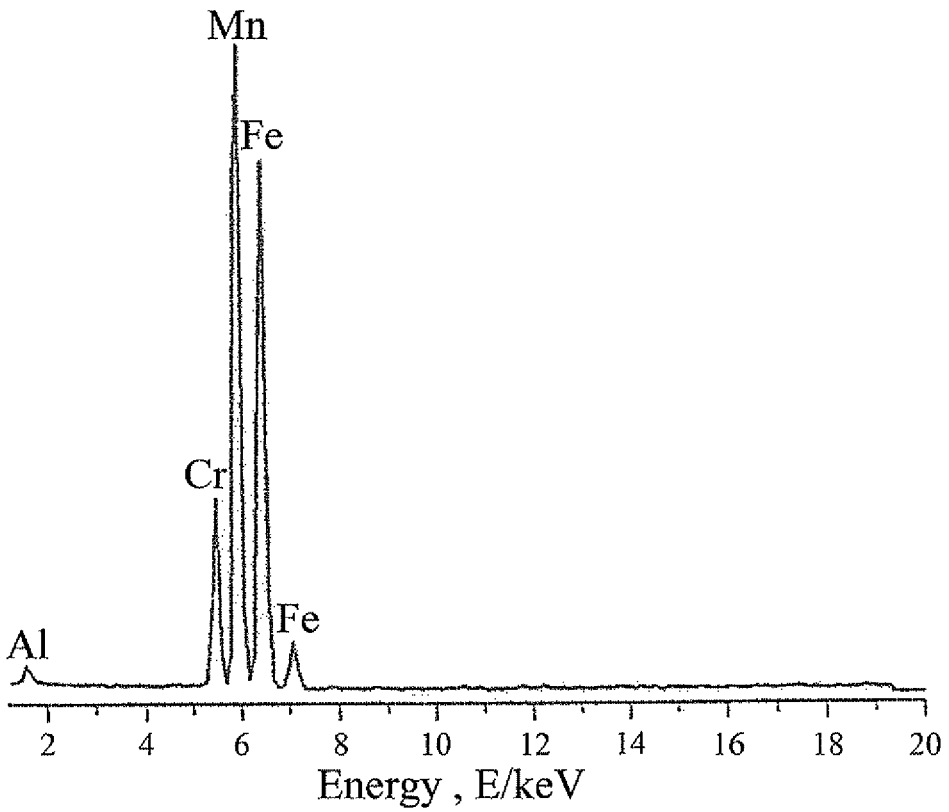
Figure 5A:
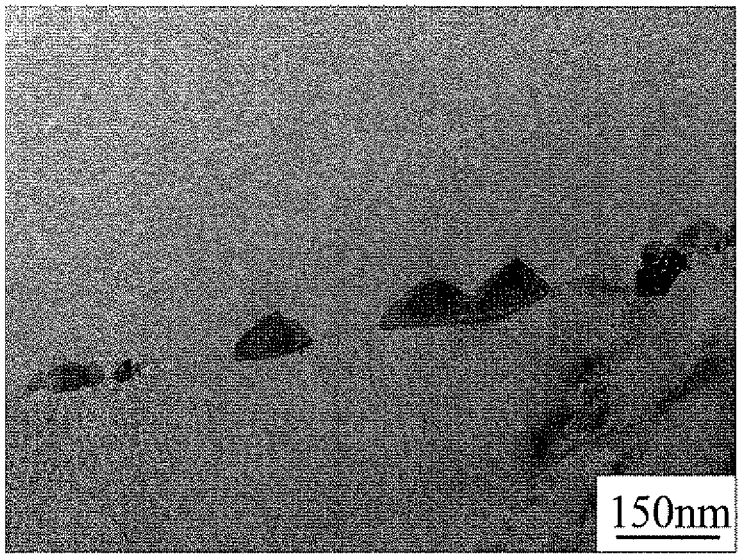
FIG. 5(*a*)~FIG. 5(*b*) Transmission electron micrographs of the as-quenched Fe-26.9 wt. % Mn-8.52 wt. % Al-2.02 wt. % Ti-1.85 wt. % C alloy.
Figure 5B:
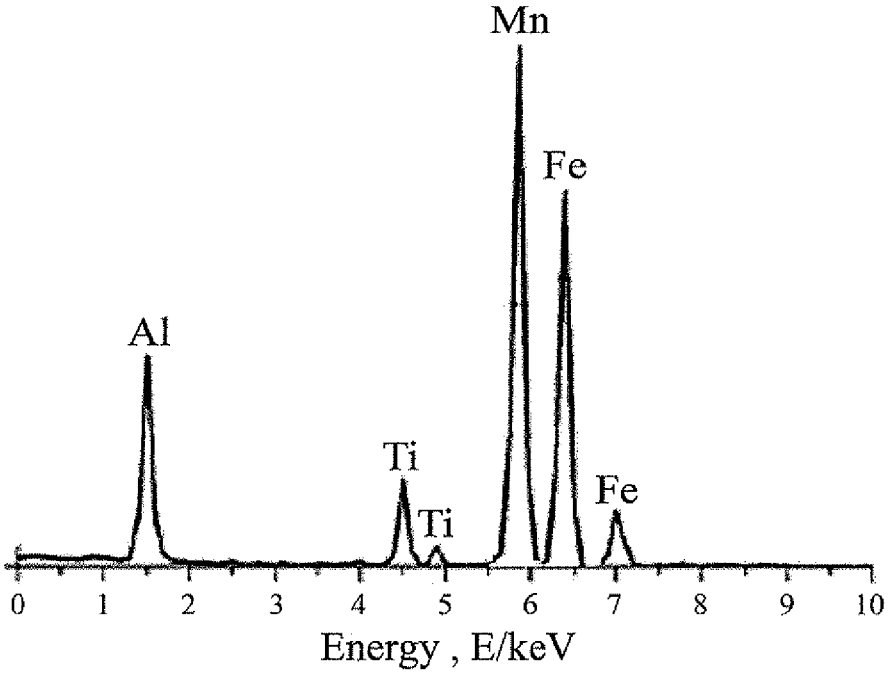
Figure 6A:
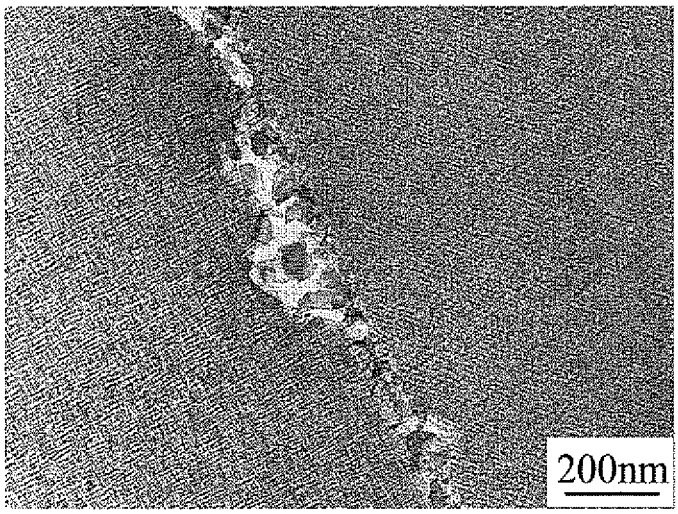
FIG. 6(*a*)~FIG. 6(*b*) Transmission electron micrographs of the Fe-28.3 wt. % Mn-9.12 wt. % Al-1.05 wt. % Mo-1.69 wt. % C alloy.
Figure 6B:
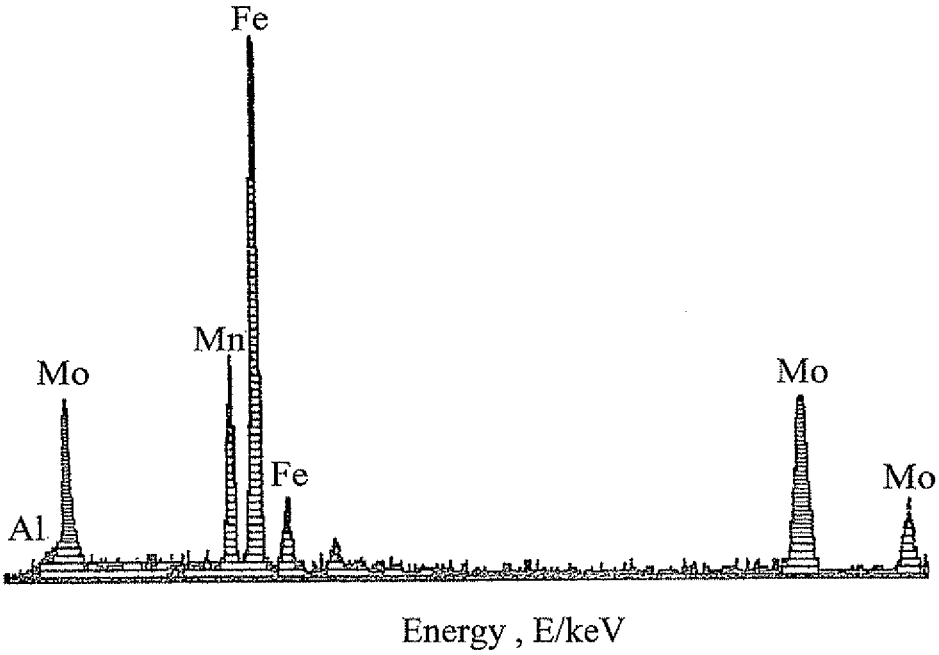
Figure 7A:
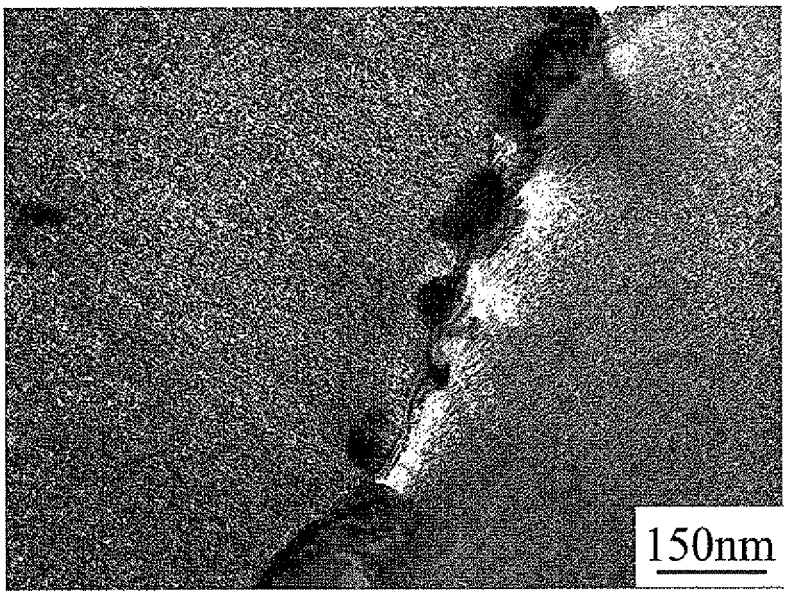
FIG. 7(*a*)~FIG. 7(*c*) Transmission electron micrographs of the as-quenched Fe-29.1 wt. % Mn-9.22 wt. % Al-0.80 wt. % Si-1.85 wt. % C alloy.
Figure 7B:
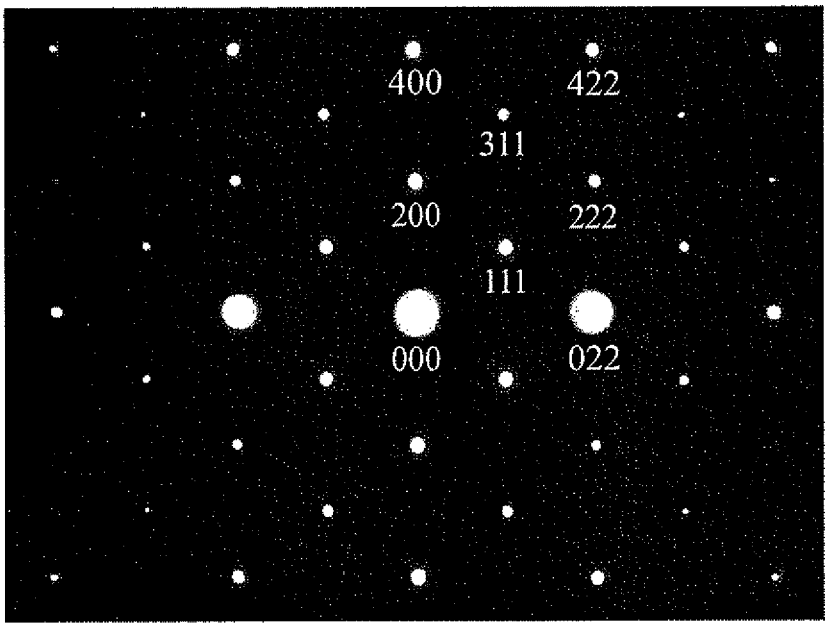
Figure 7C:
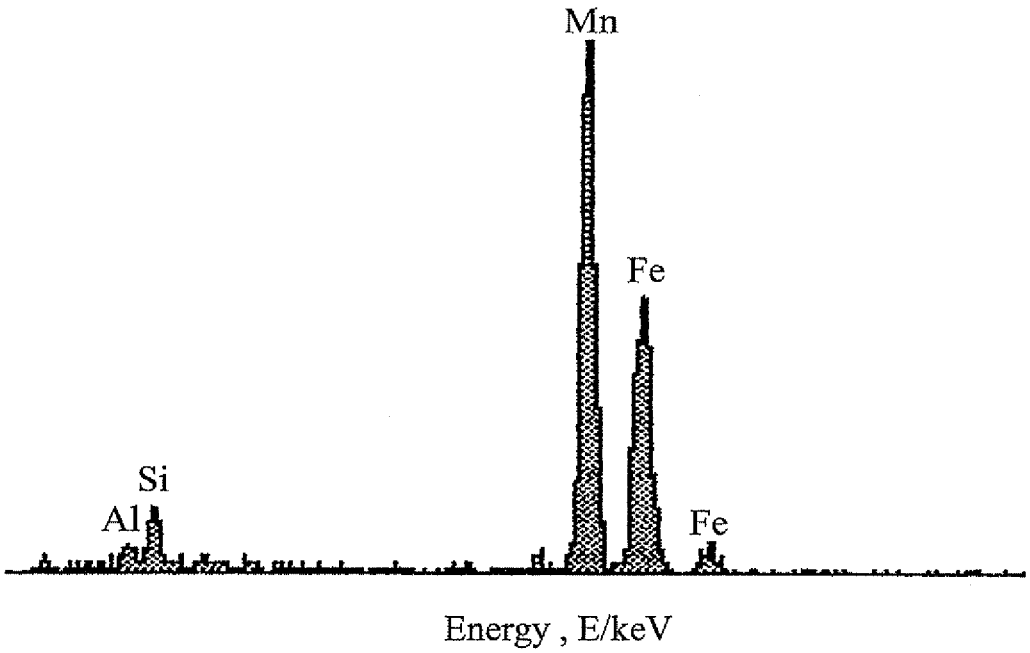

This example investigates the effects of aging time on microstructural evolution and associated mechanical properties of the same alloy shown in FIG. 1(*e*)-2, which was solution heat-treated, quenched and then aged at 500° C. and 550° C. for various times. Experiments confirmed that when the as-quenched Fe-29.0 wt. % Mn-9.76 wt. % Al-1.82 wt. % C alloy was aged at 500° C. for less than 8 hours, both the average particle size and volume fraction of the spinodal decomposition-induced κ'-carbides formed within the austenite matrix increased with increasing aging time. Moreover, within this aging time, no grain boundary precipitates could be observed and the mechanical strength of the alloy was increased with increasing aging time while keeping alloy reasonably ductile. However, as the aging time was increased to over 10 hours, the large κ-carbides started to precipitate on the austenite grain boundaries, resulting in significant reduction in ductility. These experimental results are similar to those observed in the alloys aged at 450° C. The present alloy can attain the best combination of mechanical strength and ductility when aged at 500° C. for about 8 hours. The detailed mechanical properties obtained under these aging conditions are also listed in FIG. 12 for comparisons.

FIG. 13 (*a*) shows a SEM image of the present alloy after being aged at 550° C. for 4 hours, indicating that the average particle size and volume fraction of the fine κ'-carbides increase as compared to the as-quenched alloy, and no precipitates can be observed on the grain boundaries. However, when the alloy was aged at 550° C. for 5 hours, some coarse precipitates started to appear on the grain boundaries, as shown in FIG. 13(*b*)-1. The SADP (FIG. 13(*b*)-2) and EDS (FIG. 13(*b*)-3) analyses indicate that the coarse precipitates formed on the grain boundaries were Mn-rich κ-carbides. As the aging time was further increased to 6 hours, the Mn-rich κ-carbides grew into the adjacent austenite grains through a $\gamma+\kappa' \rightarrow \gamma_0+\kappa$ reaction, as illustrated in FIG. 13(*c*). The formation of the $\gamma_0+\kappa$ lamellar structure on the grain boundaries would lead to the drastic drop of the ductility. Based on the observations described above, it is apparent that the present alloy can attain the best combination of mechanical strength and ductility when aged at 550° C. for 4 hours. The UTS, YS, and El of the alloys subjected to the abovementioned aging treatment are 1356 MPa, 1230 MPa, and 28.6%, respectively.

As described above, the as-quenched microstructure of the Fe—Mn—Al—C and Fe—Mn—Al-M-C with 0.54≤C≤1.3 wt. % alloys is single austenite phase or austenite phase with small amount of (V, Nb)C carbides. Consequently, for these alloys, it usually needs very long aging time (450° C., >500 hours; 500° C., 50~100 hours; 550° C., 15~16 hours) to attain the optimal combination of strength and ductility. However, in the C≥1.4 wt. % alloys disclosed in the present invention, a high-density of extremely fine κ'-carbides can be formed within the austenite matrix during quenching. Thus, the present invention clearly has the apparent novelties and technological features of nonobviousness, especially in the efficiency of aging treatments.

Example 4

FIG. 14(*a*) shows the cross-sectional SEM image of an Fe-28.6 wt. % Mn-9.26 wt. % Al-1.98 wt. % C alloy disclosed in the present invention, which was solution heat-treated, quenched and then directly placed into a plasma nitriding chamber filled with 50% $N_2$+50% $H_2$ mixed gas at 4 torr pressure. The plasma nitriding treatment was carried out at 450° C. for 12 hours. It can be seen that, after being etched, the cross-section of the nitrided alloy can be roughly divided into three regions, from top to bottom: a layer of bright white appearance, followed by a layer of grayish region, and finally the original alloy matrix. The thickness of the nitrided layer obtained under these conditions was about 10 μm. In order to further delineate the structural changes in the nitrided layer as a function of depth, cross-sectional TEM analyses were performed. FIG. 14(*b*)-1 shows the bright-field image of the area indicated by the dashed rectangle (marked as A) shown in FIG. 14(*a*).

The area marked as "I" represents the bright white region, while the area marked as "II" is corresponding to the grayish region, as shown in FIG. 14(*a*), respectively. FIGS. 14(*b*)-2~(b)-4 are the SADPs taken from the area "I" in FIG. 14(*b*)-1. Analyses of these SADPs indicated that the nitride in that area is AlN having a FCC structure with lattice constant a=0.407 nm. The zone axes are [001], [011], and [$\bar{1}$11], respectively. FIG. 14(*c*)-1 is the enlarged TEM bright-field image of the area "II" marked in FIG. 14(*b*)-1. The corresponding SADPs for the [001], [011], [$\bar{1}$11] and [$\bar{2}$11] zone axes are shown in FIGS. 14(*e*)-2~14(*c*)-5, respectively. In these SADPs, it is evident that area "II" is composed of two FCC-structured phases with very close lattice parameters. The analyses indicated that the diffraction spots closer to the center with higher intensity are originated from the AlN phase, while those slightly outside of the center with weaker intensity belong to the FCC structured $Fe_4N$ phase. From FIG. 14(*c*)-2~14(*c*)-5, it is evident that the crystallographic orientation relationship between AlN and $Fe_4N$ is $(110)_{AlN}//(110)_{Fe_4N}$ and $[001]_{AlN}//[001]_{Fe_4N}$. FIG. 14(*c*)-6 shows the dark-field image for the AlN phase, i.e. the white regions corresponding to AlN and the dark regions belong to $Fe_4N$, indicating that the area is mainly composed of AlN with small amount of $Fe_4N$.

FIGS. 14(*d*)-1~14(*d*)-3 show the TEM bright-field image, SADP, and $(100)_{\kappa'}$ dark-field image in the vicinity of interface between the nitrided layer and austenite matrix (i.e. the C-area in FIG. 14(*a*)). In FIG. 14(*d*)-2, it is clear that the primary phases existing in this region are AlN, κ'-carbides, and the austenite matrix. The crystallographic orientation relationship between AlN and austenite matrix is cubic to cubic with $(110)_{AlN}//(110)_{\gamma}$ and $[001]_{AlN}//[001]_{\gamma}$. The image analysis shown in FIG. 14(*d*)-3 reveals that the average size of the κ'-carbides has grown to about 20~30 nm. FIG. 14(*e*) shows the microhardness of the nitrided alloy as a function of depth, indicating that the surface microhardness is extremely high, reaching up to 1753 Hv, and the microhardness gradually decreases until it reaches the microhardness of austenite+κ'-carbides matrix. The result of tensile test indicates that the UTS, YS, and El of the present nitrided alloy are 1512 MPa, 1402 MPa, and 30.5%, respectively, which are comparable to those obtained for the same alloy aged at 450° C. for 12 hours (without nitriding treatment). FIG. 14(*f*) shows the SEM image of the fracture surface of the nitrided alloy after tensile test, revealing: (1) There are only a few small microvoids existing in the nitrided layer and these small microvoids do not show any sign of propagation; (2) The fracture surface within the austenite+κ'-carbides matrix exhibits a high density of fine dimples, indicating that the nitrided alloy still maintains excellent ductility similar to that obtained in the aged alloys; (3) Perhaps the most striking observation is that, even the nitrided alloy has been subjected to a very large tensile deformation, there is no observable cracks existing in the vicinity of the interface between the nitrided layer and the matrix. This may be due to the fact that the AlN and $Fe_4N$ phases existing in the nitrided layer have the same highly ductile FCC structure as the austenite matrix.

FIG. 14(*g*) shows the typical corrosion polarization curves in the 3.5% NaCl solution for the as-quenched (without nitriding treatment) and nitrided alloy disclosed in the present invention. A Standard Calmomel Electrode (SCE) and a platinum wire were used as reference and auxiliary electrodes, respectively. Curves (a) and (b) are potentiodynamic polarization curves for the as-quenched alloy prior to nitriding treatment and the same alloy after being plasma nitrided at 450° C. for 12 hours, respectively. Comparing the two polarization curves, it is apparent that, due to the formation of an AlN+$Fe_4N$ nitrided layer, there is an obvious passivation region in curve (b). The corrosion potential ($E_{corr}$) and pitting potential ($E_{pp}$) are drastically improved from $E_{corr}$=−750 mV and $E_{pp}$=−520 mV to $E_{corr}$=+45 mV and $E_{pp}$=+1910 mV, indicating the tremendous improvements in corrosion resistance obtained from nitriding treatment. It is worthwhile to emphasize here that, comparing to the AISI 4140 and 4340 alloy steels as well as the AISI 410 and 17-4PH stainless steels after the complicated processes of austenization, quenching, tempering (or aging), and then optimal nitriding treatments, the present nitrided alloy has exhibited far superior performances in virtually every aspect over these commercially available high-strength alloy steels and stainless steels, including mechanical strength, ductility, surface microhardness, as well as the corrosion resistance in 3.5% NaCl solution. Detailed comparisons can be made by referring to FIG. 15.

Example 5

This example illustrates the results obtained for an Fe-30.5 wt. % Mn-8.68 wt. % Al-1.85 wt. % C alloy disclosed in the present invention. The alloy was solution heat-treated, quenched and then directly placed into a plasma nitriding chamber filled with 65% $N_2$+35% $H_2$ mixed gas at 1 torr pressure. The plasma nitriding treatment was carried out at 500° C. for 8 hours. The cross-sectional SEM image of the nitrided alloy is shown in FIG. 16(*a*). It is evident that the thickness of the nitrided layer can reach about 40 μm, which is much thicker than that obtained for the alloy treated at 450° C. for 12 hours (~10 μm).

In order to further investigate the structure of the nitrided layer, X-ray diffraction analysis was performed. FIG. 16(*b*) shows the XRD result for the alloy after nitriding treatment at 500° C. for 8 hours. It can be seen that, in addition to the (111), (200), and (222) diffraction peaks of the austenite matrix, the diffraction peaks of AlN (111), (200), and (220), and $Fe_4N$ (111), (200), and (220) can be detected. Both AlN and $Fe_4N$ phases have FCC structure. Moreover, the intensity of the diffraction peaks of AlN phase is much higher than those of $Fe_4N$ phase. Based on these observations, it is clear that the nitrided layer is composed predominantly of AlN phase with less amount of $Fe_4N$ phase. FIG. 16(*c*) shows the microhardness of the nitrided alloy as a function of depth. It is evident that the surface microhardness reaches 1860 Hv at the top surface and then gradually decreases toward the center of the alloy until finally reaches 550 Hv at the depth of about 40 μm, which is consistent with the nitrided layer thickness obtained from SEM observation.

The above results indicate that the surface microhardness of the alloy nitrided at 500° C. for 8 hours is slightly higher than that obtained in alloys after nitriding treatment at 450° C. for 12 hours. The UTS, YS, and El of the alloy nitrided at 500° C. for 8 hours are 1388 MPa, 1286 MPa, and 33.6%, respectively, which are comparable to those obtained for the alloy aged at 500° C. for 8 hours (without nitriding treatment). FIG. 16(*d*) shows the SEM image of the fracture surface of the nitrided alloy after tensile test. It is clear that a high density of fine dimples can be detected within the austenite κ'-carbides matrix, and no evidence of microvoids and microcracks can be observed in the nitrided layer as well as in the vicinity of the interface between the nitrided layer and the matrix. This is due to the fact that the nitrided layer is mainly composed of AlN and small amount of $Fe_4N$; both phases have the same FCC structure as the ductile austenite matrix. These results are also similar to those observed in alloys after nitriding at 450° C. for 12 hours. FIG. 16(*e*) shows the typical corrosion polarization curves in the 3.5% NaCl solution for the as-quenched (without nitriding treatment) and nitrided alloys disclosed in the present invention. A Standard Calmomel Electrode (SCE) and a platinum wire were used as reference and auxiliary electrodes, respectively. Curves (a) and (b) are the potentiodynamic polarization curves for the as-quenched alloy prior to nitriding treatment and the same alloy after plasma nitriding at 500° C. for 8 hours. Comparing the two polarization curves, it is apparent that, due to the formation of a 40 μm-thick nitrided layer consisting of AlN+$Fe_4N$, there is an obvious passivation region in curve (b). The corrosion potential ($E_{corr}$) and pitting potential ($E_{pp}$) are drastically improved to $E_{corr}$=+50 mV and $E_{pp}$=+2030 mV, respectively. Similar to those obtained in alloys nitrided at 450° C. for 12 hours, nitriding treatment has indeed resulted in tremendous improvements in corrosion resistance of the alloys disclosed in the present invention. The fact that the pitting potential for the alloys nitrided at 500° C. for 8 hours ($E_{pp}$=+2030 mV) is larger than that obtained for alloys nitrided at 450° C. for 12 hours ($E_{pp}$=+1910 mV) is believed to be due to the difference in the thickness of the nitrided layers obtained under the two different plasma nitriding treatment conditions. Obviously, comparing to the high-strength AISI 4140 and 4340 alloy steels, as well as the AISI 410 martensitic and 17-4PH precipitation-hardening stainless steels after the complicated processes of austenization, quenching, tempering (or aging) and then optimal nitriding, the present nitrided alloy has indeed exhibited far superior performances in virtually every aspect over these commercially available alloy steels and stainless steels, including mechanical strengths, ductility, surface microhardness, as well as the corrosion resistance in 3.5% NaCl solution. Detailed comparisons can be made by referring to FIG. 15.

Example 6

This example illustrates the results obtained for an Fe-28.5 wt. % Mn-7.86 wt. % Al-1.85 wt. % C alloy disclosed in the present invention. The alloy was solution heat-treated, quenched and then directly placed into a gas nitriding chamber filled with 60% $NH_3$+40% $N_2$ mixed gas at the ambient pressure. The gas nitriding treatment was carried out at 550° C. for 4 hours. FIG. 17(*a*) is the cross-sectional SEM image of the nitrided alloy. Under the present nitriding condition, the thickness of the nitrided layer is about 25 μm, which is thicker than that obtained for alloys plasma nitrided at 450° C. for 12 hours (~10 μm), but is thinner than that obtained for alloys plasma nitrided at 500° C. for 8 hours (~40 μm). FIG. 17(*b*) shows the XRD result for the alloy after gas nitriding at 550° C. for 4 hours. It is seen that in addition to the (111), (200), and (222) diffraction peaks of the austenite matrix, the diffraction peaks of AlN (111), (200), and (220) and $Fe_4N$ (111), (200), and (220) can also be detected. Obviously, the intensity of the diffraction peaks of AlN phase is much higher than those of $Fe_4N$ phase. Based on these observations, it is evident that the nitrided layer is composed predominantly of AlN phase with less amount of $Fe_4N$ phase. These results are similar to those obtained for the alloys after plasma nitriding at 500° C. for 8 hours. FIG. 17(*c*) shows the microhardness of the nitrided alloy as a function of depth. It is evident that the microhardness reaches 1514 Hv at the top surface and then gradually decreases toward the center of the alloy until finally reaches a constant value of 530 Hv at the depth of about 25 μm and beyond, which is consistent with the nitrided layer thickness obtained from SEM observation.

The surface microhardness of the alloy gas nitrided at 550° C. for 4 hours is somewhat lower than that obtained from the alloys plasma nitrided at 450° C. for 12 hours, as well as at 500° C. for 8 hours. The UTS, YS, and El of the alloy gas nitrided at 550° C. for 4 hours are 1363 MPa, 1218 MPa, and 33.5%, respectively, which are also comparable to those obtained for the alloy aged at 550° C. for 4 hours (without nitriding treatment). FIG. 17(*d*) shows the SEM image of the fracture surface of the gas nitrided alloy after tensile test. Similar to the observations in alloys after plasma nitriding at 450° C. for 12 hours and 500° C. for 8 hours, no evidence of microvoids and microcracks can be observed in the nitrided layer and in the vicinity of the interface between the nitrided layer and the matrix.

FIG. 17(*e*) shows the typical corrosion polarization curves in the 3.5% NaCl solution for the as-quenched (without nitriding treatment) and gas nitrided alloys disclosed in the present invention. A Standard Calmomel Electrode (SCE) and a platinum wire were used as reference and auxiliary electrodes, respectively. Curves (a) and (b) are the potentiodynamic polarization curves for the as-quenched alloy prior to nitriding treatment and the same alloy after gas nitriding at 550° C. for 4 hours, respectively. Similarly, due to the formation of AlN+$Fe_4N$ nitrided layer, the corrosion potential ($E_{corr}$) and pitting potential ($E_{pp}$) are drastically improved to $E_{corr}$=+160 mV and $E_{pp}$=+2810 mV, respectively. It is obvious that nitriding treatment has indeed resulted in tremendous improvements in corrosion resistance of the alloys disclosed in the present invention. Both the corrosion potential and pitting potential of the 550° C. gas nitrided alloys are better than those obtained from 450° C. plasma nitrided ($E_{corr}$=+45 mV; $E_{pp}$=+1910 mV) and 500° C. plasma nitrided ($E_{corr}$=+50 mV; $E_{pp}$=+2030 mV) alloys. Detailed comparisons can be made by referring to FIG. 15.

The examples described above are merely for the purposes of clarifying the novel features of the alloy design and processing methods disclosed in the present invention, and they should not be deemed as the scope of the present invention. All the alternatives based on the claims of the present invention should be regarded as being included in the scope of the patent.

What is claimed is:

1. A processing method for fabricating a wrought FeMnAlC alloy, the method comprising:

melting, casting, and then hot-working an alloy containing, by weight, 23 to 34 percent manganese (Mn), 6 to 12 percent aluminum (Al), 1.45 to 2.2 percent carbon (C), and balance essentially iron (Fe);

solution heat-treating said alloy at 980° C. to 1200° C. for 2 hours followed by quenching to room-temperature water or ice water; and aging said alloy at 450° C. to 550° C.

2. A processing method for fabricating a wrought FeMnAlC alloy, the method comprising:

melting, casting, and then hot-working an alloy containing, by weight, 25 to 32 percent manganese (Mn), 7.0 to 10.5 percent aluminum (Al), 1.6 to 2.1 percent carbon (C), and balance essentially iron (Fe);

solution heat-treating said alloy at 980° C. to 1200° C. for 2 hours followed by quenching to room-temperature water or ice water; and aging said alloy at 450° C. to 550° C.

3. A processing method for fabricating a wrought FeMnAlC alloy, the method comprising:

melting, casting, and then hot-working an alloy containing, by weight, 23 to 34 percent manganese (Mn), 6 to 12 percent aluminum (Al), 1.45 to 2.2 percent carbon (C), and balance essentially iron (Fe);

solution heat-treating said alloy at 980° C. to 1200° C. for 2 hours followed by quenching to room-temperature water or ice water; and placing said alloy into a plasma nitriding chamber and conducting a plasma nitriding treatment at 450° C. to 550° C. to form a nitrided layer.

4. The processing method according to claim 3, wherein the gas used for plasma nitriding treatment is consisted of 20 to 80% nitrogen and balance hydrogen, wherein the total pressure of the mixed gas in the nitriding chamber is 1 to 6 torr.

5. The processing method according to claim 3, wherein said nitrided layer formed during nitriding treatment consists predominantly of FCC-structured AlN and traced amount of FCC-structured $Fe_4N$, wherein FCC means Face-Centered Cubic.

6. A processing method for fabricating a wrought FeMnAlC alloy, the method comprising:

melting, casting, and then hot-working an alloy containing, by weight, 23 to 34 percent manganese (Mn), 6 to 12 percent aluminum (Al), 1.45 to 2.2 percent carbon (C), and balance essentially iron (Fe);

solution heat-treating said alloy at 980° C. to 1200° C. for 2 hours followed by quenching to room-temperature water or ice water; and placing said alloy into a gas nitriding furnace and conducting a gas nitriding treatment at 450° C. to 550° C. to form a nitrided layer.

7. The processing method according to claim 6, wherein the gas used for gas nitriding treatment is consisted of 20 to 80% ammonia and balance nitrogen.

8. The processing method according to claim 6, wherein the gas used for gas nitriding treatment is consisted of 20 to 80% ammonia and balance nitrogen and hydrogen.

9. The processing method according to claim 6, wherein said nitrided layer formed during nitriding treatment consists predominantly of FCC-structured AlN and traced amount of FCC-structured $Fe_4N$, wherein FCC means Face-Centered Cubic.

10. A processing method for fabricating a wrought FeMnAlC alloy, the method comprising:

melting, casting, and then hot-working an alloy containing, by weight, 25 to 32 percent manganese (Mn), 7.0 to 10.5 percent aluminum (Al), 1.6 to 2.1 percent carbon (C), and balance essentially iron (Fe);

solution heat-treating said alloy at 980° C. to 1200° C. for 2 hours followed by quenching to room-temperature water or ice water; and placing said alloy into a plasma nitriding chamber and conducting a plasma nitriding treatment at 450° C. to 550° C. to form a nitrided layer.

11. The processing method according to claim 10, wherein the gas used for plasma nitriding treatment is consisted of 20 to 80% nitrogen and balance hydrogen, wherein the total pressure of the mixed gas in the nitriding chamber is 1 to 6 torr.

12. The processing method according to claim 10, wherein said nitrided layer formed during nitriding treatment consists predominantly of FCC-structured AlN and traced amount of FCC-structured $Fe_4N$, wherein FCC means Face-Centered Cubic.

13. A processing method for fabricating a wrought FeMnAlC alloy, the method comprising:

melting, casting, and then hot-working an alloy containing, by weight, 25 to 32 percent manganese (Mn), 7.0 to 10.5 percent aluminum (Al), 1.6 to 2.1 percent carbon (C), and balance essentially iron (Fe);

solution heat-treating said alloy at 980° C. to 1200° C. for 2 hours followed by quenching to room-temperature water or ice water; and placing said alloy into a gas nitriding furnace and conducting a gas nitriding treatment at 450° C. to 550° C. to form a nitrided layer.

14. The processing method according to claim 13, wherein the gas used for gas nitriding treatment is consisted of 20 to 80% ammonia and balance nitrogen.

15. The processing method according to claim 13, wherein the gas used for gas nitriding treatment is consisted of 20 to 80% ammonia and balance nitrogen and hydrogen.

16. The processing method according to claim 13, wherein said nitrided layer formed during nitriding treatment consists predominantly of FCC-structured MN and traced amount of FCC-structured $Fe_4N$, wherein FCC means Face-Centered Cubic.

* * * * *